US005550795A

United States Patent [19]

Takakura et al.

[11] Patent Number: 5,550,795

[45] Date of Patent: Aug. 27, 1996

[54] ELECTRONIC TIMEPIECE AND A METHOD OF DRIVING A STEPPING MOTOR OF ELECTRONIC TIMEPIECE

[75] Inventors: Akira Takakura; Jun Hirotomi, both of Tokyo, Japan

[73] Assignee: Seiko Instruments Inc., Japan

[21] Appl. No.: 302,923

[22] PCT Filed: Jan. 12, 1994

[86] PCT No.: PCT/JP94/00030

§ 371 Date: Sep. 19, 1994

§ 102(e) Date: Sep. 19, 1994

[87] PCT Pub. No.: WO94/16365

PCT Pub. Date: Jul. 21, 1994

[30] Foreign Application Priority Data

| | | | |
|---|---|---|---|
| Jan. 18, 1993 | [JP] | Japan | 5-006163 |
| Feb. 12, 1993 | [JP] | Japan | 5-024311 |
| Mar. 4, 1993 | [JP] | Japan | 5-044182 |
| Mar. 11, 1993 | [JP] | Japan | 5-051111 |
| Mar. 25, 1993 | [JP] | Japan | 5-067127 |
| Apr. 14, 1993 | [JP] | Japan | 5-087660 |
| Oct. 4, 1993 | [JP] | Japan | 5-248204 |

[51] Int. Cl.[6] ..... G04F 5/00; G04B 19/00

[52] U.S. Cl. ..... 368/157; 318/696; 368/160

[58] Field of Search ..... 368/157, 160; 318/696

[56] References Cited

U.S. PATENT DOCUMENTS

| | | | |
|---|---|---|---|
| 3,812,670 | 5/1974 | Nikaido et al. | 368/159 |
| 4,477,196 | 10/1984 | Ito | 368/157 |
| 4,599,005 | 7/1986 | Kawamura et al. | 368/157 |
| 4,715,725 | 12/1987 | Kawamura et al. | 368/157 |
| 5,038,329 | 8/1991 | Kawamura et al. | 368/157 |

*Primary Examiner*—Bernard Roskoski
*Attorney, Agent, or Firm*—Adams & Wilks

[57] ABSTRACT

To obtain an electronic clock which realizes miniaturization and low power consumption, and improves the precision of the rotation detection of a rotor by supplying a stepping motor with an effective power in accordance with the increase of a load to the stepping motor with time and performance of parts.

A detect assistant pulse is supplied to the stepping motor to amplify a voltage induced by the rotational motion of the rotor which occurs after the main drive pulse is interrupted.

13 Claims, 52 Drawing Sheets

FIG. 7A
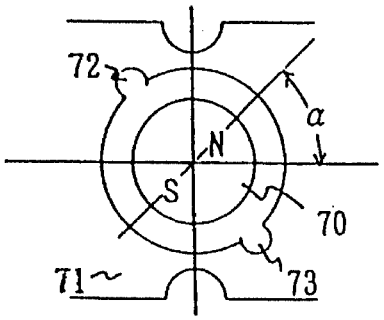
FIG. 7B
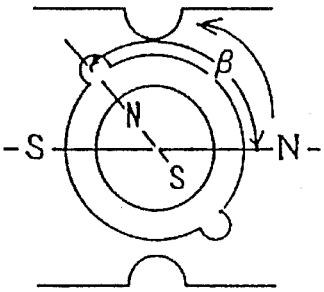
FIG. 7C
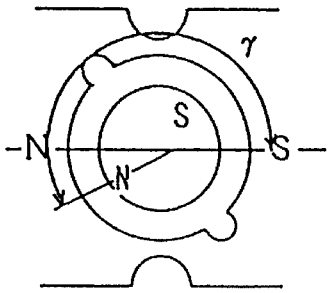
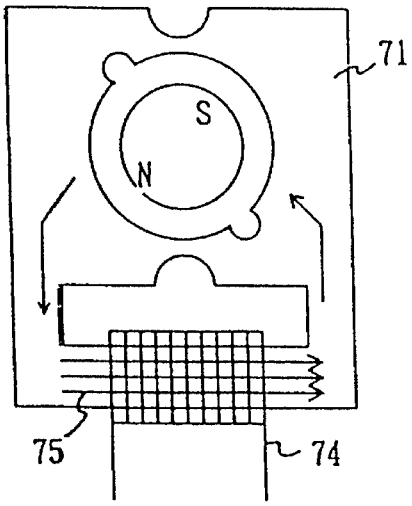
FIG. 7D
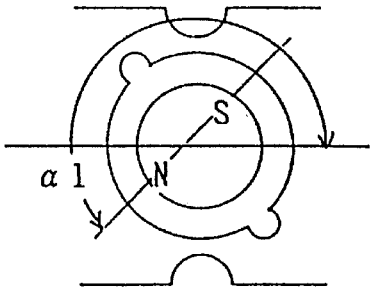
FIG. 7E

ELECTRONIC TIMEPIECE AND A METHOD OF DRIVING A STEPPING MOTOR OF ELECTRONIC TIMEPIECE

FIELD OF THE INVENTION

The present invention relates to an electronic timepiece and a method of driving a stepping motor of electronic timepiece in which plural detection assisting pulses are output to a stepping motor after turning off a main drive pulse, thereby performing stable detection of the rotation of the stepping motor.

BACKGROUND ART

In a stepping motor of a conventional electronic timepiece, a stepping motor driving means has been used in which a main driving pulse train having low effective power is output to the stepping motor to reduce current-consumption, and wherein the rotational state of a rotor is detected by known means to output a correction drive pulse to the stepping motor in accordance with the detection result. Practical examples of this is known technology are disclosed in Japanese publication of applications No. 61-8392 and No. 63-18148, for example.

With respect to the practical example illustrated in Japanese publication of application No. 61-8392, FIG. 2 diagrammatically shows a drive voltage waveform of a correction drive system, and FIG. 3 diagrammatically shows a voltage waveform after turning off a main drive pulse obtained by the drive system as shown in FIG. 2.

The drive voltage waveform diagram as shown in FIG. 2 is constructed by a main drive pulse P1 (hereinafter referred to as "P1") which is output to the stepping motor every second, a section DT for detecting the rotation of the stepping motor after P1, goes low and a correction drive pulse P2 (hereinafter referred to as "P2") which is output when the stepping motor is in non-rotational state. P1 automatically alters its pulse width in accordance with a load state to be applied to the stepping motor. P2 is output FIG. 3 shows a voltage waveform which is induced in a detection resistor by forming a closed loop in a coil after pulse turning off through the control of a MOS gate for driving the stepping motor or the like. As shown in FIG. 3, a rotation detecting method is used for detecting rotation of the rotor by electrically detecting whether the induced level reaches a predetermined voltage on the basis of the fact that the induced voltage in the section DT is different between a rotational state (as indicated by a solid line in FIG. 3) and a non-rotational state (as indicated by a dotted line in FIG. 3).

This detection means is characterized in that the rotor which is rotated with the main drive pulse makes free attenuating motion due to residual magnetic potential energy in the rotor after the main drive pulse goes low, and the variation of the induced voltage occurring in the coil during the attenuating motion is used as the rotation detecting means.

With respect to the practical example which is illustrated in Japanese publication of application No. 63-18148, FIG. 4 shows an example of a drive voltage waveform diagram of a correction drive system, and FIG. 5 shows an example of a current waveform generated when the rotor is driven by the detection pulse.

The driving voltage waveform diagram of FIG. 4 is constructed by a main drive pulse P1 which is output to the stepping motor every second, detection pulses Px and Py which are used to detect the rotation of the stepping motor after P1 goes low, and a correction drive pulse P2 which is output when the stepping motor is in a non-rotational state at P1. P1 and P2 are identical to those of FIG. 2. The detection pulses Px, Py have such a short pulse width that the stepping motor cannot be rotated.

FIG. 5 shows the current waveform when the rotor is driven with the detection pulse, and the current waveform is varied as shown by a characteristic curve a or characteristic curve b of FIG. 5 in accordance with the orientation of the magnetic pole of the rotor. The reason for the difference in current waveform is that the current waveform is determined in accordance with whether the magnetic pole formed in a stator with detection pulse is in a state where the magnetic pole of the rotor magnet has a repulsive orientation or an attractive orientation. As shown by curve b of FIG. 5, the rotation detecting means for the rotor drives the rotor with the detection pulse, and identifies the orientation of the magnetic pole of the rotor on the basis of the difference in shape of the current waveform flowing in the coil at the driving time of the rotor, thereby to detect the rotation of the rotor.

The detecting means is characterized in that the rise-up voltage of the current waveform (the rise-up shape of the voltage waveform) is detected using the detection pulse having such effective power as to reduce the current consumption to detect the position of the magnetic pole of the rotor magnet, whereby the rotation of the rotor is detected.

However, the conventional rotation detecting method has the following problem for accurate judgment of the rotation of the rotor.

An induced voltage which is caused by the attenuating motion of the rotor within a predetermined time (for example, a period from the start of pulse application to 8–16 msec) has the relationship between the induced voltage and the pulse width of the main drive pulse as shown in FIG. 6 and the relationship between the induced voltage and the moment of inertia of the rotor as shown in FIG. 6.

The relationship between the main drive pulse and the pulse width is explained with the solid of FIG. 6 showing the induced voltage waveform.

When the main drive pulse is applied to the stepping motor, the induced voltage is a sufficiently high voltage in a range of the shortest pulse width T1 to a degree of long pulse width T2 where a normal stepping operation can be performed. However, when the pulse width exceeds T2, the induced voltage is rapidly lowered. This phenomenon is due to the following reason: the rotor has low magnetic potential energy after a pulse having a long pulse width is turned off, and the amplitude of the free attenuating motion of the rotor is reduced, so that the induced voltage is lowered in proportion with the amplitude of the attenuating motion of the rotor.

The relationship between the induced voltage and the inertia moment of the rotor is explained with the solid curve of FIG. 6 showing the induced voltage waveform. A stepping motor having a rotor of low inertia moment can not only reduce power consumption but can also more easily and rapidly rotate and stop. That is, the rotor of low inertia moment can be rotated with a small amount of effective power, and stopped in a short time after turning off a pulse through an attenuating motion of small amplitude. When the amplitude is small as described above, the absolute value of magnetic flux which intersects the coil is small, and the induced voltage caused by the attenuating motion of the rotor is also lowered. Further, since the free attenuating motion of the rotor is rapidly reduced, if a method of detecting the induced voltage in a predetermined time is used, the rotor almost approaches to a stopped state. Accordingly, there exists virtually no induced voltage which is caused by variation of magnetic flux per unit time, and the rotation state of the rotor is erroneously judged to be at a non-rotational state.

Accordingly, in the rotation detection method of the rotor using the induced voltage occurring after the application of the main drive pulse, if the power consumption is increased in order to lengthen the pulse width of the main drive pulse to improve a driving torque and the inertia moment of the rotor is reduced to lower the power consumption, the amplitude of the rotation free attenuating motion of the rotor after the turning off the pulse is lowered to induce the lowering of the induced voltage, resulting in the erroneous judgment of the rotation of the rotor.

Further, in the detection method using the detection pulse, the pulse width of the detection pulse must be designed to be long to some extent to enable accurate judgment of the magnetic pole of the rotor, and thus there occurs a problem that the current consumption of the stepping motor is increased.

Still further, the judgment on the rotation of the rotor is erroneously made if the detection pulse is output from a rest state of the rotor, and thus the output timing of the detection pulse must be delayed. Accordingly, the output timing of the correction drive pulse which is output in the non-rotational state of the rotor is delayed, so that the motion of an indicator is delayed and provides an unnatural display.

SUMMARY OF THE INVENTION

An object of this invention is to solve the problem of the prior art, and to provide a compact electronic time piece which can improve precision of detection of the rotation of a rotor, and utilize low power consumption.

In order to solve the above problem, an electronic time piece having a stepping motor and a gear train has a circuit construction comprising a detection assisting pulse generating circuit 1 for generating at least one detection assisting pulse which has an effective power such that the stepping motor 7 is not rotated by one step, on the basis of a clock pulse input from a dividing circuit 8, and outputting the generated pulse to a drive pulse selecting circuit 4, a main drive pulse generating circuit 3 for generating at least one kind of main drive pulse signal on the basis of the clock signal input from the dividing circuit 8 and outputting the generated main drive pulse signal to the drive pulse selecting circuit 4, a correction drive pulse generating circuit 2 for generating a correction drive pulse signal having a larger pulse width than the main drive pulse on the basis of the clock signal input from the dividing circuit 8 and outputting the generated correction drive pulse signal to the drive pulse selecting circuit 4, wherein the drive pulse selecting circuit selects the output or non-output of the correction drive pulse signal in accordance with the main drive pulse signal, the detection assisting pulse signal and a detection signal from a detecting circuit 6 and outputting the main drive pulse signal, the detection assisting pulse signal and the correction drive pulse signal to a driving circuit 5, wherein the driving circuit 5 converts the main drive pulse signal, the detection assisting pulse signal and the correction drive pulse signal input from the drive pulse selecting circuit 4 to effective power pulses and outputting the effective power pulses to the stepping motor 7, and wherein the detection circuit carries out a circuit switching operation on the basis of the clock signal input from the dividing circuit 8 to detect the rotation of the stepping motor 7 and generates a detection signal in accordance with a rotation detection result to output the detection signal to the detecting circuit 6, such that rotation of the stepping motor 7 can be accurately performed by applying the detection assisting pulse to the stepping motor 7, thereby to improve the detection precision.

In the electronic clock thus constructed, the detection assisting pulse is applied to the stepping motor a predetermined time after the interruption of the main drive pulse which is applied to the stepping motor one every second. The rotational angular velocity of the rotor which makes the attenuating motion after the interruption of the main drive pulse is amplified by the detection assisting pulse, and it is faster than before the application of the detection assisting pulse. The potential of the induced voltage occurring in the coil is heightened in proportion to the rotational angular velocity of the rotor.

It will be described with reference to FIGS. 7(*a*) to (*e*) and FIG. 8 that by applying the detection assisting pulse as described above, the rotational speed of the rotor is increased and the amplitude of the rotation attenuating motion is intensified.

FIG. 7(*a*) is a schematic diagram showing that the angle at which the rotor 70 is electrically stably at rest. A magnetic potential energy difference occurs between notches 72, 73 provided to a stator 71 and magnet of the rotor 70, and the rotor rests at the angle at which the energy difference is lowest.

When the main drive pulse P1 as shown in FIG. 8 is applied in the rest state of the rotor as shown in FIG. 7(*a*), magnetic flux 75 occurs in a coil 74, so that magnetic pole occurs in the stator 71 as shown in FIG. 7(*b*), and the rotor 70 starts its rotation in a direction as indicated by an arrow using a magnetic repulsive force.

When the main drive pulse P1 is interrupted after the rotor magnetic pole N exceeds an angle$\beta$ as shown in FIG. 8, the rotor 70 starts the free attenuating motion until it is at rest at an angle$\alpha$1 which provides a magnetically stable state. At this time, the rotor 70 occupies the magnetic potential energy and the rotational energy due to the inertia force by the main drive pulse.

Upon input of a detection assisting pulse Pa as shown in FIG. 8 to the driving circuit 5 when the rotor magnetic pole N reaches an angle $\gamma$ as shown in FIG. 7(*c*), magnetic flux 75 occurs in the coil 74, and the magnetic pole as shown in FIG. 7(*c*) is induced in the stator 71. The rotor 70 is supplied with rotational energy due to the magnetic repulsive forces, and the amplitude of the free attenuating motion is intensified as shown by the waveform of the solid line of FIG. 8.

When the amplitude of the free attenuating motion of the rotor is intensified, as shown in FIG. 7(*d*), the variation of the magnetic flux 75 which intersects the coil 74 is also increased, and current induced in the coil 74 is increased. The waveform of the dotted line of FIG. 8 indicates a rotational state of the rotor when no detection assisting pulse is applied to the stepping motor, and the induced current is small because the amplitude of the rotor is low and the variation of the magnetic flux 75 intersecting the coil 74 is small.

The rotor 70 after the interruption of the detection assisting pulse undergoes free attenuating motion as shown by the waveform of the solid line of FIG. 8, and then it stops at the magnetically stable angle as shown in FIG. 7(*e*).

As described above, the application of the detection assisting pulse Pa inducing the rotational motion of the rotor during the free attenuating motion after the main drive pulse P1 intensifies the amplitude of the attenuating motion and the variation of the magnetic flux intersecting the coil which is required to detect the rotation of the rotor, and thus it has an effect of increasing the induced voltage. Accordingly, according to this invention using the detection system of electrically comparing the induced voltage with a predetermined reference voltage, the potential of the induced voltage is heightened with the detection assisting pulse, and this enables the rotation detection of the stepping motor to be easily and accurately performed.

BRIEF DESCRIPTION OF DRAWINGS

FIG. 7 (*a*) to (*e*) are diagrams showing the operation principle of the rotor of the embodiment of this invention.

DETAILED DESCRIPTION OF THE PREFERRED EMBODIMENTS (1) First Embodiment

Figure 9:
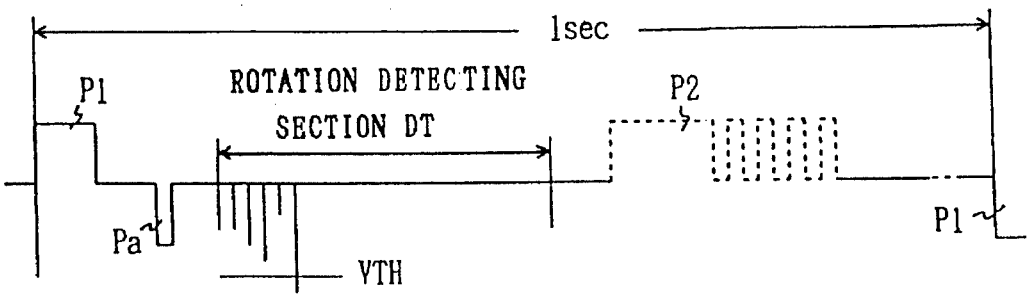
FIG. 9 is a diagram showing the drive voltage waveform of the first embodiment according to this invention.

The first embodiment is characterized in that a detection assisting pulse Pa is applied to a stepping motor which is subjected to a rotation detecting operation (see FIG. 9). The first embodiment of this invention will be described hereunder with reference to the drawings.

Figure 1:
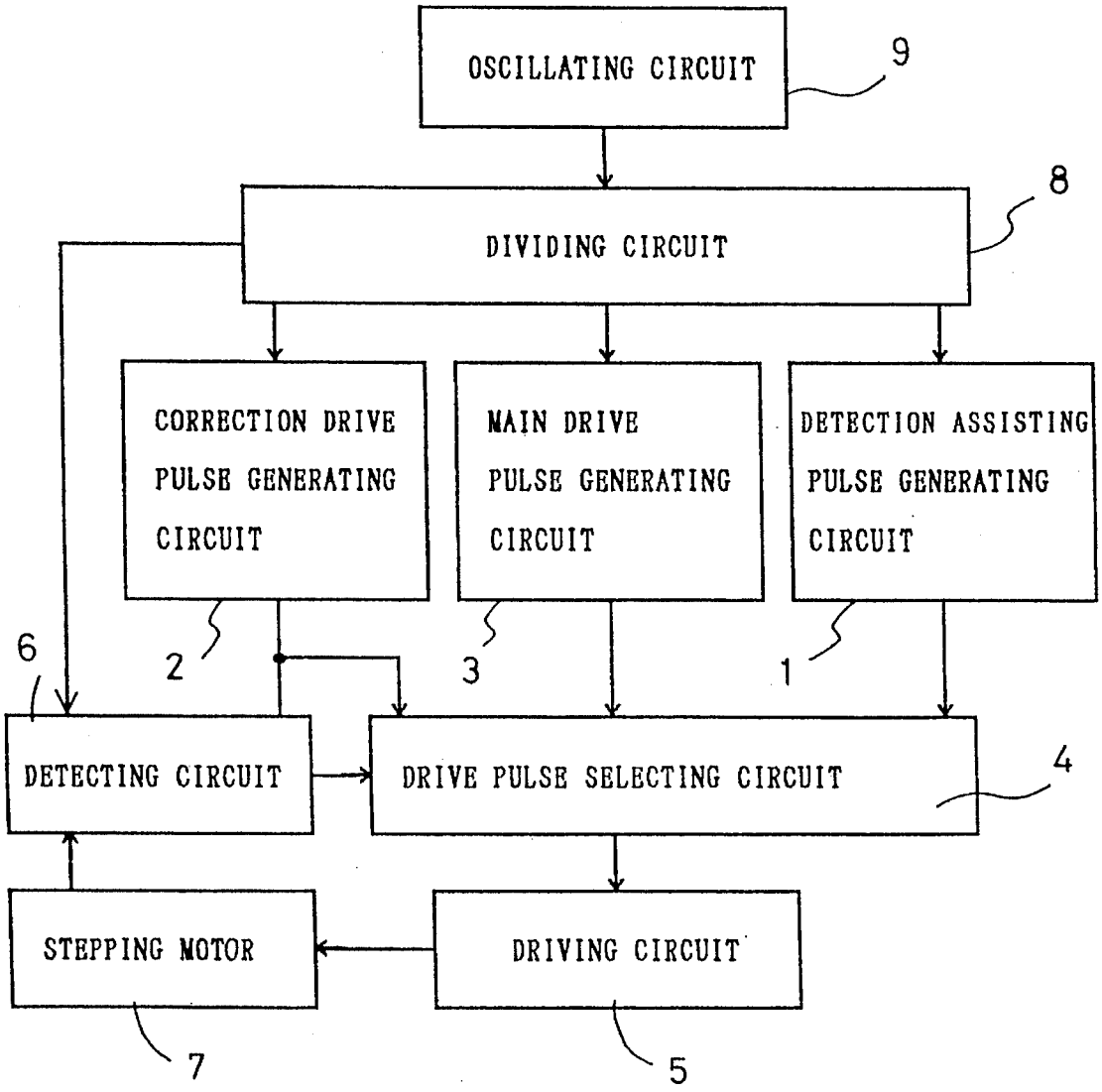
FIG. 1 is a block diagram showing a first embodiment according to this invention.
Figure 2:
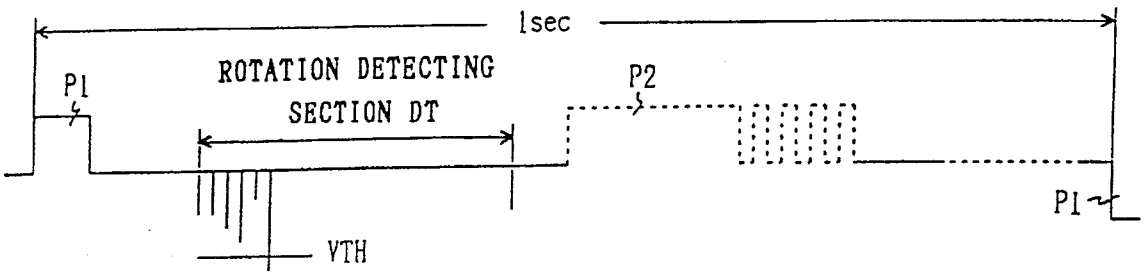
FIG. 2 is a drive voltage waveform diagram showing an example of the conventional correction drive system.
Figure 3:
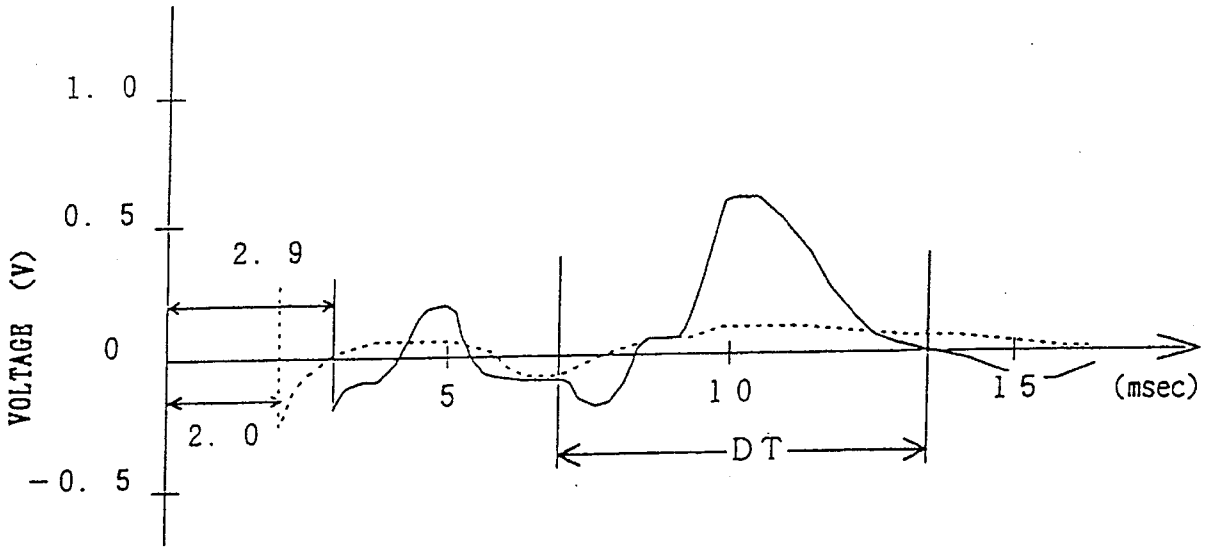
FIG. 3 is a diagram showing an example of the voltage waveform due to the rotation free attenuating motion of the stepping motor after the interruption of the main drive pulse.
Figure 4:
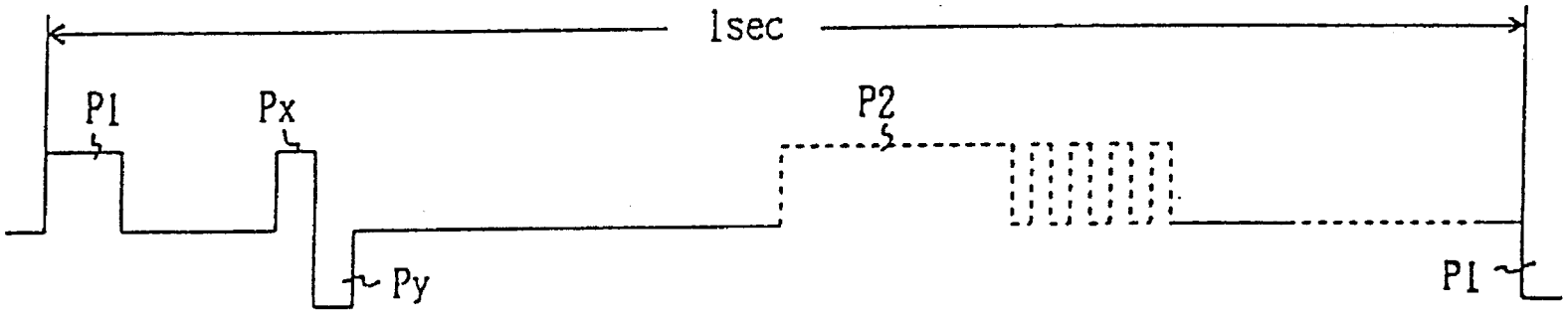
FIG. 4 is a drive voltage waveform diagram showing another example of the conventional correction drive system.
Figure 5:
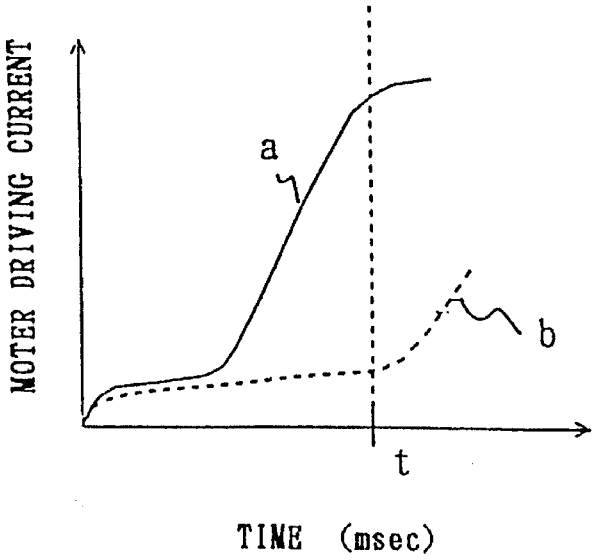
FIG. 5 is a diagram showing an example of the drive current waveform during the driving of the detect pulse.
Figure 6:
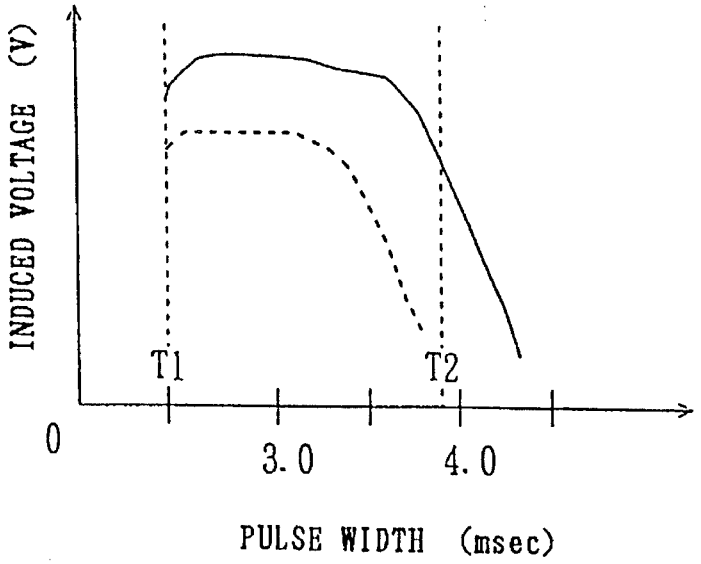
FIG. 6 is an explanatory diagram showing the relationship between the pulse width and the induced voltage.
Figure 8:
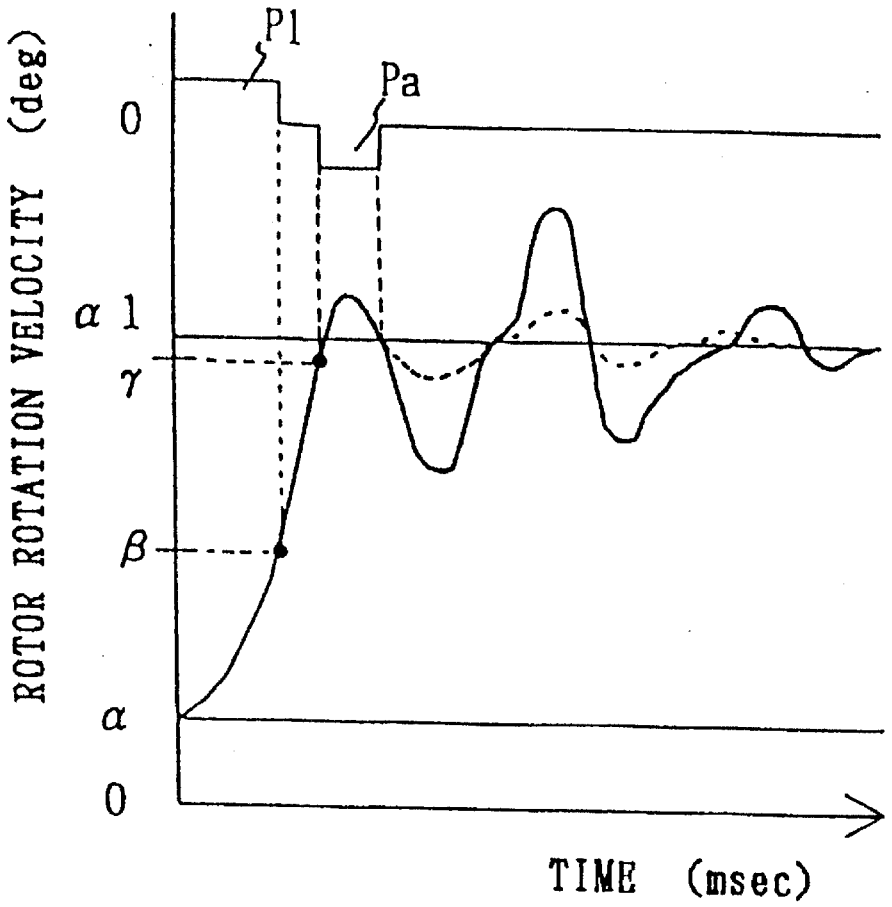
FIG. 8 is a diagram showing the relationship between the drive pulse and the rotational angle of the rotor in the embodiment according to this invention.

FIG. 1 is a block diagram of the first embodiment of the present invention. An oscillating circuit (OSC) 9 preferably a quartz oscillator oscillates a signal at 32768 Hz. This signal is output to the dividing circuit 8. This signal is divided into clock signals having frequencies of 1 Hz at minimum by 15-stage flip flops in the dividing circuit 8, and these clock signals of respective frequencies are output to the main drive pulse generating circuit 3, the correction drive pulse generating circuit 2, the detect assistant pulse generating circuit 1, and the detecting circuit 6.

Since the stepping motor 7 is supplied with a main drive pulse once P1 which is an effective power pulse every second, the main drive pulse generating circuit 3 generates a main drive pulse signal on the basis of the clock signal input from the dividing circuit 8, and outputs the main drive pulse signal to the drive pulse selecting circuit 4.

Since the stepping motor 7 is supplied with a correction drive pulse so that it can be surely rotated and complete a normal stepping operation, the correction drive pulse generating circuit 2 generates a correction drive pulse signal on the basis of the clock signal input from the dividing circuit 8, and outputs the correction drive pulse signal to the drive pulse selecting circuit 4 at a predetermined timing.

The detection assisting pulse generating circuit 1 generates a detection assisting pulse signal having a pulse width such that the stepping motor is not rotated on the basis of the clock signal input from the dividing circuit 8, and outputs the detection assisting pulse signal to the drive pulse selecting circuit 4 at a predetermined timing.

At arbitrary timing, the drive pulse selecting circuit 4 outputs to the driving circuit 5 a correction drive pulse signal for selecting the output or non-output in accordance with the detect signal output from the main drive pulse signal, the detection assisting pulse signal and the detection signal output from the detecting circuit 6. The correction drive pulse signal is output to the driving circuit 5 only when the rotation detection result of the rotor 70 judges the non-rotational state in the detecting circuit 6.

The driving circuit 5 supplies the main drive pulse signal, the detection assisting pulse signal and the correction drive pulse signal input from the drive pulse selecting circuit 4 to the stepping motor 7 as an effective power pulse.

The detecting circuit 6 generates a detect-selection signal for carrying out detection of the rotation of the rotor at only a predetermined time on the basis of the signal input from the dividing circuit 8, executes the rotation detection operation of the stepping motor 7 in accordance with the signal, and outputs information on the rotation or non-rotation to the drive pulse selecting circuit 4 as a detection signal.

The output of the stepping motor 7, that is, the rotational motion is transferred to the ring array, the indicator, etc.

Next, an embodiment of each circuit as shown in the circuit block of FIG. 1 will be described.

Figure 10:
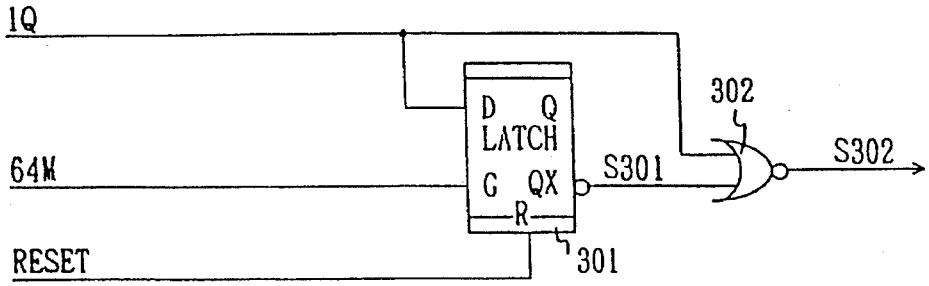
FIG. 10 is a circuit diagram showing an example of a main drive pulse generating circuit 3 in this invention.

First, the main drive pulse generating circuit 3 will be described with reference to FIG. 10. The main drive pulse generating circuit 3 comprises a latch circuit 301 and a NOR gate 302, and generates a main drive pulse signal S302 once every second in synchronism with the positive going transitions of the clock signals 1Q and 64M input from the dividing circuit 8.

Figure 11:
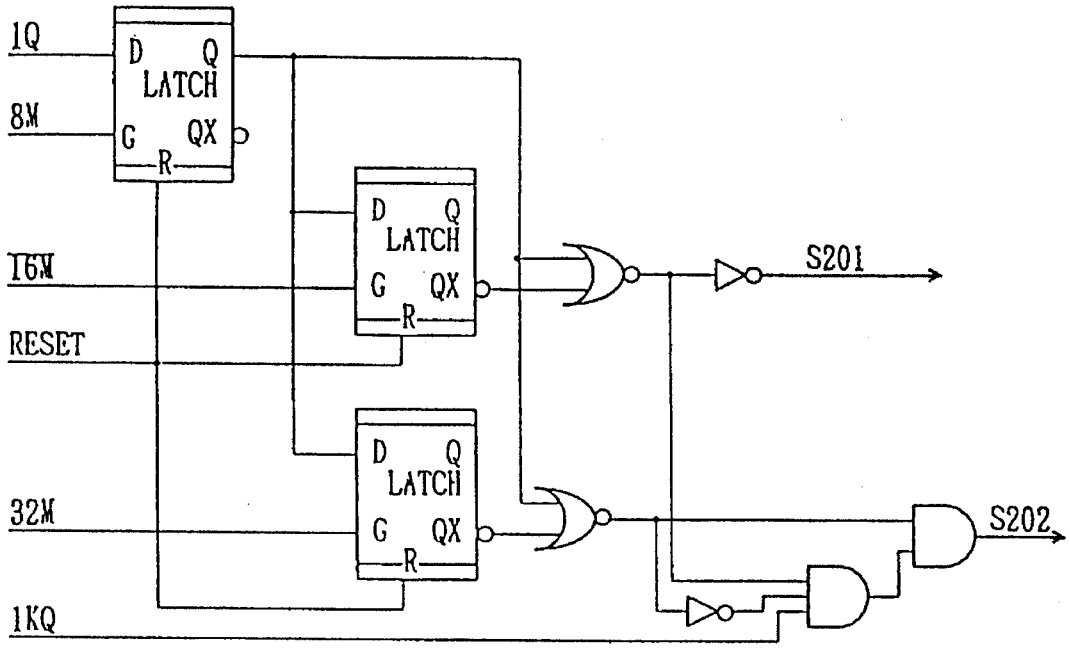
FIG. 11 is a circuit diagram showing an example of a correction drive pulse generating circuit 2 in this invention.
Figure 14:
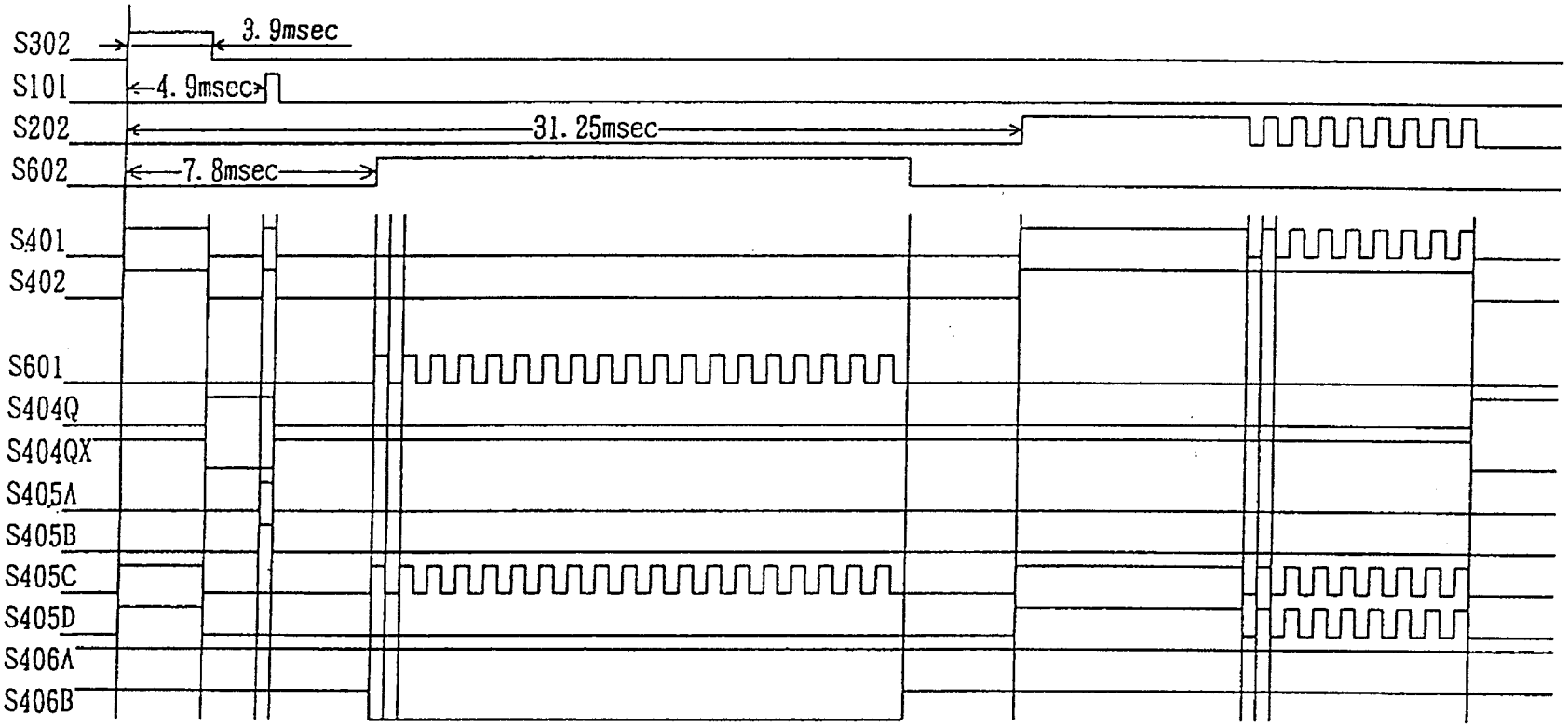
FIG. 14 is a timing chart for input and output signals of the drive pulse selecting circuit 4 in this invention.

An embodiment of the correction drive pulse generating circuit 2 is shown in FIG. 11, and comprises a latch circuit, a NOR gate, a NOT gate, an AND gate, etc. Through the operation of the correction drive pulse generating circuit 2, a correction drive pulse signal S202 as shown in a timing chart of FIG. 14 is output after 31.25 msec elapses from the rise-up of 1Q. In this embodiment, the pulse comprises a combination pulse of a continuous pulse and an intermittent pulse to maximize the effect of the correction drive pulse P2.

Figure 12:
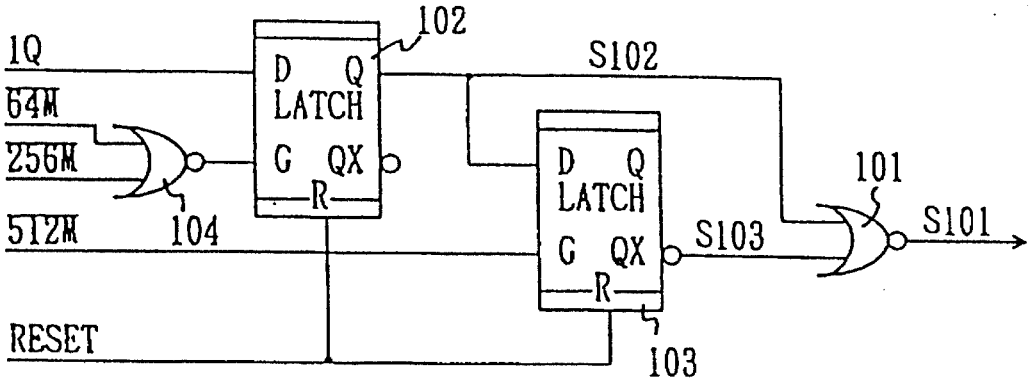
FIG. 12 is a circuit diagram showing an example of a detection assisting pulse generating circuit 1 in this invention.

An embodiment of the detection assisting pulse generating circuit 1 is shown in FIG. 12, and comprises latch circuits 102, 103, NOR gates 101, 104, etc. The detection assisting pulse generating circuit 1 starts the output of a detection assisting pulse signal S101 after 4.9 msec elapses from the rise-up of 1Q, and interrupts the output of the detection assisting pulse signal in accordance with a clock signal an inverse of the signal 512M to the latch circuit 103. The output timing of the detection assisting pulse signal S101 is shown in the timing chart of FIG. 14.

Figure 13:
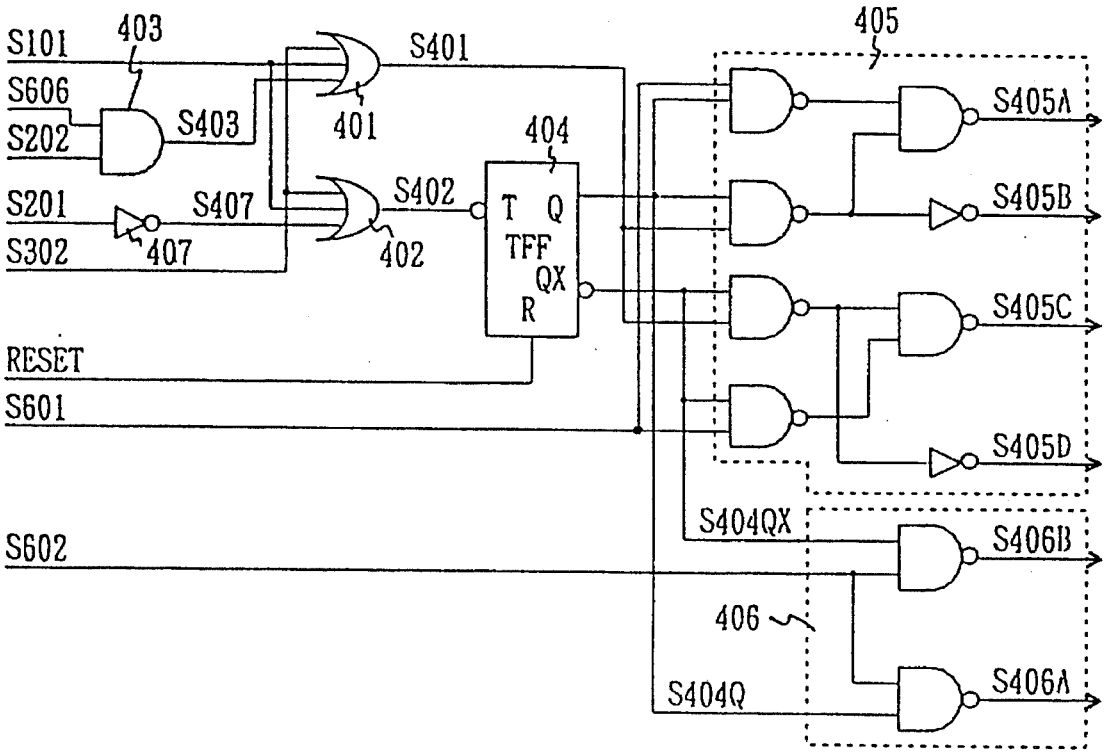
FIG. 13 is a circuit diagram showing an example of a drive pulse selecting circuit 4 in this invention.

The drive pulse selecting circuit is designed as shown in FIG. 13, and comprises OR gates 401, 402, an AND gate 403, a flip-flop 404 (hereinafter referred to as TFF), a gate circuit 405, a NAND gate circuit 406, a NOT gate 407, etc. The OR gate 401 is provided to selectively output a pulse signal input to each pulse generating circuit. The input terminal thereof is supplied with the signals S101, S302 and S403. The OR gate 402 is provided to synthesize a pole inverting signal S402 which controls the pole of the voltage of an applied pulse and is supplied to the TFF 404. The input terminal thereof is supplied with the signals S101, S302 and S407. The AND gate 403 is provided to control the output or non-output of the correction drive pulse.

The drive pulse signal S401 which is an output signal of the OR gate 401 is input to the gate circuit 405. On the other hand, the pole inverting signal which is the output signal of the OR gate 402 is input to a T terminal of the TFF 404. In accordance with a trailing signal of the pole inverting signal S402, the output signals S404Q and S404QX of the TFF 404 are inverted to "High (hereinafter referred to as "H")" or "Low (hereinafter referred to as "L")". The TFF output signals S404Q and S404QX are input to the gate circuit 405 and the NAND gate circuit 406.

Figure 15A:
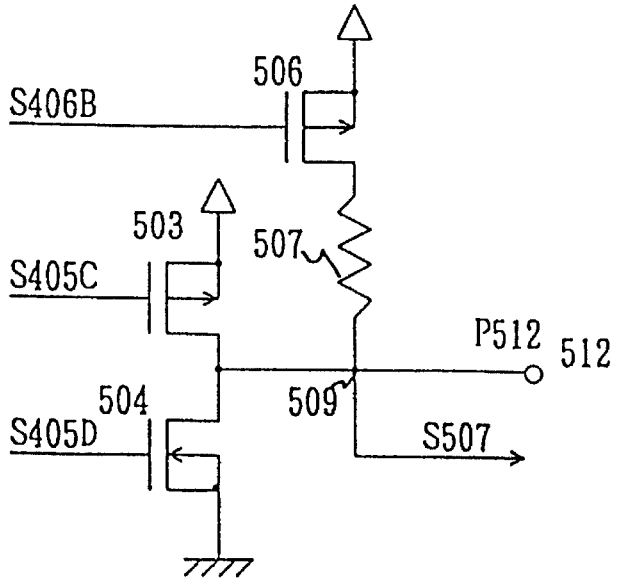
FIG. 15 is a circuit diagram showing an example of a driving circuit 5 in this invention.
Figure 15B:
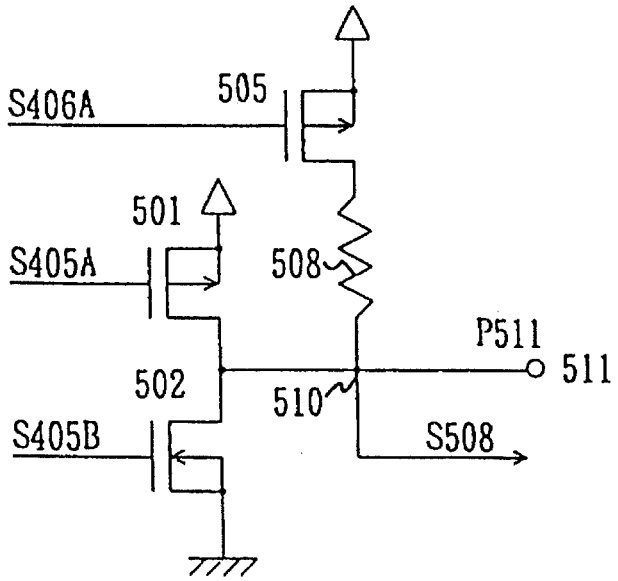

The gate circuit 405 and the NAND gate circuit 406 output driving MOSFET control signals S405A to D for controlling the ON/OFF state of a stepping motor driving MOSFET to gate terminals of MOSFETs 501 to 504 as shown in FIGS. 15(*a*), (*b*) in accordance with the drive pulse signal S404, the TFF output signals S404Q and 404QX and the MOSFET control signals S606 and S602 input from the detecting circuit 6. Further, detecting MOSFET control signals S406A, S406B for controlling the ON/OFF state of the detecting MOSFET are output to the gate terminals of MOSFETs 505, 506 as shown in FIGS. 15(*a*), (*b*).

An embodiment of the driving circuit 5 is designed as shown in FIGS. 15(*a*), (*b*), and comprises motor driving MOSFETs 501 to 504, detecting MOSFETs 505, 506 and resistant elements 507, 508. The MOSFETs 501 to 506 carry out an ON/OFF operation in accordance with an input signal to the gate terminal of each MOSFET. The rotation of the stepping motor 7 is realized by applying drive pulses P511 and P512 to the stepping motor 7 from the output terminals 511, 512 which are connected to the coil 74.

Figure 16:
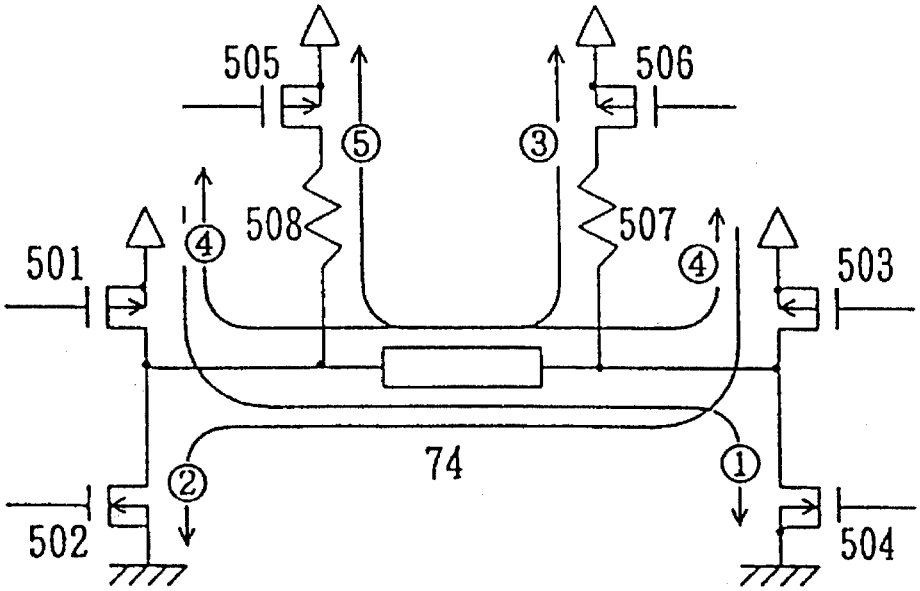
FIG. 16 is a diagram showing paths of current flowing in a coil in the embodiment of this invention.

Current paths in accordance with a switching operation of each MOSFET is shown in a table 1 and FIGS. 14 and 16.

TABLE 1

| 501 | 502 | 503 | 504 | 505 | 506 | current path |
|---|---|---|---|---|---|---|
| on | off | on | off | off or on | off or | (4) |
| on | off | off | on | off | off | (1) |
| off | on | on | off | off | off | (2) |
| on | off | off | off | off | on | (3) |
| off | off | on | off | on | off | (5) |

FIG. 14 shows a timing chart for the control signals S405A to S405D, S406A, and S406B for each MOSFET which is input to the driving circuit 5. FIG. 16 is a schematic diagram showing a path of current flowing in the coil.

The paths (1) and (2) are current paths for driving pulses through which currents flowing in opposite directions are applied to the coil. The paths (3),(5) are closed loops of high impedance containing detection resistor 507 or 508 (resistant element of several hundreds K. The path (4) is in a state where both ends of the coil 74 are short-circuited. When the MOSFET 505 or 506 is in ON-state, there are two paths through which current flows. However, only the path (4) is regarded as the current-flowing path due to the effect of the detection resistors.

Figure 17:
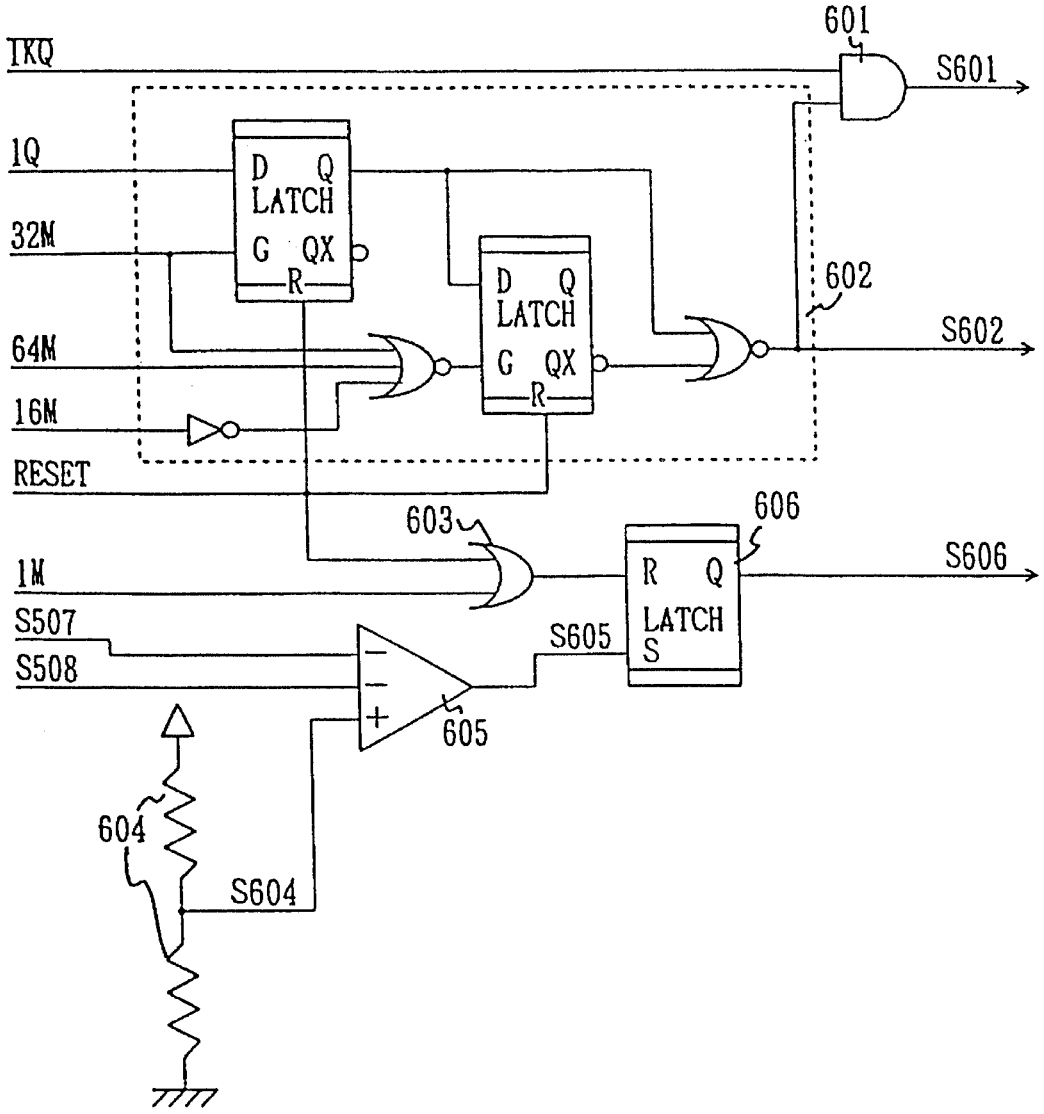
FIG. 17 is a circuit diagram showing an example of the detect circuit 6 of this invention.

An embodiment of the detecting circuit 6 is designed as shown in FIG. 17, and comprises an AND gate 601, a gate circuit 602, an OR gate 603, a comparator 605, a latch circuit 606, a reference voltage generating resistant element 604, etc. The detecting operation of the detecting circuit 6 is as follows.

First, the input signals S507, S508 and S604 to the comparator 605 will be described. The signal S604 is a reference voltage VTH (hereinafter referred to as VTH) for judgment on rotation, and is a potential induced by the resistor element 604. The signals S507, S508 are each a detection voltage VRS (hereinafter referred to as VRS) obtained by amplifying the induced voltage occurring in the coil with the detection resistor 507, 508, and VRS is also a transient voltage which is caused by a switching operation over multiple period of the path (3) or (4) and the path (5) as shown in FIG. 16. The comparator is set to "L" for "VTH≦VRS", and to "H" for "VTH>VRS". The comparator output signal S605 is output to a SET terminal of the latch circuit 606. The timing chart for the above detecting operation is shown in FIG. 18.

Figure 18:
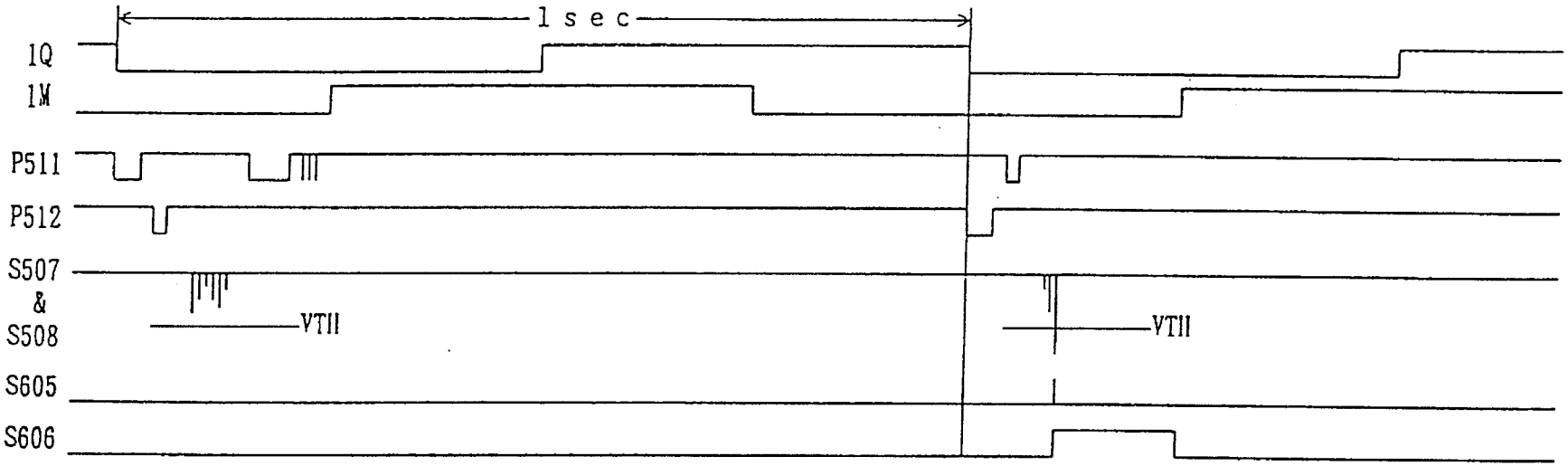
FIG. 18 is a timing chart for an electrical operation of the drive circuit 5 and the detection circuit 6 of this invention.

FIG. 18 shows motor drive pulses P511, P512 which are output from the driving circuit 5 to the stepping motor 7, rotation detection voltages S507, S508 which are input from the stepping motor 7 to the detecting circuit 6, a signal S605 which is obtained and output through electrical comparison between the VTH and the rotation detection voltage in the detecting circuit 6, and a detection signal S606 which is the output signal of the detecting circuit 6.

For the first one second, interval the main drive pulse is applied to the stepping motor from the 511 terminal side of FIG. 18, and the detection assisting pulse is applied from the 512 terminal side. However, the rotor is in the non-rotational state, the comparator output signal S605 and the detection signal S606 are left in "L" state, the correction drive pulse is applied to the stepping motor.

For the next one second, interval the main drive pulse is applied to the stepping motor from the 512 terminal side of FIG. 18, and the detection assisting pulse is applied to the 511 terminal side. Thereafter, the rotor is rotated, and thus the signal S605 becomes one shot "H" and the detection signal S606 also becomes "H". When the detection signal is "H", the correction drive pulse is not applied to the stepping motor, and thus the drive pulse P512 has no voltage waveform of the correction drive pulse.

When a master signal of 1 Hz is "H", the latch circuit 606 is in a reset state, and the detection signal S 606 is also "L".

Figure 19:
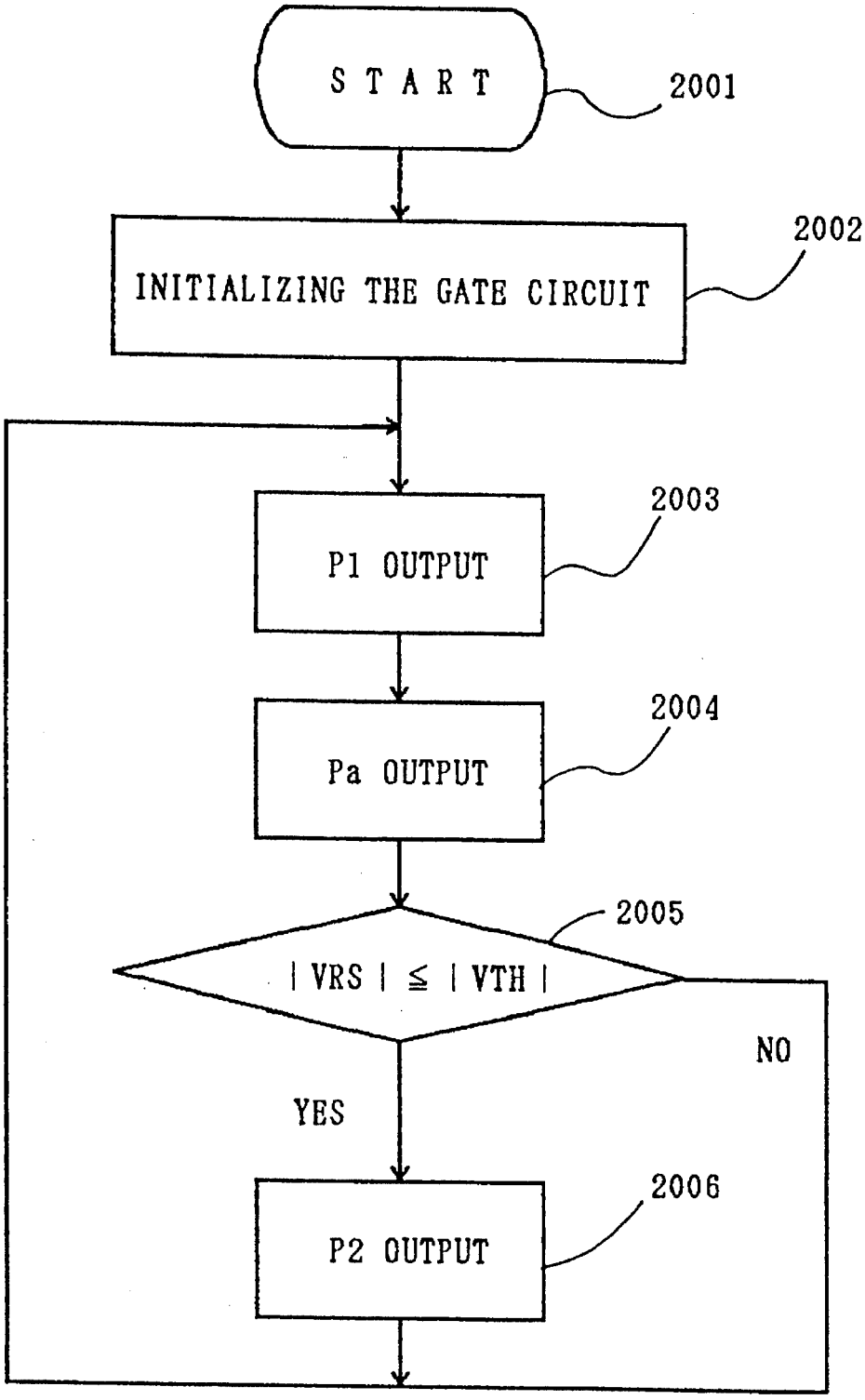
FIG. 19 is a flowchart for the circuit operation of the first embodiment of this invention.

Next, the operation of the embodiment according to this invention will be described with reference to a flowchart of FIG. 19.

First, simultaneously with the start (2001), initialization is made to the gate circuit, etc. (2002). Subsequently, the main drive pulse P1 is output to the stepping motor (2003), and then the detection assisting pulse Pa goes low output to the stepping motor after the main drive pulse is (2004). After interruption of the detecting assisting pulse, the program goes to a subsequent rotation detecting operation.

At the rotation detecting step (2005), the rotation or non-rotation of the rotor is judged. The rotation detection method uses comparison between VTH and VRS. If |VRS|≦|VTH|, the correction drive pulse P2 is output to the stepping motor (2006). On the other hand, if |VRS|>|VTH|, no correction drive pulse is output, and the operation of rotating the rotor by one step is terminated.

The above description is made for the first embodiment. The circuit of this embodiment is characterized in that the detection assisting pulse is applied to the motor, and has an object of improving the precision of the rotation detection by applying the detection assisting pulse.

(2) Second Embodiment

Figure 20:
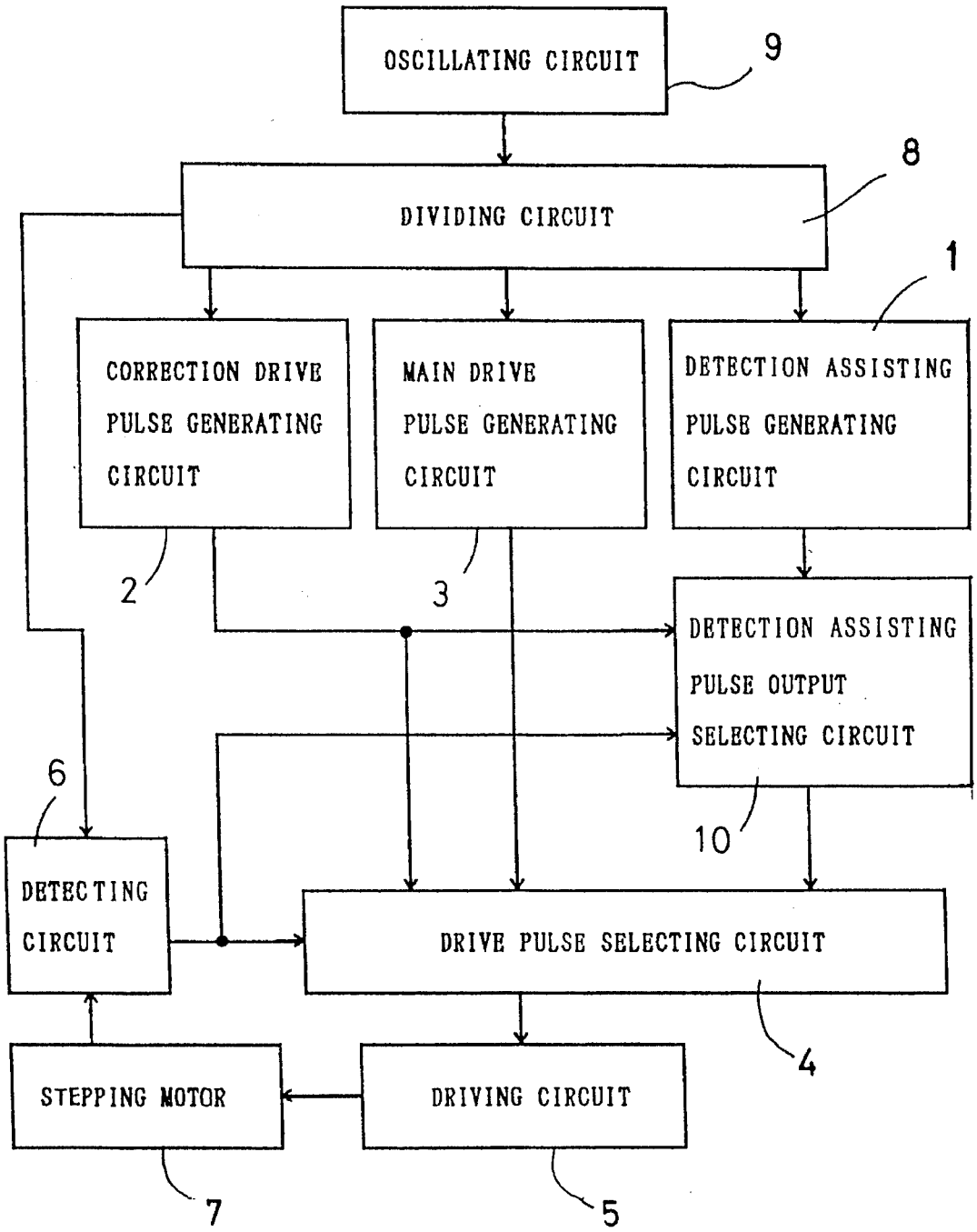
FIG. 20 is a block diagram of a second embodiment of this invention.
Figure 21:
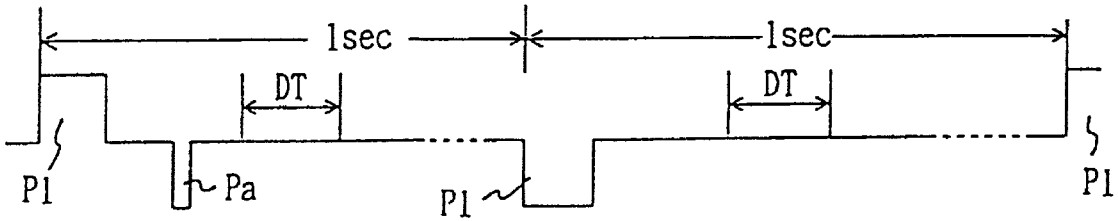
FIG. 21 is a diagram showing the drive voltage waveform of the second embodiment of this invention.

The circuit construction of the second embodiment of this invention is characterized in that a detection assisting pulse output selecting circuit 10 is added to the circuit construction of the first embodiment as described above (see block diagram of FIG. 20), and the output of the detection assisting pulse signal is selected in accordance with the detection signal input from the detecting circuit 6 (see FIG. 21).

Figure 22:
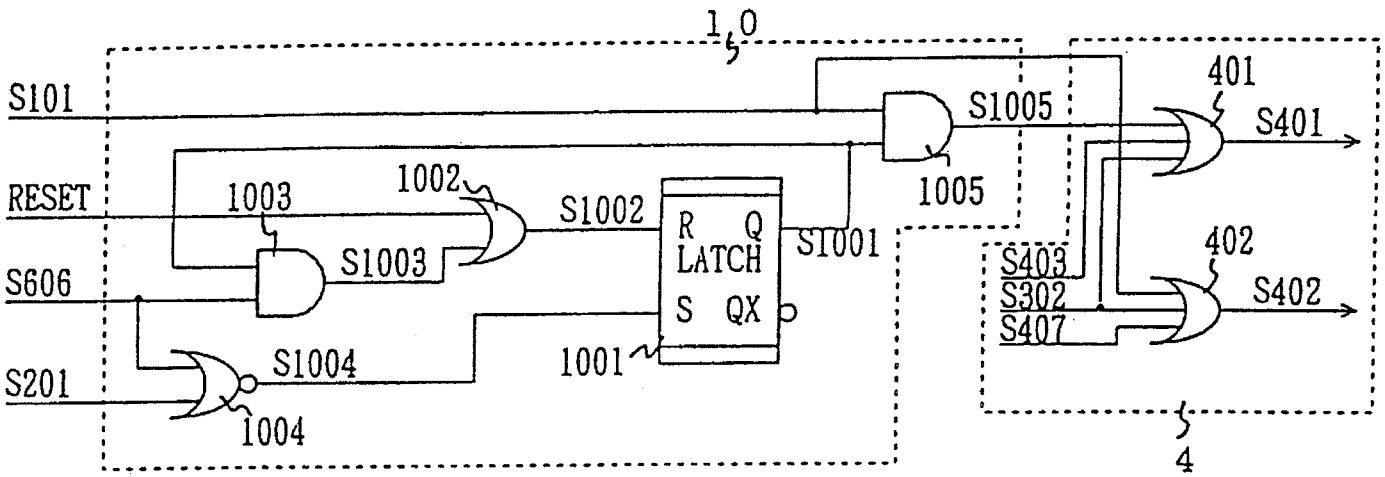
FIG. 22 is a circuit diagram showing an example of the detection assisting pulse output selecting circuit 10 of the second embodiment according to this invention.
Figure 23:
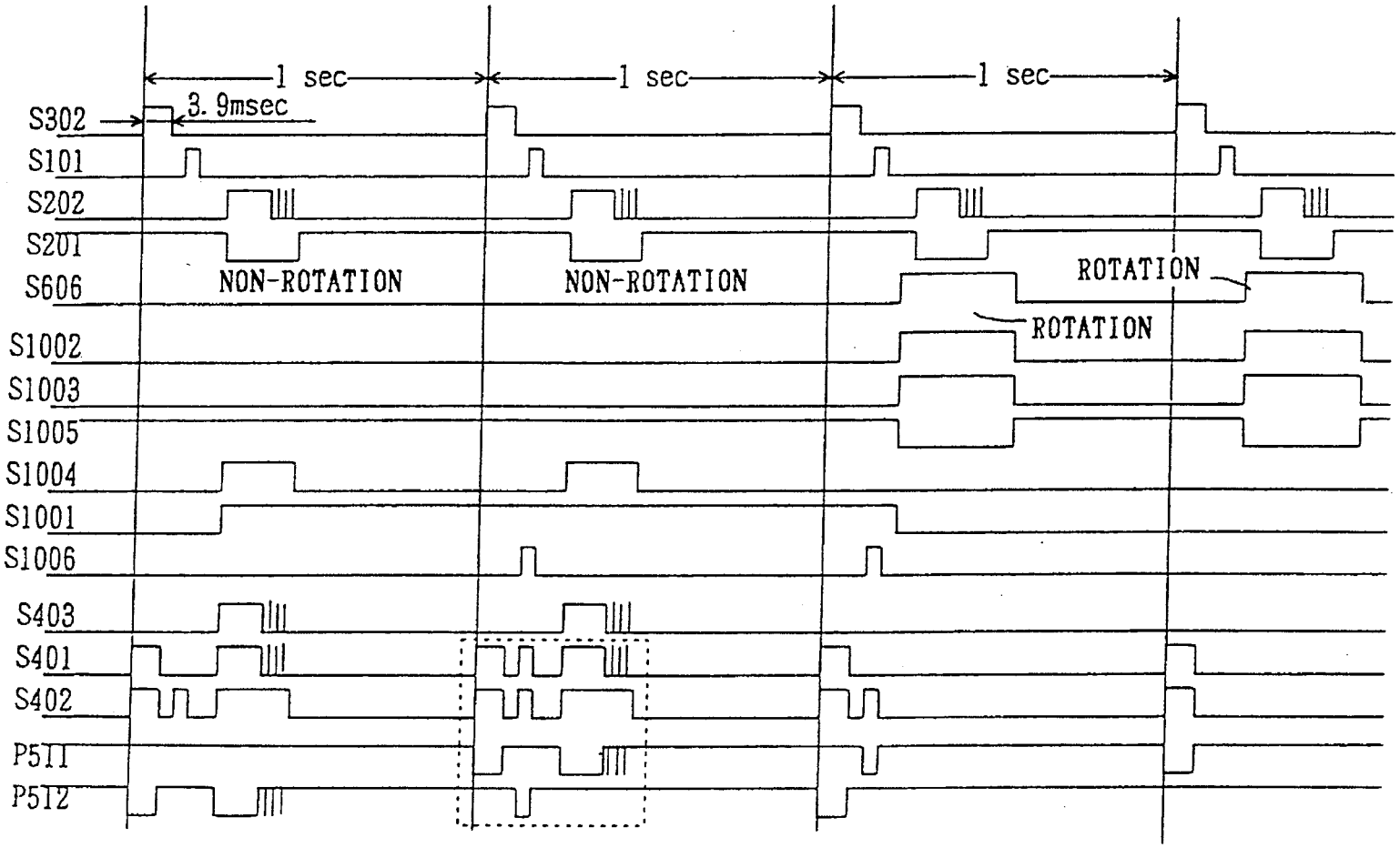
FIG. 23 is a timing chart showing the electrical operation of the detection assisting pulse output selecting circuit 10 of the second embodiment according to this invention.

An embodiment of the detection assisting pulse output selecting circuit 10 is designed as shown in FIG. 22, and comprises an RS latch circuit 1001, an OR gate 1002, AND gates 1003, 1005, and a NOR gate 1004. A timing chart for a series of operations of the detection assisting pulse output selecting circuit 10 is shown in FIG. 23.

Signals input to the detection assisting pulse output selecting circuit 10 are a detection assisting pulse signal S101, a detection signal S606 from the detection circuit 6, an output signal S202 from the correction drive pulse generating circuit and a reset signal.

The NOR gate 1004 is connected to the SET terminal of the RS latch circuit 1001. When the correction drive pulse signal S202 falls down to "L" with the signal S606 being left in "L" state, the output signal S1004 outputs "H" to the RS latch circuit 1001, and the RS latch circuit 1001 is set to a SET state (output "H" from the output terminal Q).

With respect to the AND gate 1003, when the rotor is rotated and the RS latch circuit 1001 is in the SET state, the output signal S1003 of the AND gate 1003 is set to "H", and input to the OR gate 1002.

The OR gate 1002 is connected to the RESET terminal of the RS latch circuit 1001. When the reset signal or signal S1003 rises up to "H", the RS latch circuit 1001 is set to the RESET state (outputs "L" from the output terminal Q).

The RS latch circuit 1001 is set to the SET state if the rotor is detected to be in the non-rotational state, and set to the RESET state if the rotation of the rotor is detected when the signal S1001 is in "H" state (SET state). Although the rotor is detected in the RESET state (the signal S1001 is "L"), the signal S1001 is not varied.

The AND gate 1005 outputs the detection assisting pulse signal S1005 to the OR gate 401 of the drive pulse selecting circuit 4 when the RS latch circuit 1001 is in the SET state.

Figure 24:
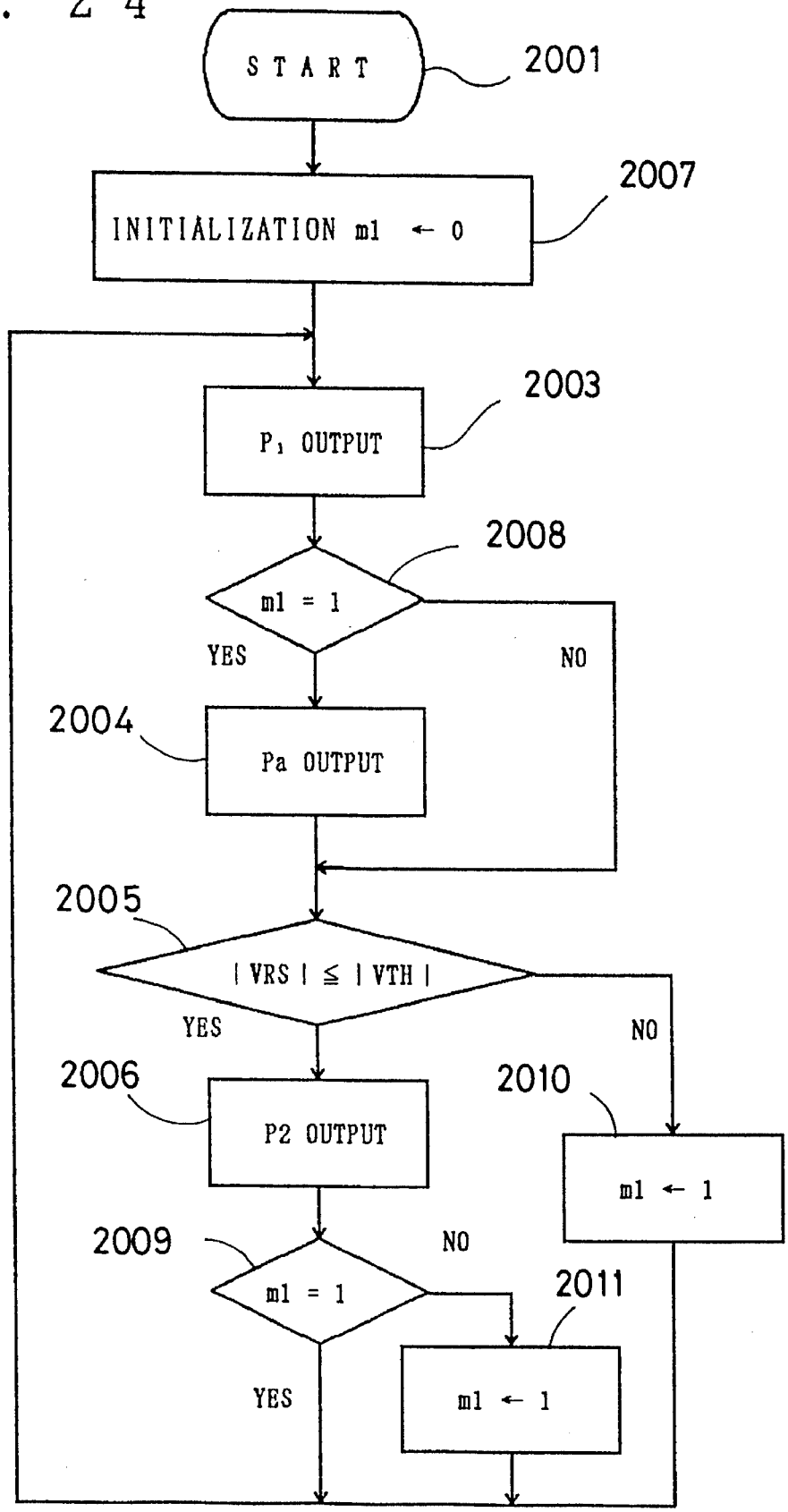
FIG. 24 is a flowchart showing the circuit operation of the second embodiment according to this invention.

Next, the operation of the circuit of this embodiment according to this invention will be described with reference to a flowchart of FIG. 24.

Simultaneously with the start (2001), the initialization is made to the circuit (2007) to set a control signal m1 to "m1=0". The main drive pulse P1 is output to the stepping motor (2003), and then it is determined using the control signal m1 whether the detection assisting pulse is output to the stepping motor (2008). If the control signal m1 is in a state of "m1=1", a next detection assisting pulse Pa is output after the main drive pulse (2004). On the other hand, if the control signal ml is in a state of "m1=0", the detection assisting pulse Pa is not output to the stepping motor.

Subsequently, after detection assisting pulse goes low, the program goes to a next rotation detecting operation.

At the rotation detecting step (2005), the rotation or non-rotation of the rotor is judged. The detection method uses the comparison between VTH and VRS. If $|VRS| \leqq |VTH|$, the correction drive pulse P2 is output to the stepping motor (2006). Thereafter, the judgment on the control signal ml is made (2009). If "m1=0", the control signal m1 is written to "m1=1" (2011).

On the other hand, if $|VRS|>|VTH|$, the correction drive pulse P2 is not output to the stepping motor, and the control signal m1 is written to "m1=0" (2010). Subsequently, the operation of rotating the rotor by one step is terminated.

By repeating the above operation, the output or non-output of the detection assisting pulse can be controlled in accordance with the rotation detection result of the rotor, and the output of the detection assisting pulse which exceeds a required amount can be prevented. Therefore, the detection precision can be improved, and the power consumption can be suppressed.

(3) Third embodiment

Figure 25:
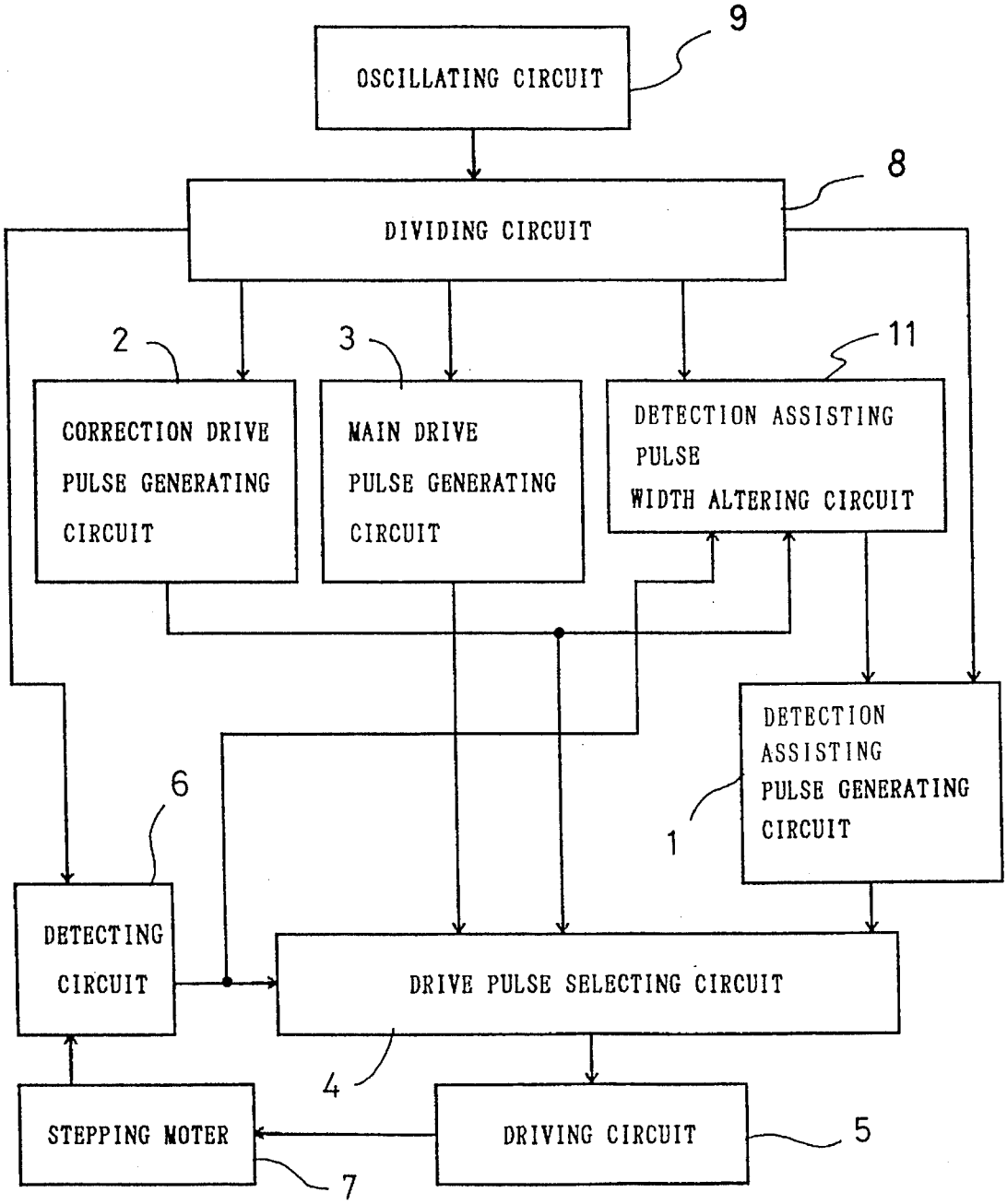
FIG. 25 is a block diagram showing the third embodiment according to this invention.
Figure 26:
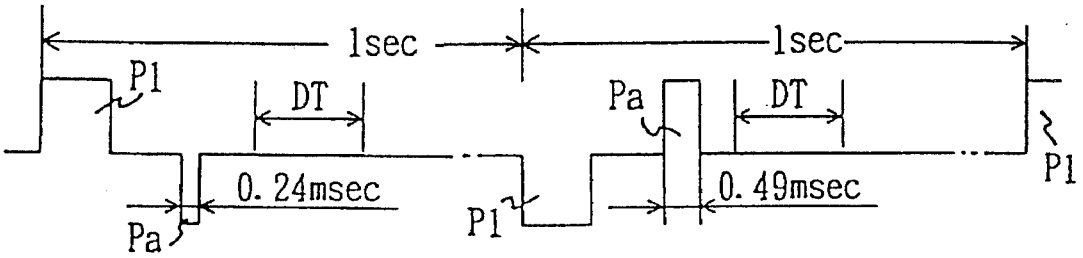
FIG. 26 is a diagram showing the drive voltage waveform of the third embodiment according to this invention.

The circuit construction of the third embodiment according to this invention is characterized in that a detection assisting pulse width modulating circuit 11 is added to the circuit construction of the first embodiment as described above (see a block diagram of FIG. 25), and the pulse width of the detection assisting pulse signal is alterable in accordance with the detection signal input from the detecting circuit 6 (see FIG. 26).

Figure 27:
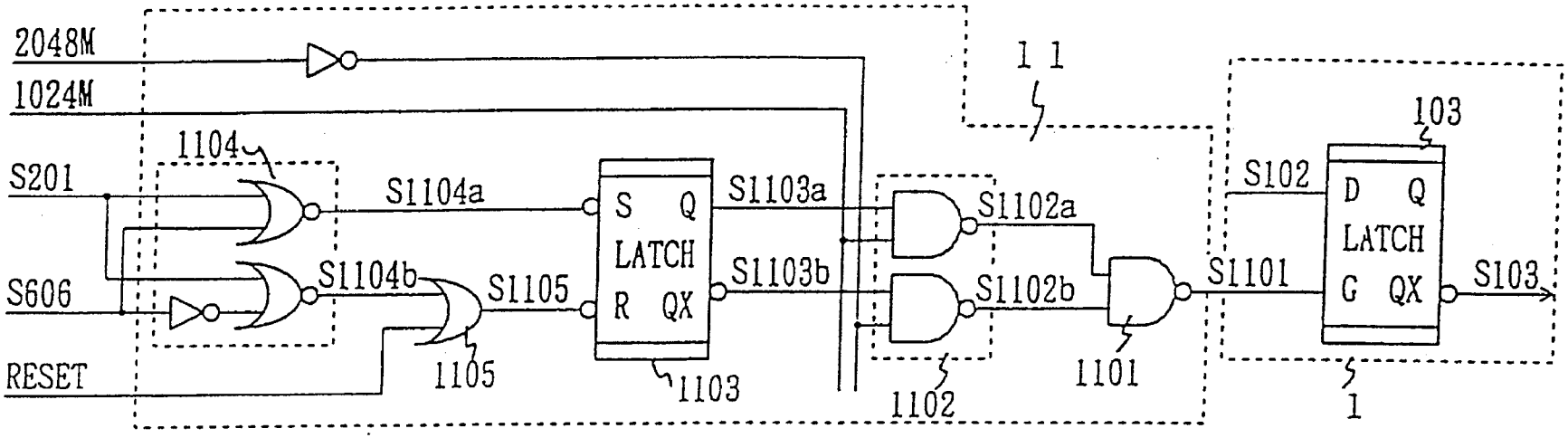
FIG. 27 is a circuit diagram showing an example of the detect assistant pulse with altering circuit 11 as shown in the third embodiment according to this invention.
Figure 28:
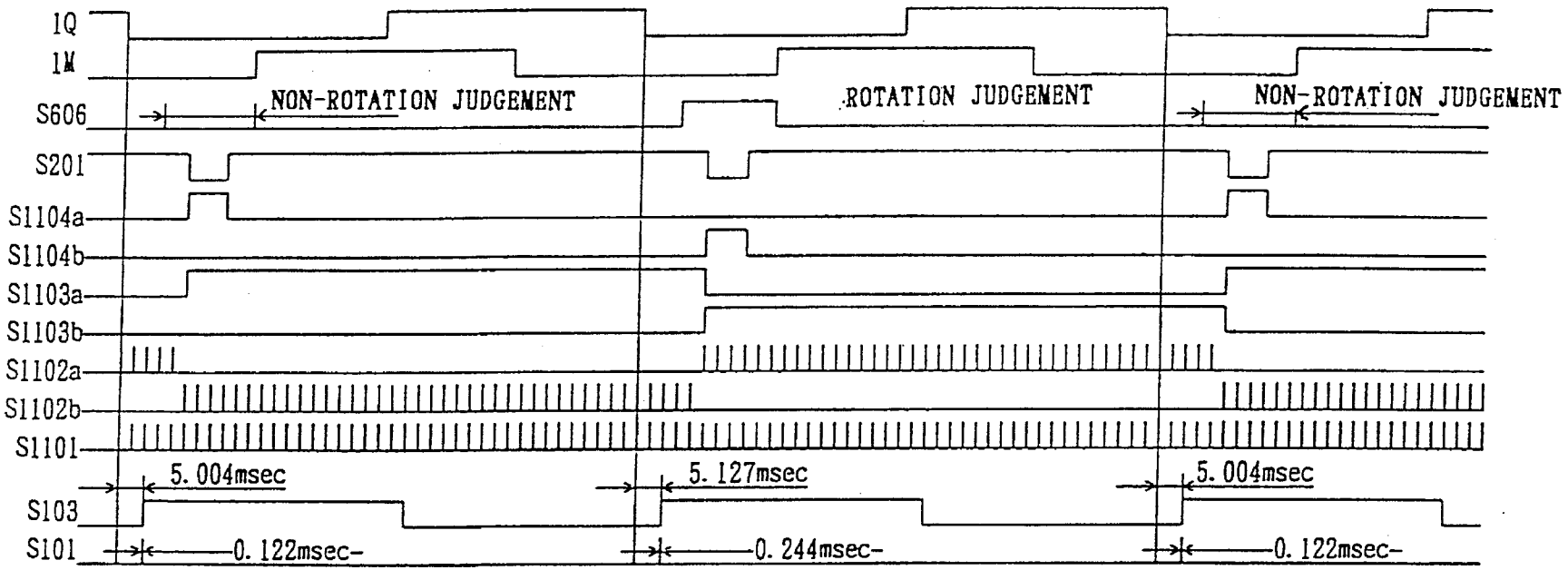
FIG. 28 is a timing chart for the electrical operation of the detect assistant pulse width altering circuit 11 of the third embodiment according to this invention.

An embodiment of the detection assisting pulse output selecting circuit 11 according to this invention is designed as shown in FIG. 27. It selects one clock signal S1101 from plural clock signals input from the dividing circuit 8 in accordance with the detection signal S606 of the detecting circuit 6, and outputs the selected signal to the detection assisting pulse generating circuit 1. The timing chart for the output timings of these signals is shown in FIG. 28.

The circuit construction of an embodiment of the detection assisting pulse width modulating circuit 11 of the third embodiment of this invention and the operation thereof will be first described.

The detection assisting pulse width modulating circuit 11 comprises a NAND gate 1101, a gate circuit 1102, a latch circuit 1103, a gate circuit 1104, an OR gate 1105, etc.

The input signals of the gate circuit 1104 are S201 and S606. The gate circuit 1104 synthesizes output signals S1104*a*, S1104*b* which are rise-up signals synchronized with S201 in accordance with the rotation or non-rotation of the rotor, and outputs the output signals S1104*a* and S1104*b* to the SET terminal of the latch circuit 1103 and the input terminal of the OR gate 1105, respectively.

The input signals of the OR gate 1105 are S1104 and RESET signal as described above, and the output terminal is connected to the RRESET terminal of the latch circuit 1103.

The latch circuit 1103 sets the output signal S1103*a* at the output terminal Q to "H" in a SET state (an electrical state after the input signal S1104*a* is set to "H"), and sets the output signal S1103*b* at the output terminal QX to "H" in a RESET state (an electrical state after the input signal S1105 is set to "H").

The input signals of the gate circuit 1102 are the signals 1103*a* and 1103*b*, a signal (an inverse of the signal 2 KM signal) obtained by inverting the master signal of 2 KHz, and the master signal of 1 KHz. When the input signal S1103 is "H", the output signal S1102*a* becomes a trailing clock signal synchronized with the an inverse of the signal 2 KM signal (the signal S1102*b* is left in "H"-state). When the input signal S1103*b* is "H", the output signal S1102*b* is a clock signal synchronized with the 1 KM signal (the signal S1102*a* is left in "H"-state).

The NAND gate 1101 is a gate element for outputting the input signals S1102*a*, S1102*b* as one clock signal, and the output signal S1101 thereof becomes a rise-up clock signal for any one of the an inverse of the signal 2 KM signal and the 1 KM signal. The output terminal is connected to the gate terminal of the latch circuit 103.

The relationship between the pulse width of the detect assistant pulse signal S101 and the clock signal S1101 is as shown in a table 2.

TABLE 2

| Detection result of previous stepping operation | Signal S1101 | Pulse width of S101 |
|---|---|---|
| Rotation | 2KM an inverse of the stop | 0.122 (msec) |
| non-rotation | 1KM | 0.244 (msec) |

With respect to the selection of the clock signal in the detect assistant pulse width altering circuit 11 of the third embodiment, selection of two kinds of clock signals is made. If the detecting circuit judges "rotation", the circuit is set to the SET state. If it judges "non-rotation", the circuit is set to the RESET state. If plural clock signals are required to be selected by the detection assisting pulse width altering circuit 11, the input signal may be controlled using a counter or the like.

Figure 29:
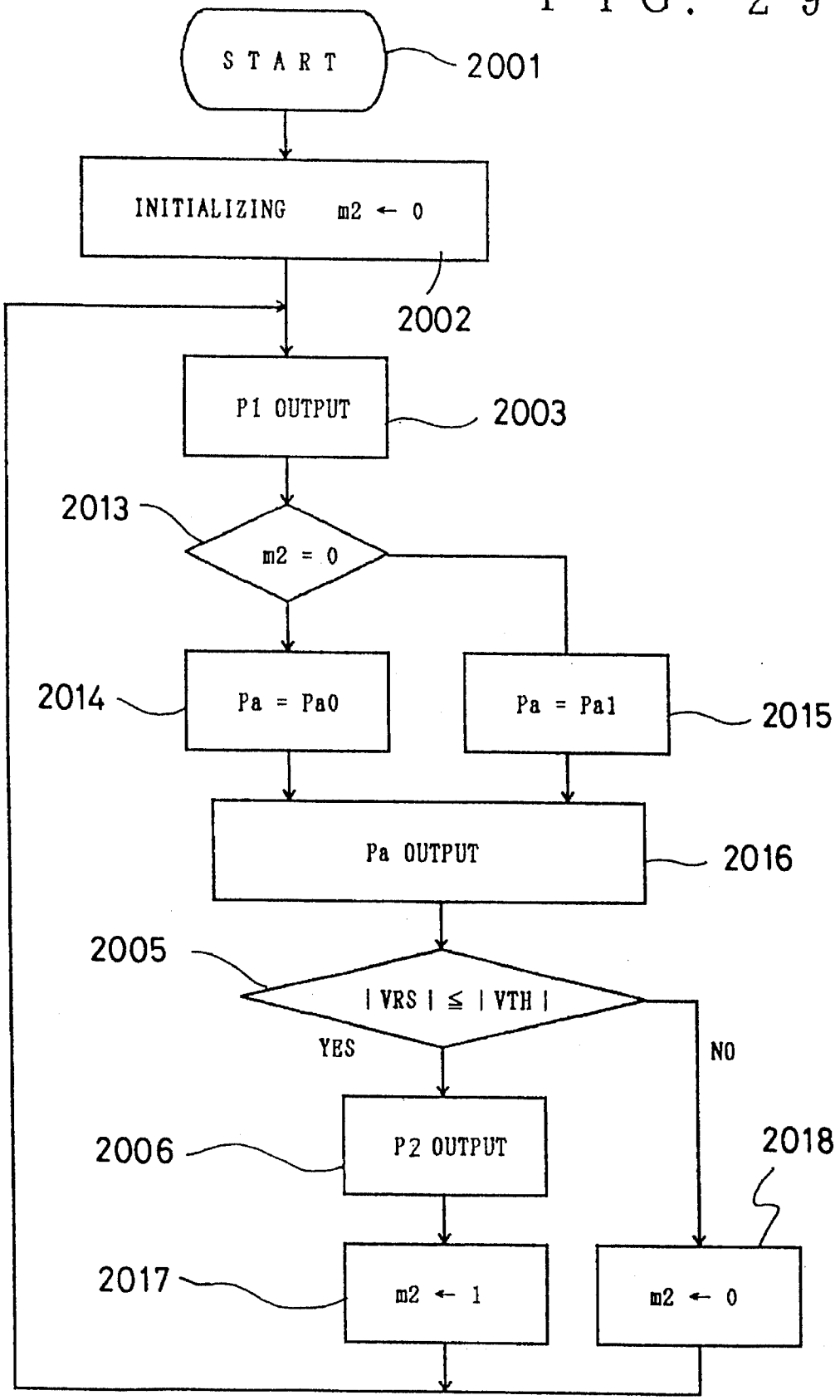
FIG. 29 is a flowchart showing the circuit operation of the third embodiment according to this invention.

Next, the operation of the circuit of the third embodiment according to this invention will be described with reference to a flowchart of FIG. 29.

First, simultaneously with the start (2001), the initialization is made to the circuit (2012) to set a control signal m2 (signal S1103*a* as shown in FIG. 27, for example) to m2=0. After the main drive pulse P1 is output to the stepping motor (2003), the pulse width of a next detection assisting pulse Pa is selected (2013). The output selection of the detection assisting pulse Pa is made using the control signal m2. If m2 =0, the detection assisting pulse Pa is set to Pa=Pa0 (for example, Pa0=0.122 msec) (2014), and output to the stepping motor (2016). On the other hand, if m2=1, the detection assisting pulse Pa is set to Pa=Pa1 (for example, Pa1=0.244 msec) (2015), and output to the stepping motor (2016).

Further, after the interruption of the detection assisting pulse goes low, the program goes to a next rotation detecting operation.

At the rotation detecting step (2005), the rotation or non-rotation of the rotor is judged. The detection method uses the comparison between VTH and VRS. if $|VRS| \leqq |VTH|$, the correction drive pulse P2 is output to the stepping motor (2006). Thereafter, the control signal m2 is rewritten to the signal of "m2=1" (2017).

On the other hand, if $|VRS| > |VTH|$, the correction drive pulse P2 is not output to the stepping motor, and the control signal m2 is rewritten to "m2=0" (2018). Subsequently, the operation of rotating the rotor by one step is terminated.

By repeating the above operation, the control for the alteration of the pulse width of the detection assisting pulse can be performed in accordance with the rotation detection result of the rotor. The precision of the rotation detection can be improved by executing the pulse width altering operation of the detection assisting pulse.

Pa0, Pa1 can be easily determined on an electrical circuit, and it is not necessary to specify the pulse width as described above.

(4) Fourth Embodiment

Figure 30:
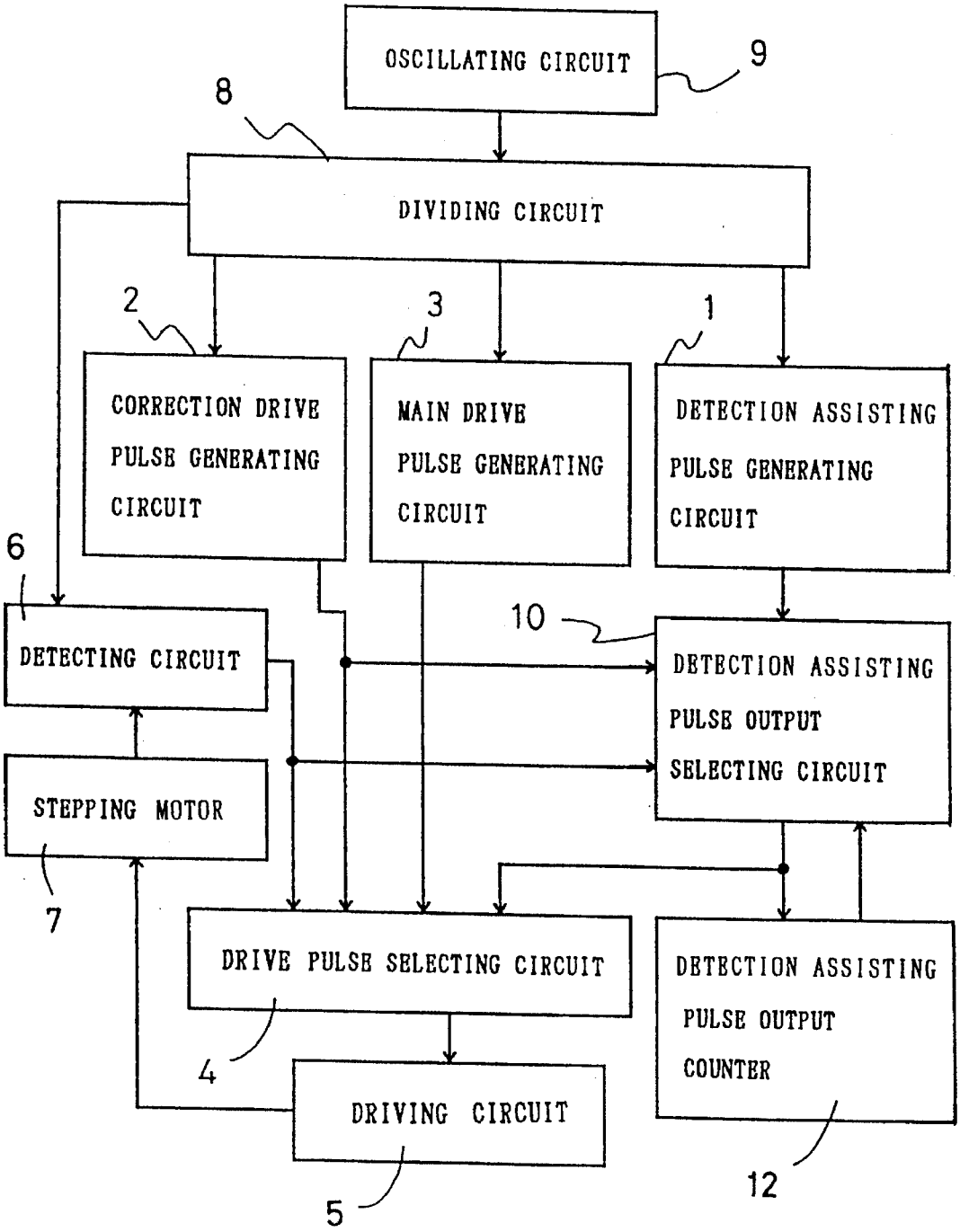
FIG. 30 is a block diagram showing the fourth embodiment according to this invention.

The circuit construction of the fourth embodiment according to this invention is-characterized in that a detection pulse output counter 12 is added to the circuit construction of the second embodiment as described above (see a block diagram of FIG. 30), and that the output frequency of the detection assisting pulse signal is counted, and in accordance with the detection signal input from the detecting circuit 6 and the count result, the output or non-output of the detection assisting pulse signal is selected.

Figure 31:
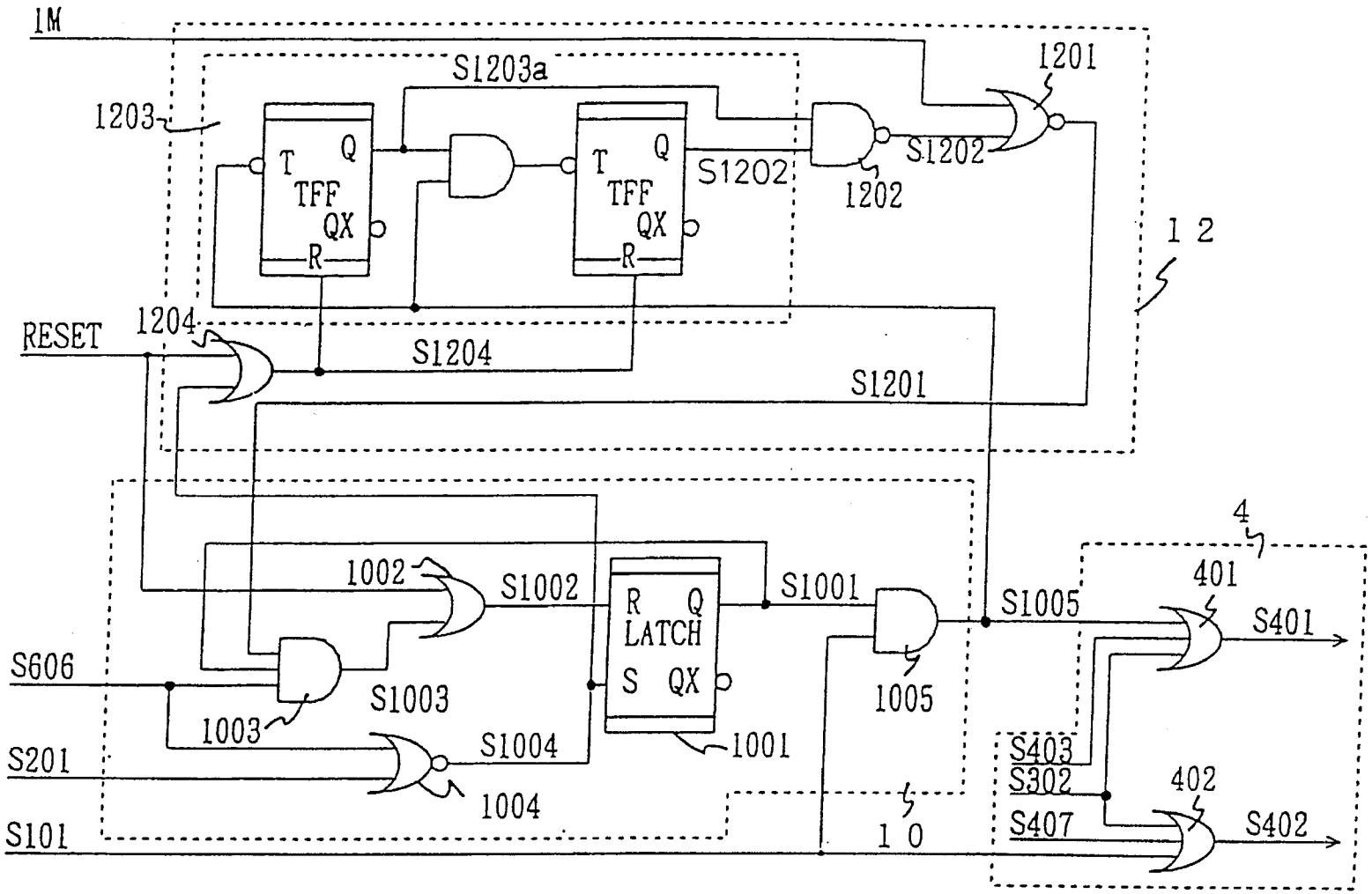
FIG. 31 is a circuit diagram showing an example of the detect assistant pulse output counter circuit 12 of the fourth embodiment according to this invention.
Figure 32:
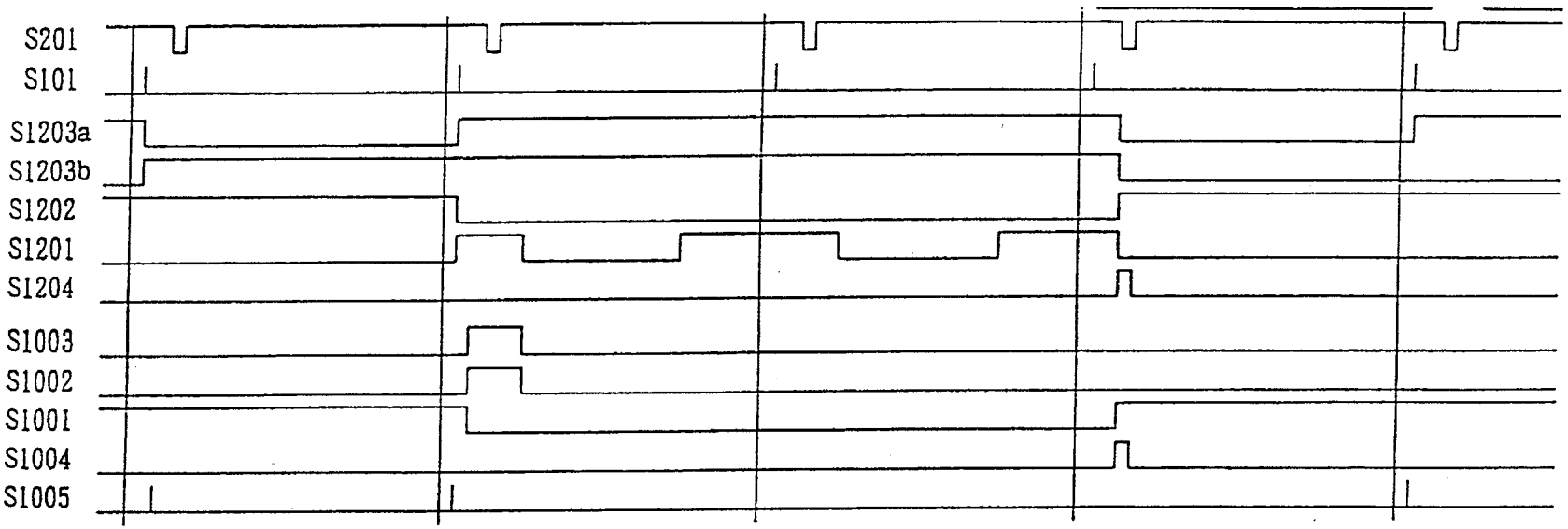
FIG. 32 is a timing chart for the electrical operation of the detect assistant pulse output counter circuit 12 and the detect assistant pulse output selecting circuit 10.

An embodiment of the detection assisting pulse output selecting circuit 10 and the detection assisting output counter 12 of this embodiment according to this invention is a circuit as shown in FIG. 31. FIG. 32 shows a timing chart for the circuit. The circuit construction of the fourth embodiment of this invention and the operation thereof will be described with reference to FIGS. 31 and 32.

The detection assisting pulse output counter 12 comprises a NOR gate 1201, a NAND gate 1202, a counter 1203 and an OR gate 1204.

The counter 1203 is a 2-bit binary counter, and switches the output signals S1203*a*, S1203*b* of the counter 1203 to "H" or "L" in synchronism with the trailing of the signal S1005 to output four kinds of combination signals (for example, S1203*a* is "H", and S1203*b* is "L" to the NAND gate 1202.

The NAND gate 1202 sets the signal S1202 to "L" only when the signals S1203*a* and S1203*b* are "H". The signals S1203*a* and S1203*b* are set to "H" only when a signal is input to the counter 1203 after reset at three times.

The NOR gate 1201 is synchronized with the master signal of 1 Hz. When all the input signals are "L", the output signal S1201 is set to "H".

The OR gate 1204 is supplied with the RESET signal and the signal S1004, and the output signa S1204 thereof is output to the reset terminal of the counter 1203.

The detection assisting pulse output selecting circuit 10 comprises a latch circuit 1001, AND gates 1003, 1005, an OR gate 1002 and a NOR gate 1004.

The latch circuit 1001 inverts the data of the output signal S1001 in synchronism with the rise-up of the input signal. Accordingly, the output signal S1001 is set to "H" when the input signal S1004 to the SET terminal rises up, and the output signal S1001 is set to "L" when the input signal S1002 to the RESET terminal rises up.

The output terminal of the AND gate 1005 is connected to the OR gate 401 of the drive pulse output selecting circuit 4 and the T terminal of the TFF 1203 of the detection assisting pulse output counter 12. The input signals to the AND gate 1005 are the detection assisting pulse signal S101 and the signal S1001, and the AND gate 1005 outputs the input signal S101 as an output signal S1005 thereof only when the signal S1001 is "H".

The input signals to the AND gate 1003 are the detection signal S606 from the detecting circuit 6, the output signal S1201 of the detection assisting pulse output counter 12, and the signal S1001. The output terminal thereof is connected to the OR gate 1002, and the signal S1003 is set to "H" when all the input signals are "H".

The output terminal of the OR gate 1002 is connected to the RESET terminal of the latch circuit. The input signals thereto are the RESET signal and the signal S1003, and the signal S1002 is set to "H" when any one of those signals is set to "H".

The output terminal of the NOR gate 1004 is connected to the SET terminal of the latch circuit and the OR gate 1204. The input signals thereto are the inverted signal of the signal S606 and the signal S201. The output signal S1002 thereof is set to "L" when the rotor is rotated, and set to "H" when the rotor is not rotated.

The above description is made for the circuit construction of the fourth embodiment according to this invention and the operation thereof.

Figure 33:
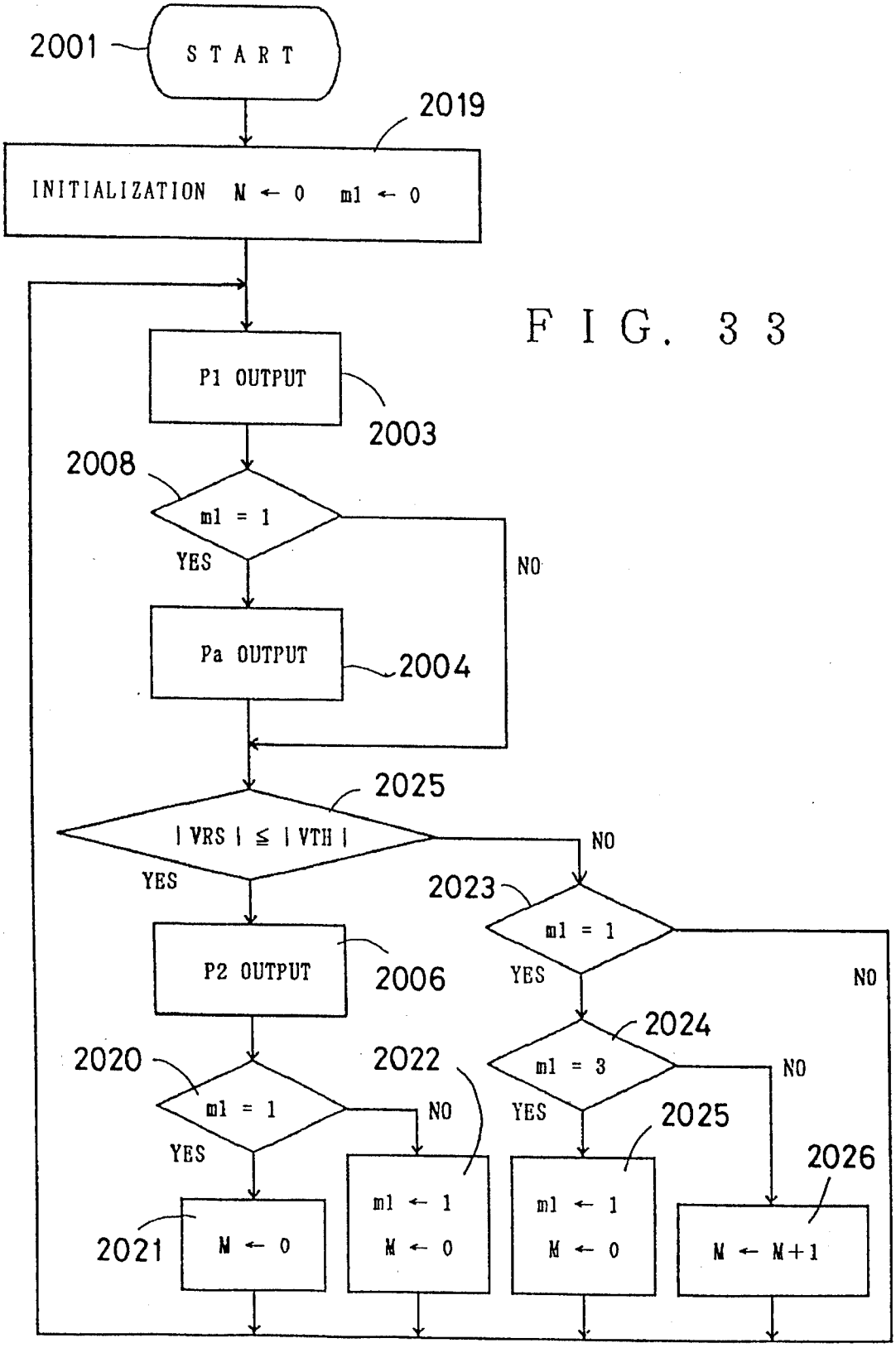
FIG. 33 is a flowchart for the circuit operation of the fourth embodiment according to this invention.

The operation of the circuit of the fourth embodiment according to this invention will be next described with reference to a flowchart of FIG. 33.

First, simultaneously with the start (2001), the initialization of the circuit (2019) is made to set a counter variable M to M=0 and set the control signal m1 (signal S1001 as shown in FIG. 31) to m1=0. Subsequently, the main drive pulse P1 is output to the stepping motor (2003), and then it is judged using the control signal ml whether a next detection assisting pulse is output to the stepping motor (2008). If "m1=1", the next detection assisting pulse Pa is output to the stepping motor after the interruption of the main drive pulse (2004). On the other hand, if "m1=0", the detection assisting pulse Pa is not output to the stepping motor.

Further, after the interruption of the detection assisting pulse, the process goes to the next rotation detecting operation.

At the rotation detecting step (2005), the rotation or non-rotation of the rotor is judged. The detecting method uses the comparison between VTH and VRS. If |VRS|≦|VTH|, the correction drive pulse P2 is output to the stepping motor (2006). Thereafter, the control signal ml is identified (2020). If "m1=1", the counter variable is rewritten to "M=0"(2021). If "m1=0", the counter variable M and the control signal m1 are rewritten to "M=0" and "m=1", respectively (2022).

On the other hand, at the rotation detecting step (2005), if |VRS|>|VTH|, the control signal ml is first identified (2023). If "m1=1", the count value of the counter variable M is identified (2024). If "M=3", the data of the control signal m1 and the counter variable M are reset to "m1=0" and "M=0", respectively (2025). If "M is not equal to 3", the counter variable M is incremented as follows: "M=M+1" (2026). If "m1 is not equal to 1", no data rewriting operation is carried out on the control signal m1 and the counter variable M. Subsequently, the operation of rotating the rotor is terminated.

By repeating the above operation, the output or non-output of the detection assisting pulse can be controlled in accordance with the rotation detection result of the rotor. If the detection assisting pulse is output once in consideration of a load torque by a calender by which a load is applied to the stepping motor for a long time, the output of the detection assisting pulse is continued during several stepping operation period, so that the precision of the rotation detection is improved.

(5) Fifth Embodiment

Figure 34:
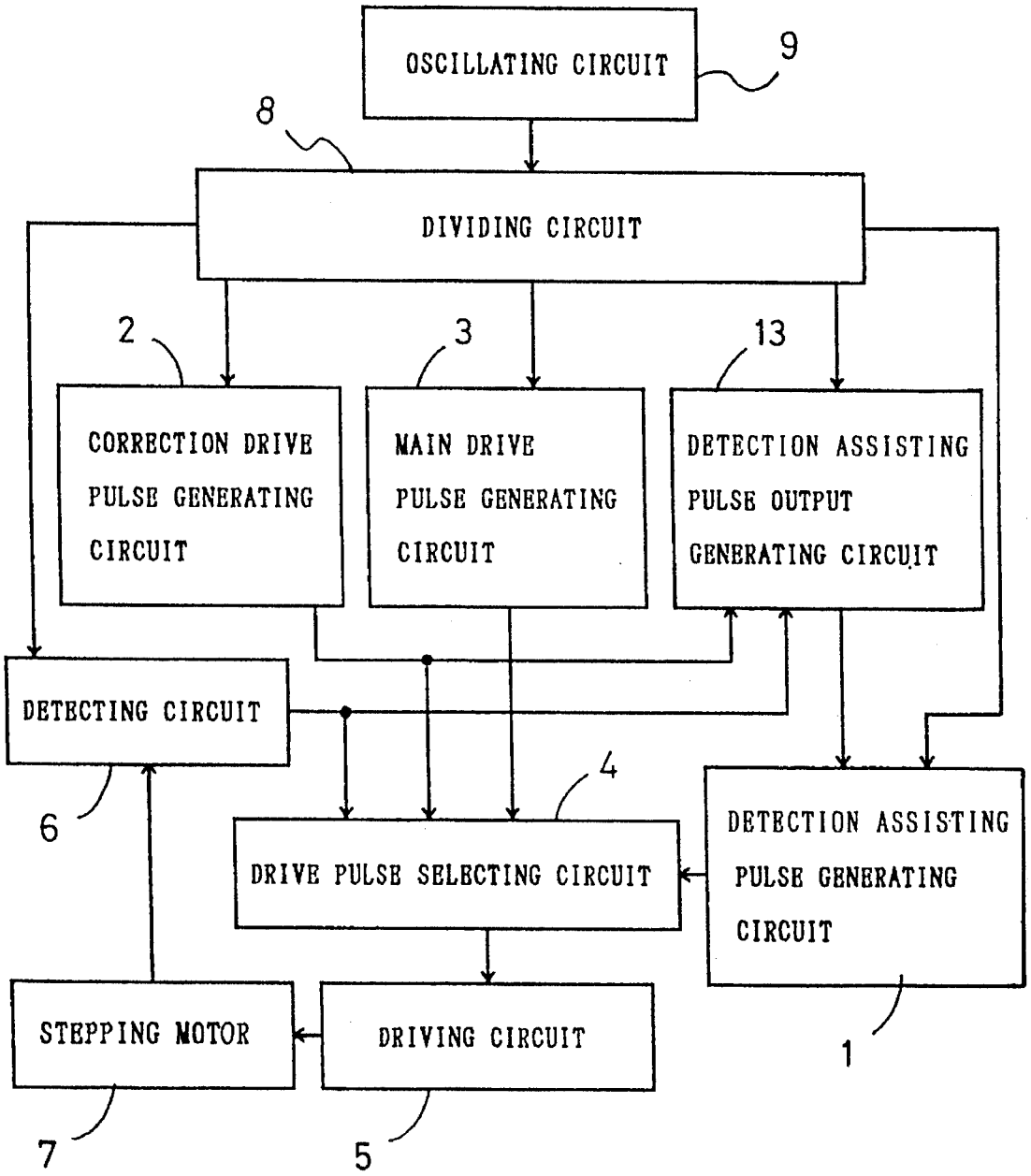
FIG. 34 is a block diagram showing the fifth embodiment according to this invention.
Figure 35:
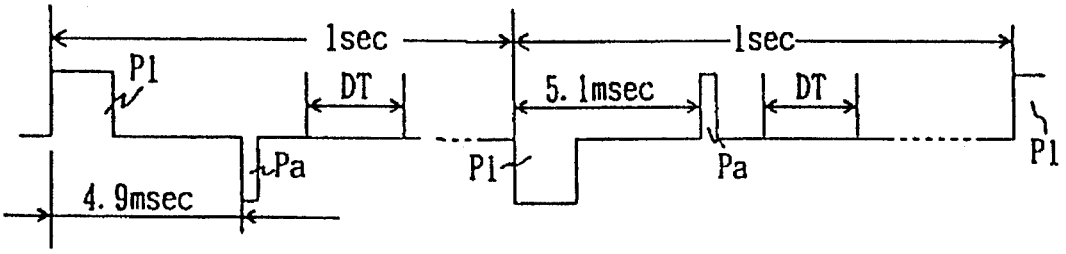
FIG. 35 is a diagram showing the drive voltage waveform of the fifth embodiment according to this invention.

The circuit construction of the fifth embodiment according to this invention is characterized in that a detection assisting pulse output timing generating circuit 13 is added to the circuit construction of the first embodiment as described above (see block diagram of FIG. 34), the timing of starting the output of the detection assisting pulse signal is altered (varied) in accordance with the detection signal input from the detecting circuit 6 (see FIG. 35).

Figure 36:
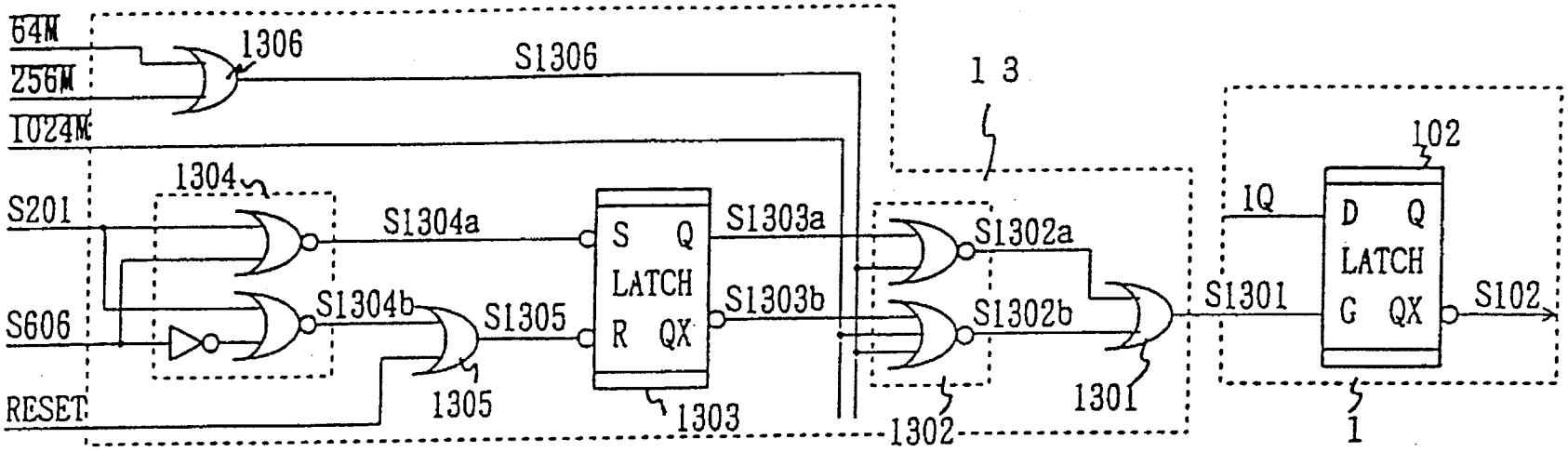
FIG. 36 is a circuit diagram showing an example of the detect assistant pulse output timing generating circuit 13 of the fifth embodiment according to this invention.
Figure 37:
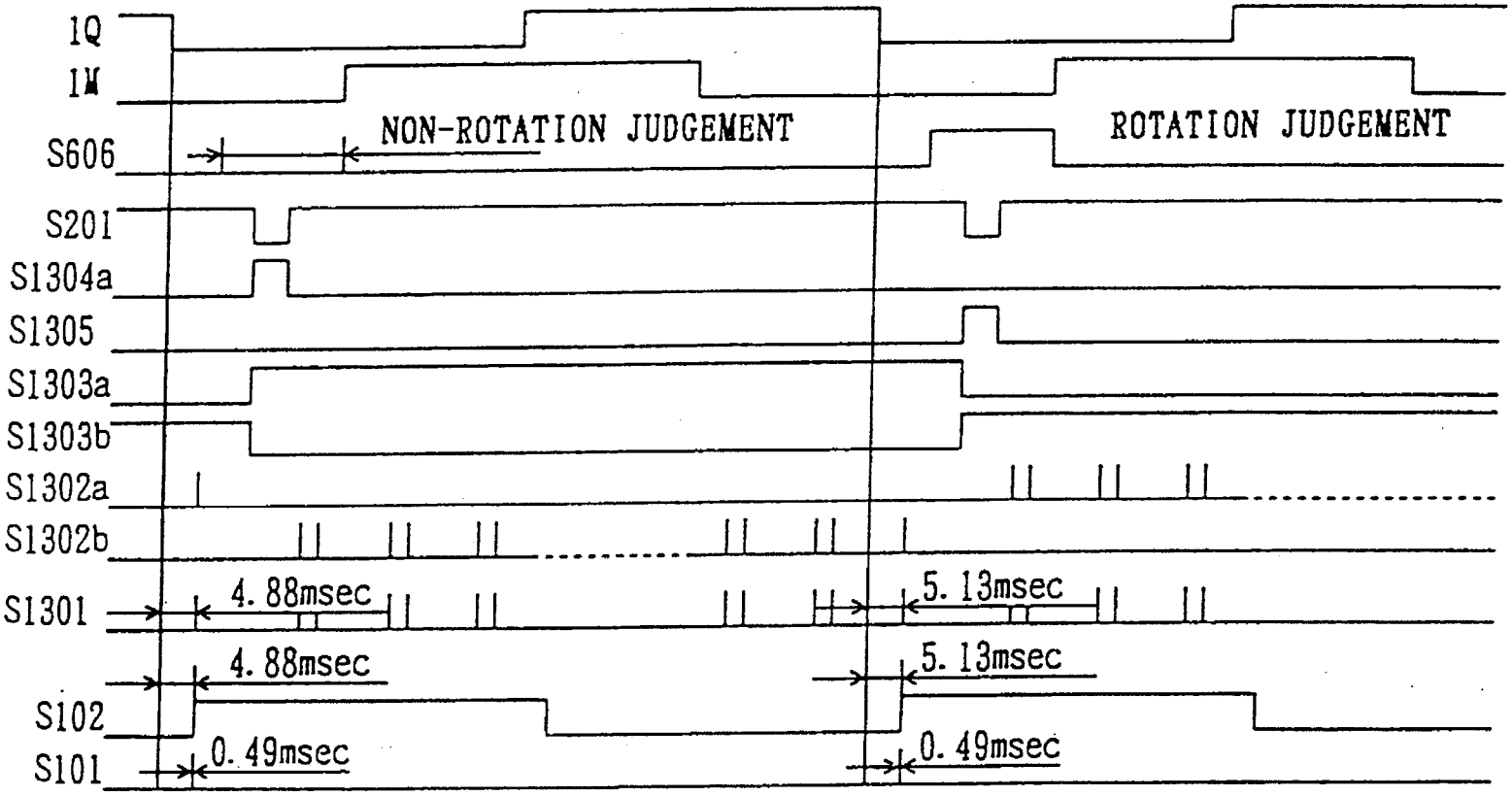
FIG. 37 is a timing chart for the electrical operation of the detect assistant pulse output timing generating circuit 13 of the fifth embodiment according to this invention.

An embodiment of the detection assisting pulse output timing generating circuit 13 of this embodiment according to this invention is a circuit as shown in FIG. 36, and FIG. 37 shows a timing chart. The circuit construction of an embodiment in the fifth embodiment of this invention and the operation thereof will be described with reference to FIGS. 36 and 37.

The detection assisting pulse output timing generating circuit 13 comprises OR gates 1301, 1305, 1306, an NOR gate circuit 1302, an RS latch circuit 1303 and a gate circuit 1304.

The gate circuit 1304 outputs a signal S1304*a* to the SET terminal of a latch circuit 1303 in accordance with two kinds of detection signals S606 from the detecting circuit 6 and the output signal S201 from the correction drive pulse, and outputs a signal S1304*b* to the OR gate 1305. When the detection signal is "L (non-rotation)", S1304*a* is set to "H", and when the detection signal is "H (rotation)", S1304*b* is set to "H".

The OR gate 1305 outputs "H" signal to the RESET terminal of the latch circuit 1303 when any one of the RESET signal and the signal S1304*b* is set to "H".

The latch circuit 1303 sets the signal S1303*a* to "L" in the RESET state, and sets the signal S1303*b* to "L" in the SET state.

The NOR gate circuit 1302 is input with a signal S1306 which is synthesized in the OR gate 1306 from inverted master signals (an inverse of the signal 64M and an inverse of the signal 256M) from the dividing circuit 8, a master signal of an inverse of the signal 1024M, and the signals S1303*a* and S1303*b*. The NOR gate circuit 1302 outputs "H" at a combination timing at which the input signals are "L". There are two output signals, and these output signals S1302*a* and S1302*b* are input to the OR gate 1301. The output signal S1302*a* rises up after 4.88 msec elapses from the rise-up of the IQ signal, and the output signal S1302*b* rises up after 5.13 msec elapses from the trailing end of the IQ signal.

The OR gate 1301 is provided to set both of the two output signals S1302*a* and S1302*b* to one detection assisting pulse output timing altering signal S1301.

The detection assisting pulse output timing altering circuit 13 as described above with reference to FIG. 36 is operated in accordance with the detection signal S606, whereby the output timing of the detection assisting pulse signal can be altered.

Figure 38:
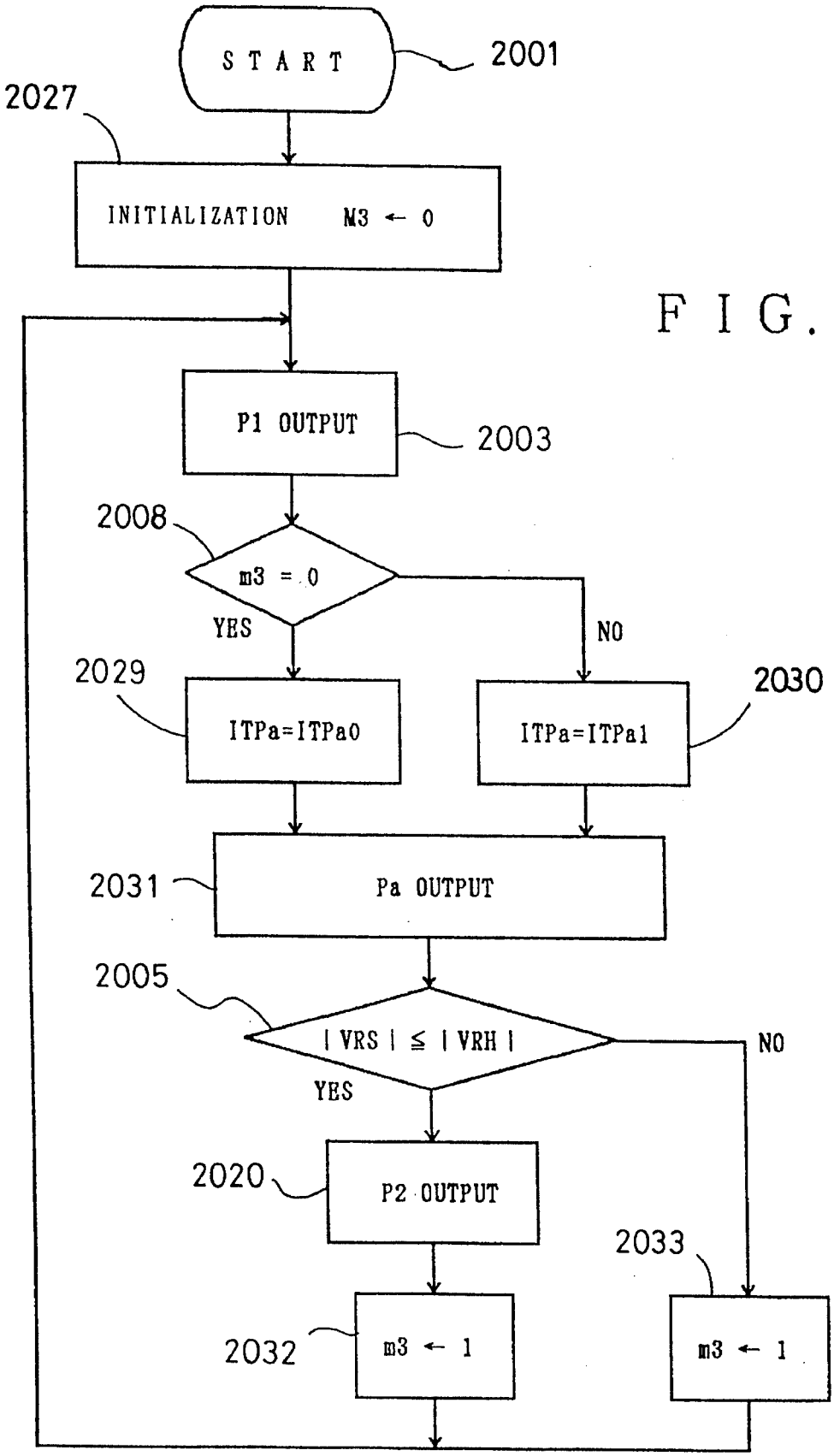
FIG. 38 is a flowchart for the circuit operation of the fifth embodiment according to this invention.

The operation of the circuit of the fifth embodiment of this invention will be next described with reference to a flowchart of FIG. 38.

First, simultaneously with the start (2001), the initialization is made to the circuit to set the control signal m3 (for example, the signal S1303*a* as shown in FIG. 36) to "m3=0". After the main drive pulse P1 is output to the stepping motor (2003), the output timing of a next detect assistant pulse Pa is selected (2028). The selection of the output timing of the detection assisting pulse Pa is carried out using the control signal m3. If "m3=0", the detection assisting pulse output timing ITPa is set to "ITPa=ITPa0 (for example, ITPa0=4.88 msec)" (2029), and output to the stepping motor (2031).

On the other hand, if "m3=1", the detection assisting pulse output timing ITPa is set to "ITPa=ITPa1 (for example, ItPa1=5.13 msec)" (2030), and output to the stepping motor (2031).

Further, the process goes to the next rotation detecting operation after the detection assisting goes low pulse.

At the rotation detecting step (2005), the rotation or non-rotation of the rotor is judged. The detection method uses the comparison between VTH and VRS. If |VRS|≦|VTH|, the correction drive pulse P2 is output to the stepping motor (2006). Thereafter, the control signal m3 is rewritten to the signal "m3=1" (2032).

On the other hand, if |VRS|>|VTH|, the correction pulse is output to the stepping motor, and the control signal m3 is rewritten to "m3=0" (2033). Thereafter, the operation of rotating the rotor by one step is terminated.

By repeating the above operation, the start time of the output timing of the detection assisting pulse can be altered in accordance with the rotation detection result of the rotor. By executing the altering operation of the output timing start time of the detection assisting pulse, the precision of the rotation detection can be improved.

(6) Sixth Embodiment

Figure 39:
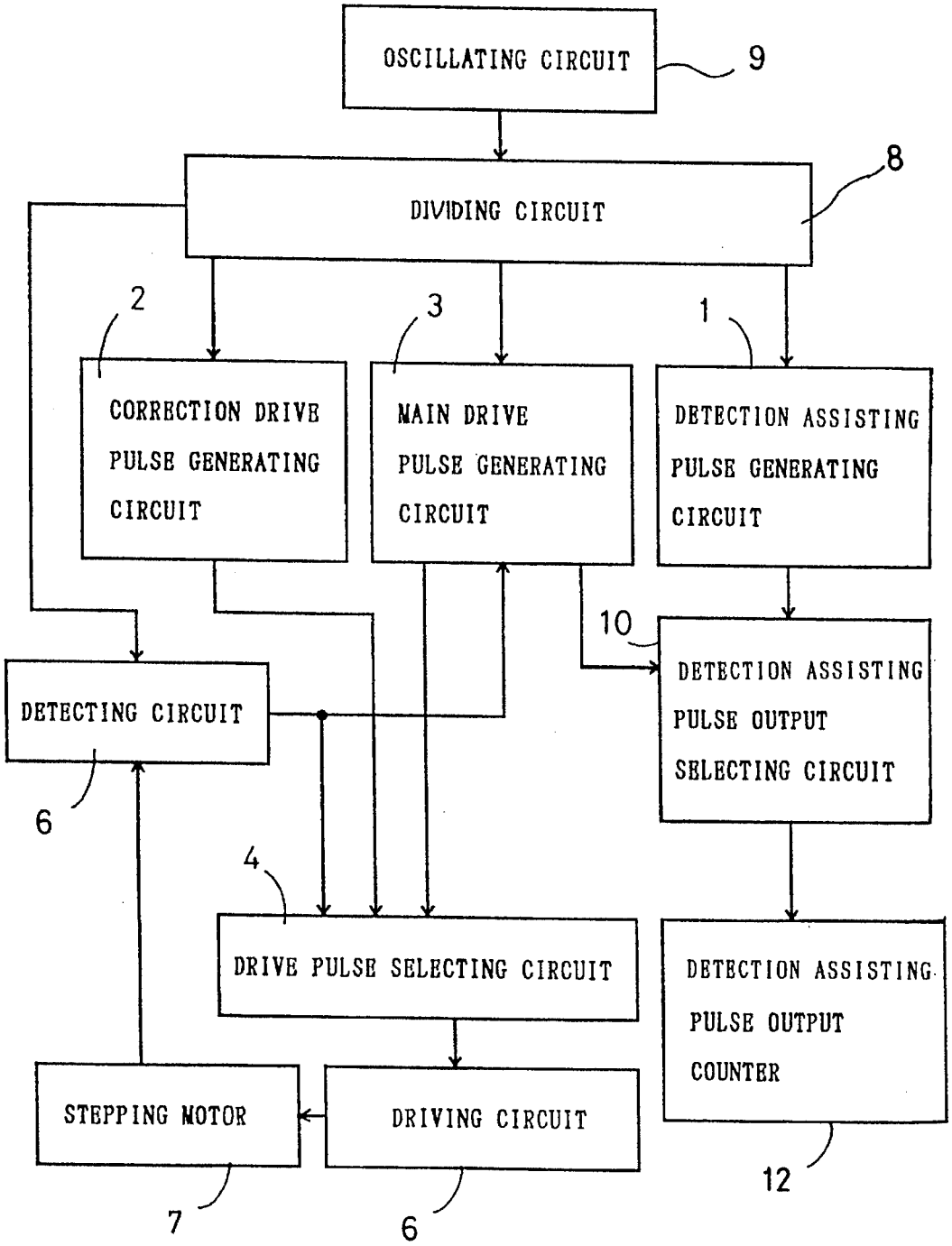
FIG. 39 is a block diagram showing the sixth embodiment according to this invention.
Figure 40:
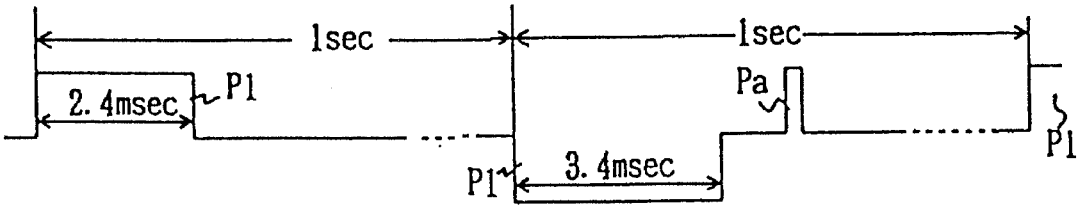
FIG. 40 is a diagram showing the drive voltage waveform of the sixth embodiment according to this invention.

The circuit construction of the sixth embodiment of this invention is characterized in that a detection assisting pulse output selecting circuit 10 is added to the circuit construction of the first embodiment (see block diagram as shown in FIG. 39), and the output or non-output of the detection assisting pulse signal is selected in accordance with the gate output signal of the main drive pulse generating circuit 3 (see FIG. 40).

Figure 43:
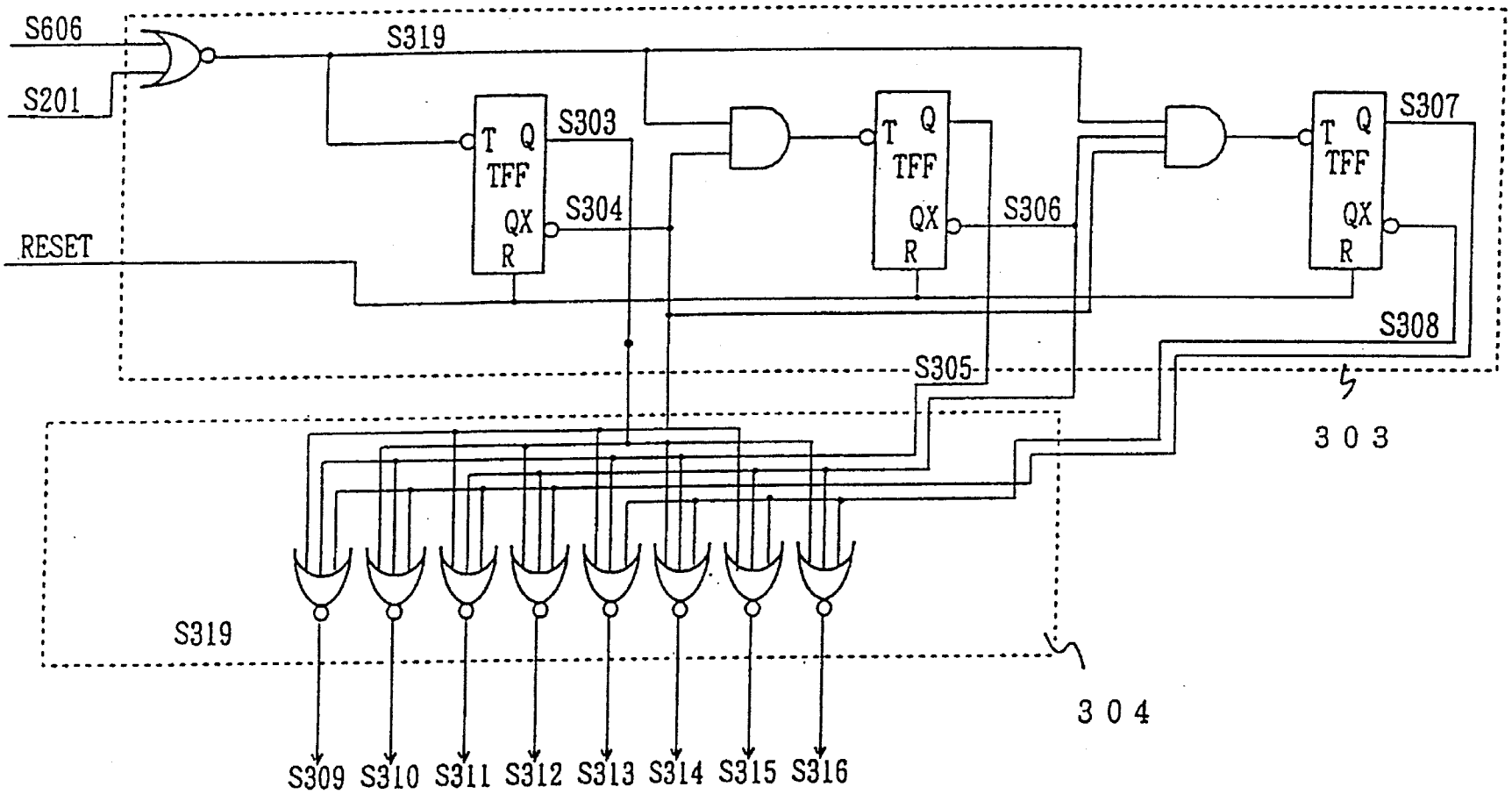
FIG. 43 is a circuit diagram showing an example of the main drive pulse generating circuit of the sixth embodiment according to this invention.
Figure 44:
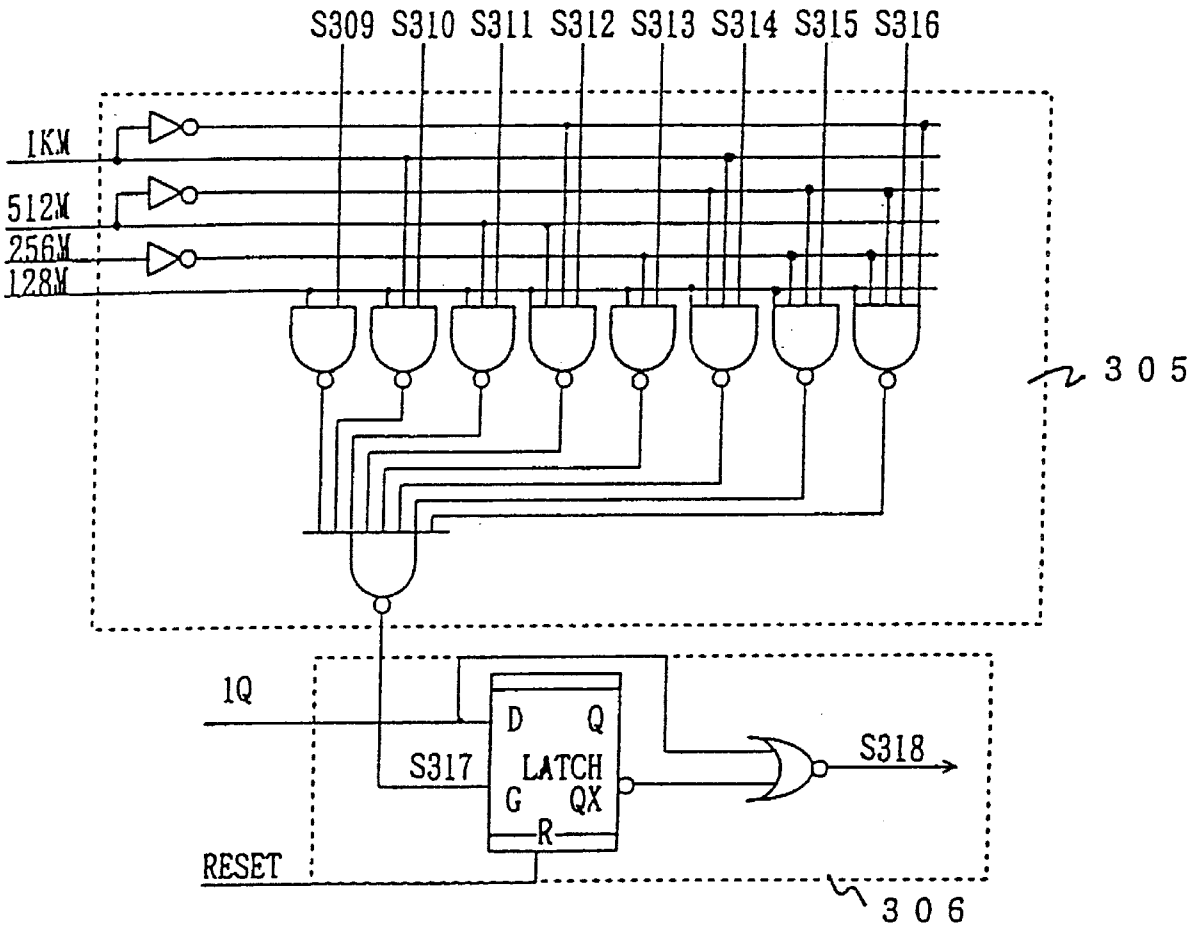
FIG. 44 is a circuit diagram showing an example of the main drive pulse generating circuit of the sixth embodiment according to this invention.

The main drive pulse generating circuit 3 will be first described with reference to FIGS. 43 and 44. The main drive pulse generating circuit 3 comprises an up-counter 303 comprising a TFF, a NAND gate, etc., a gate circuit 304 for dividing the output signals (S303 to S308) of the up-counter 303 into eight different gate output signals (S309 to S316), a gate circuit 305 for synchronizing the gate output signals S309 to S316 of the gate circuit 304 with the master signal from the dividing circuit 8 and generating an interrupting timing signal S317 for the main drive pulse, and a gate circuit 306 using a latch circuit for generating a main drive pulse signal S318 once every second, etc.

The input gate of the up-counter 303 is supplied with the output signal S606 of the detecting circuit 6 and the output signal S201 from the correction drive pulse generating circuit.

Figure 45:
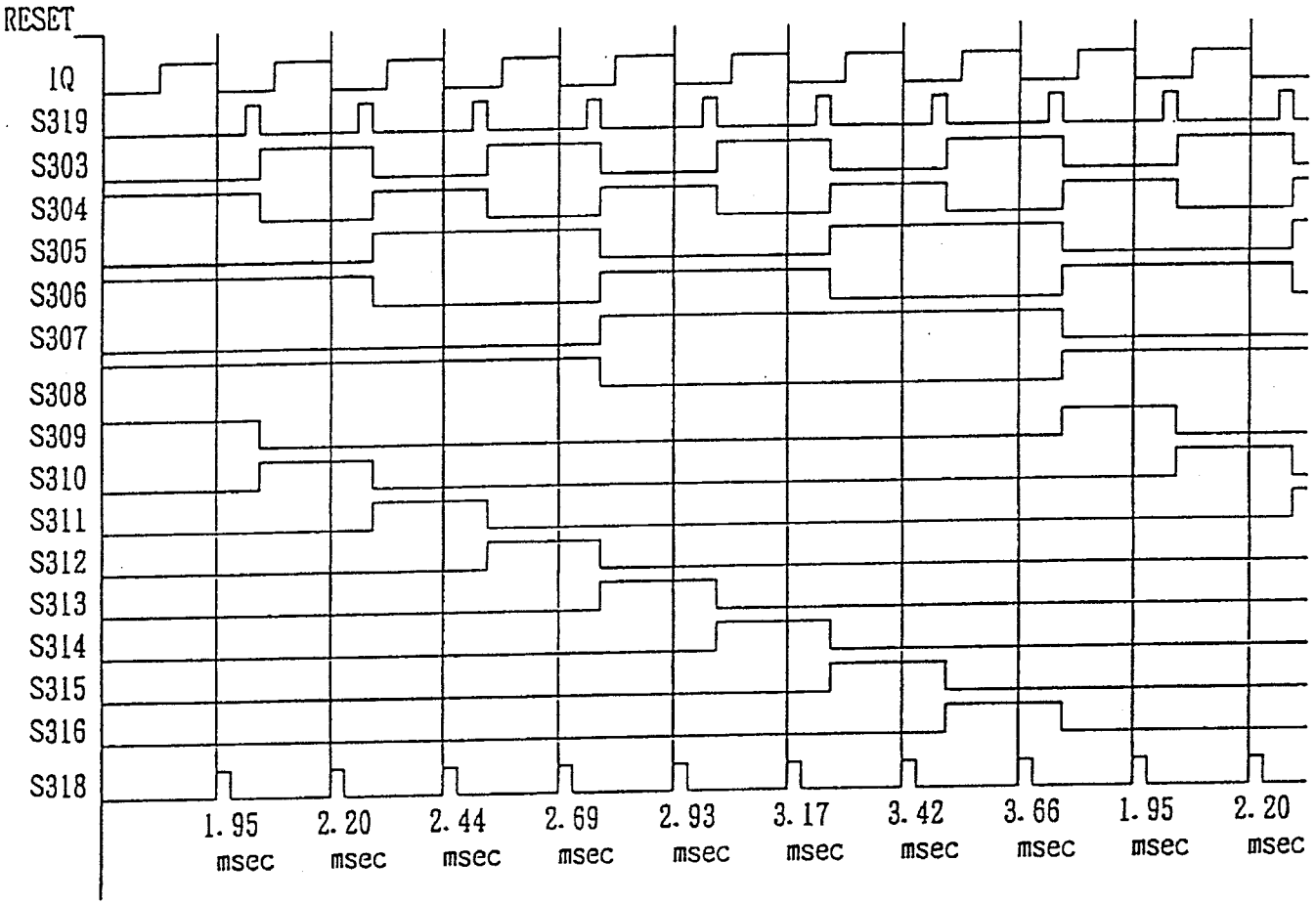
FIG. 45 is a timing chart for the electrical operation of the main drive pulse generating circuit of the sixth embodiment according to this invention.

The timing chart shown in FIG. 45 illustrates the input signal S319 and the output signals S303 to S308 of the up-counter 303, the gate output signals S309 to S316 of the gate circuit 304, and the main drive pulse signal S318. In order to clarify the operation of the main drive pulse generating circuit 3, FIG. 45 shows an operation in which the rotor is in the non-rotational state at all times.

Figure 41:
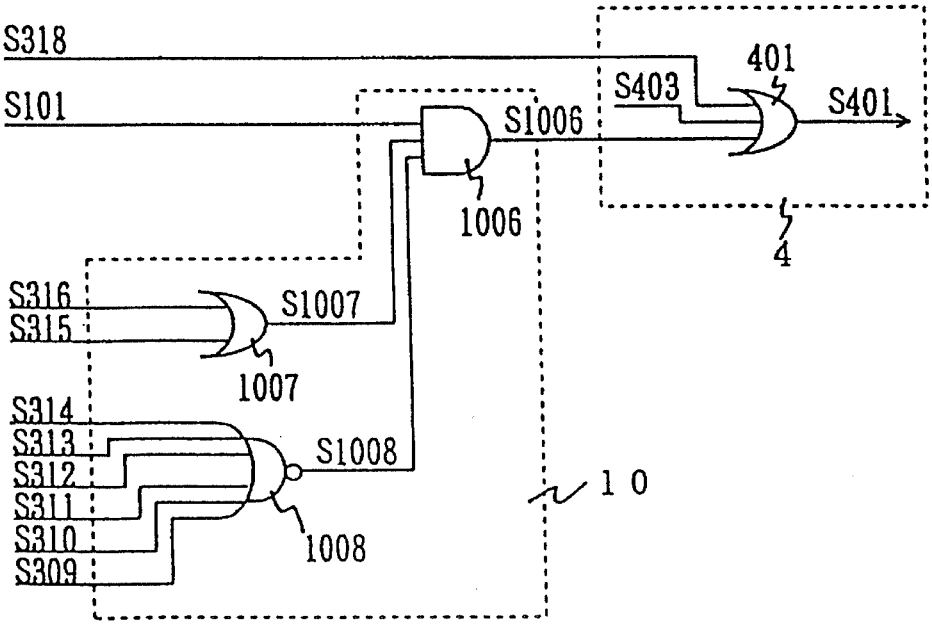
FIG. 41 is a circuit diagram showing an example of the detect assistant pulse output selecting circuit 10 of the sixth embodiment according to this invention.
Figure 42:
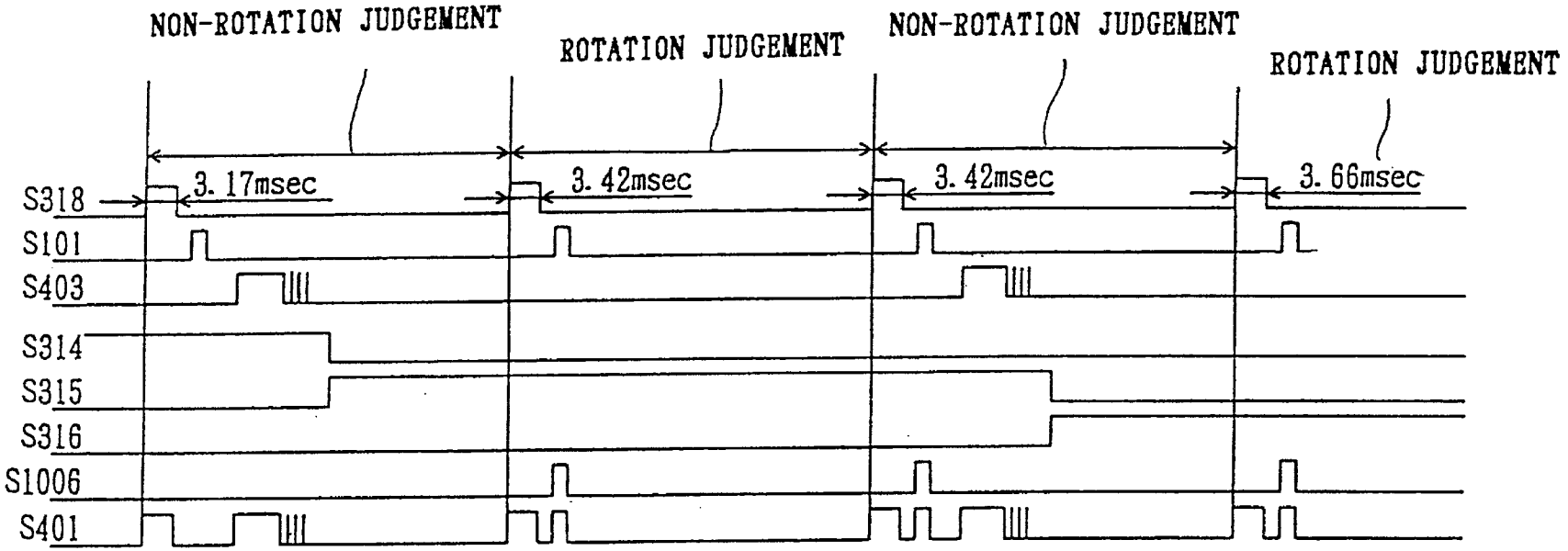
FIG. 42 is a timing chart for the electrical operation of the detect assistant pulse output selecting circuit 10 of the sixth embodiment according to this invention.

An embodiment of the detection assisting pulse output selecting circuit 10 of this embodiment according to this invention is designed as shown in FIG. 41, and FIG. 42 shows the timing chart therefor. The circuit construction of an embodiment in the sixth embodiment of this invention and the operation thereof will be hereunder described with reference to FIGS. 41 and 42.

The embodiment of the detection assisting pulse output selecting circuit 10 is designed as shown in FIG. 41, and comprises an AND gate 1006, an OR gate 1007, a NOR gate 1008, etc.

The OR gate 1007 outputs an "H" signal to the AND gate 1006 when any one of the gate output signals S315, S316 is "H".

The NOR gate 1008 outputs an "H" signal to the AND gate 1006 when all the gate output signals S309 to S314 are "L".

The AND gate 1006 outputs the detection assisting pulse signal S101 to the OR gate 401 as a signal S1006 when the input signals S1007, S1008 are "H".

FIG. 42 shows the timing chart for the circuit operation described above, and shows the input signals S318 and S314 to S316 from the main drive pulse generating circuit 3, the detection assisting pulse signal S101, and the signals S401 and S403 of the drive pulse selecting circuit 4.

Only when the gate output signal S315 or S316 is "H", the detection assisting pulse signal S1006 is output to the OR gate 401 of the drive pulse selecting circuit 4. On the other hand, when any one of the main drive pulse selecting signals S309 to S314 is "L", the signal S1006 is left to be "L" irrespective of the rotation detection result, and the signal S1006 is not input to the OR gate 401.

Figure 46:
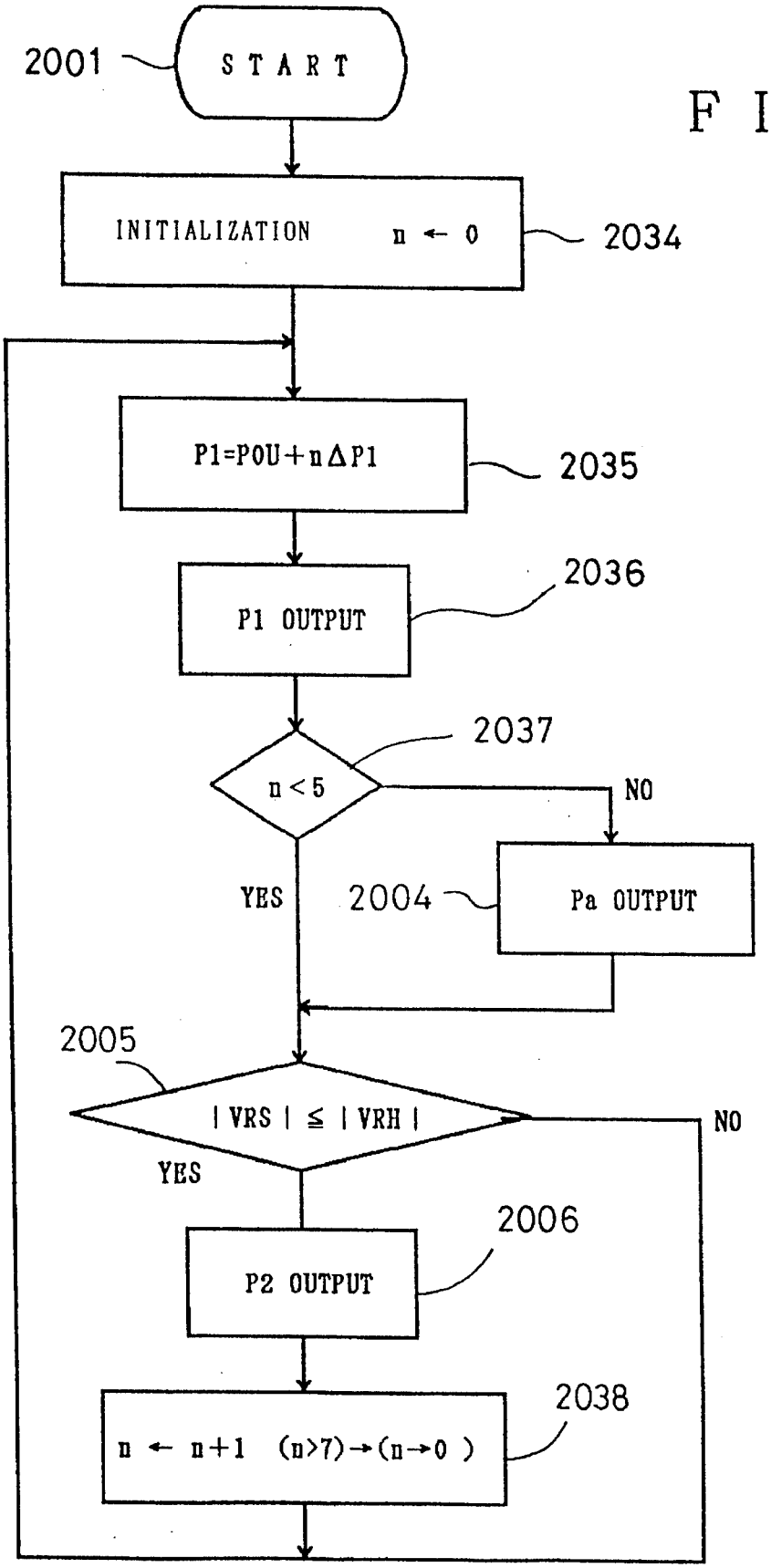
FIG. 46 is a flowchart for the circuit diagram of the sixth embodiment according to this invention.

The circuit operation of the sixth embodiment of this invention will be described with reference to a flowchart of FIG. 46.

First, simultaneously with the start (2001), the initial setting (2034) is made to set a counter variable n to "n=0". The main drive pulse P1 is set to P1=P0+nΔP1 (2035). At this time, P0 has the shortest pulse width (for example, P0=1.95 msec), n is set to 0 to 7, and ΔP1 is set to 0.244 msec.

After the setting of the main drive pulse P1, the main drive pulse P1 is output to the motor (2036), and the output or non-output of the next detection assisting pulse Pa is judged (2037). The judgment on the output or non-output is carried out using the counter variable n. If "n≧6", the detection assisting pulse Pa is output (2004), and if "n<5", the detection assisting pulse Pa is output to the motor.

In the next rotation detecting operation (2005), the rotation or non-rotation of the rotor is judged. The detection method uses the comparison between VTH and VRS. If |VRS|≦|VTH|, the correction drive pulse P2 is output (2006), the counter variable n is incremented as follows: "n=n+1" (2038), and the operation of rotating the rotor is terminated.

The above description is for the operating flowchart. P0, ΔP1, Pa0, ΔPa can be easily determined on the electrical circuit, and these values are not necessary to be limited to the above values.

(7) Seventh Embodiment

Figure 47:
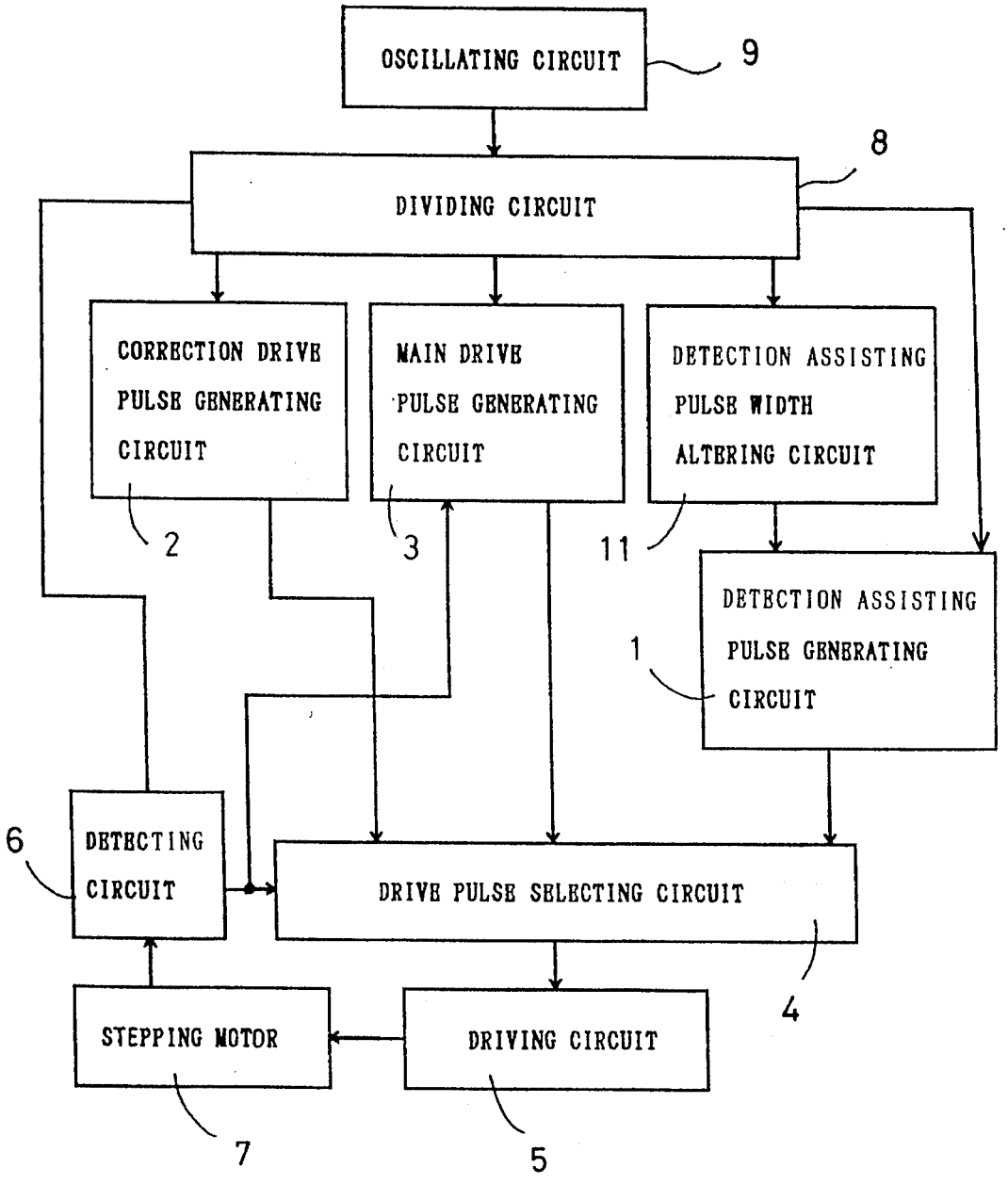
FIG. 47 is a block diagram showing the seventh embodiment according to this invention.
Figure 48:
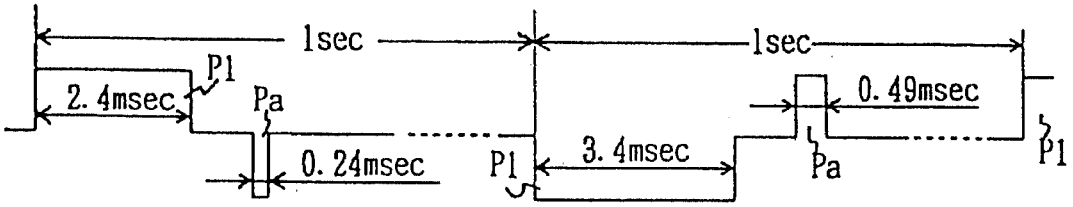
FIG. 48 is a diagram showing the drive voltage waveform of the seventh embodiment according to this invention.

The circuit construction of the seventh embodiment is characterized in that a detection assisting pulse width altering circuit 11 is added to the circuit construction of the first embodiment as described above (see a block diagram as shown in FIG. 47), and the output or non-output of the detection assisting pulse signal is selected in accordance with the gate output signal of the main drive pulse generating circuit 3 (see FIG. 48).

Figure 49:
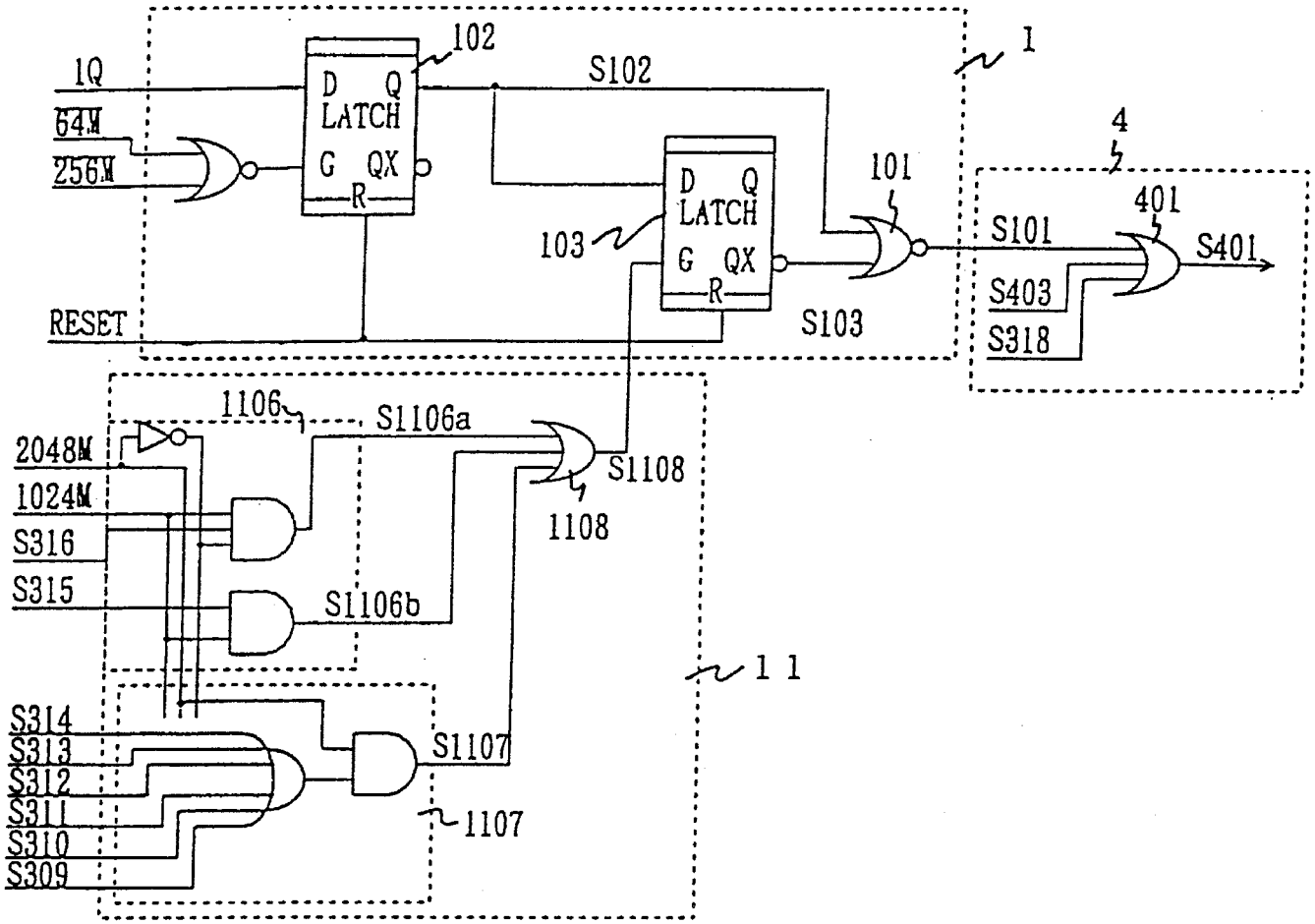
FIG. 49 is a circuit diagram showing an example of the detect assistant pulse width altering circuit 11 of the seventh embodiment according to this invention.
Figure 50:
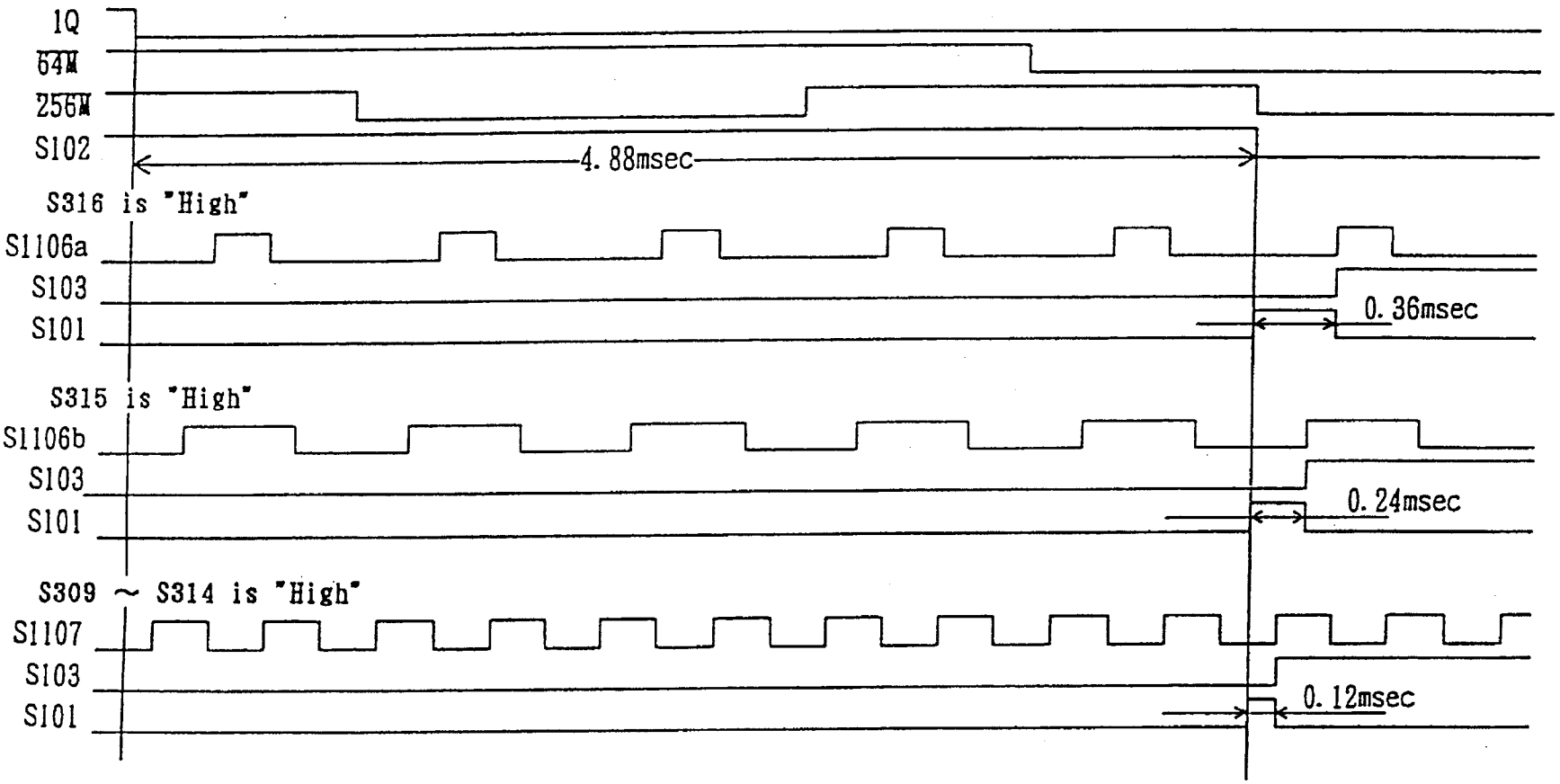
FIG. 50 is a timing chart for the electrical operation of the detect assistant pulse width altering circuit 11 of the seventh embodiment according to this invention.

An embodiment of the detection assisting pulse width altering circuit 11 of this embodiment of the pressent invention is shown in FIG. 49, and FIG. 50 is a timing chart diagram. The circuit construction of an embodiment in the seventh embodiment according to this invention and the operation thereof will be described with reference to FIGS. 49 and 50.

The detection assisting pulse width altering circuit 11 comprises an OR 9ate 1108, gate circuits 1106 and 1107, etc.

The gate circuit 1106 outputs a signal S1106*a* or S1106*b* to the OR gate 1108 when any one of the gate output signals S315 and S316 of the main drive pulse generating circuit 1 is "H".

The gate circuit 1107 outputs a master signal 2048 from the dividing circuit 8 to the Or gate 1108 as an output signal S1107 when any one of the gate output signals S309 to 8314 of the main drive pulse generating circuit 1 is "H".

The OR gate 1108 outputs any one of input signals S1106*a*, S1106*b* and S1107 to the gate terminal of the latch circuit 103 in the detection assisting pulse generating circuit as an output signal S1108.

In accordance with the output signal S1108, the signal S103 in the detection assisting pulse generating circuit 1 is synthesized, and the timing for interrupting the detection assisting pulse signal S101 is controlled, whereby alteration of the pulse width of the detection assisting pulse signal S101 is realized.

Figure 51:
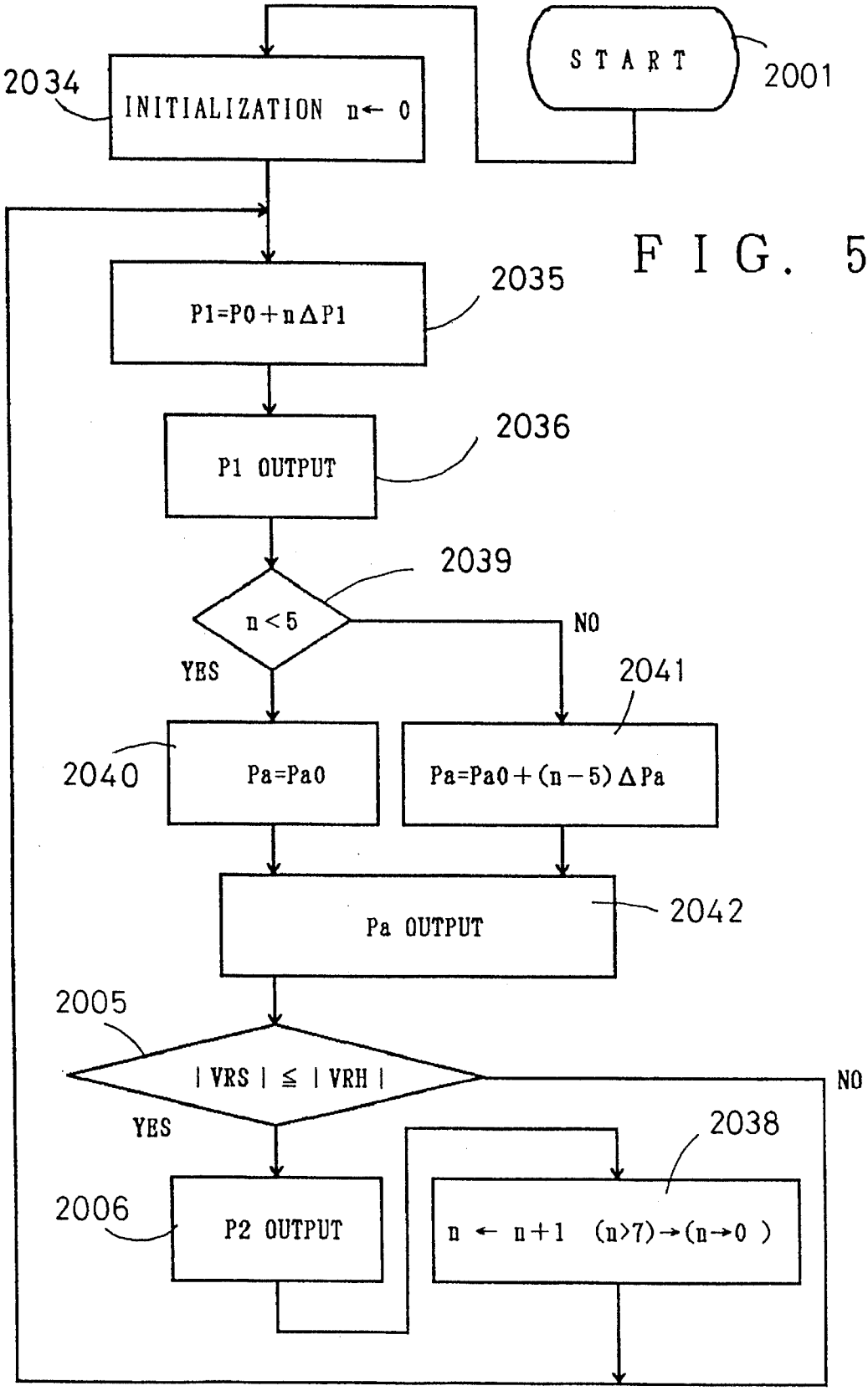
FIG. 51 is a flowchart for the circuit operation of the seventh embodiment according to this invention.

Next, the operation of the circuit of this embodiment will be described with a flowchart of FIG. 51.

First, simultaneously with the start (2001), the initial setting (2034) is made to set the counter variable n to "n=0". The main drive pulse P1 is set to P1=P0+nΔP1 (2035). At this time, P0 have the shortest pulse width (for example, P0=1.95 msec), n is set to 0 to 7, and ΔP1 is set to 0.244 msec.

After the setting of the main drive pulse P1, the main drive pulse P1 is output to the motor (2036), and the pulse width of.a next detection assisting pulse Pa is selected (2039). The counter variable n is used for the selection of the pulse width. If "n<5", the pulse width of the detection assisting pulse Pa is set to "Pa=Pa0" (2040), and the detection assisting pulse Pa is output (2042). On the other hand, if "n", the pulse width of the detection assisting pulse Pa is set to "Pa=Pa0+(n−5)ΔPa" (2041), and the detection assisting pulse Pa is output (2042).

In the next rotation detecting operation (2005), the rotation or non-rotation of the rotor is judged. The detection method uses the comparison between VTH and VRS. If |VRS|≦|VTH|, the correction drive pulse P2 is output (2006), and the counter variable n is incremented as follows: "n=n+1" (2038), thereafter terminating the operation of rotating the rotor.

The above description is for the operating flowchart. P0, P1, Pa0, Pa can be easily determined.on the electrical circuit, and thus these values are not necessarily to be limited to the above pulse width.

(8) Eighth embodiment

Figure 52:
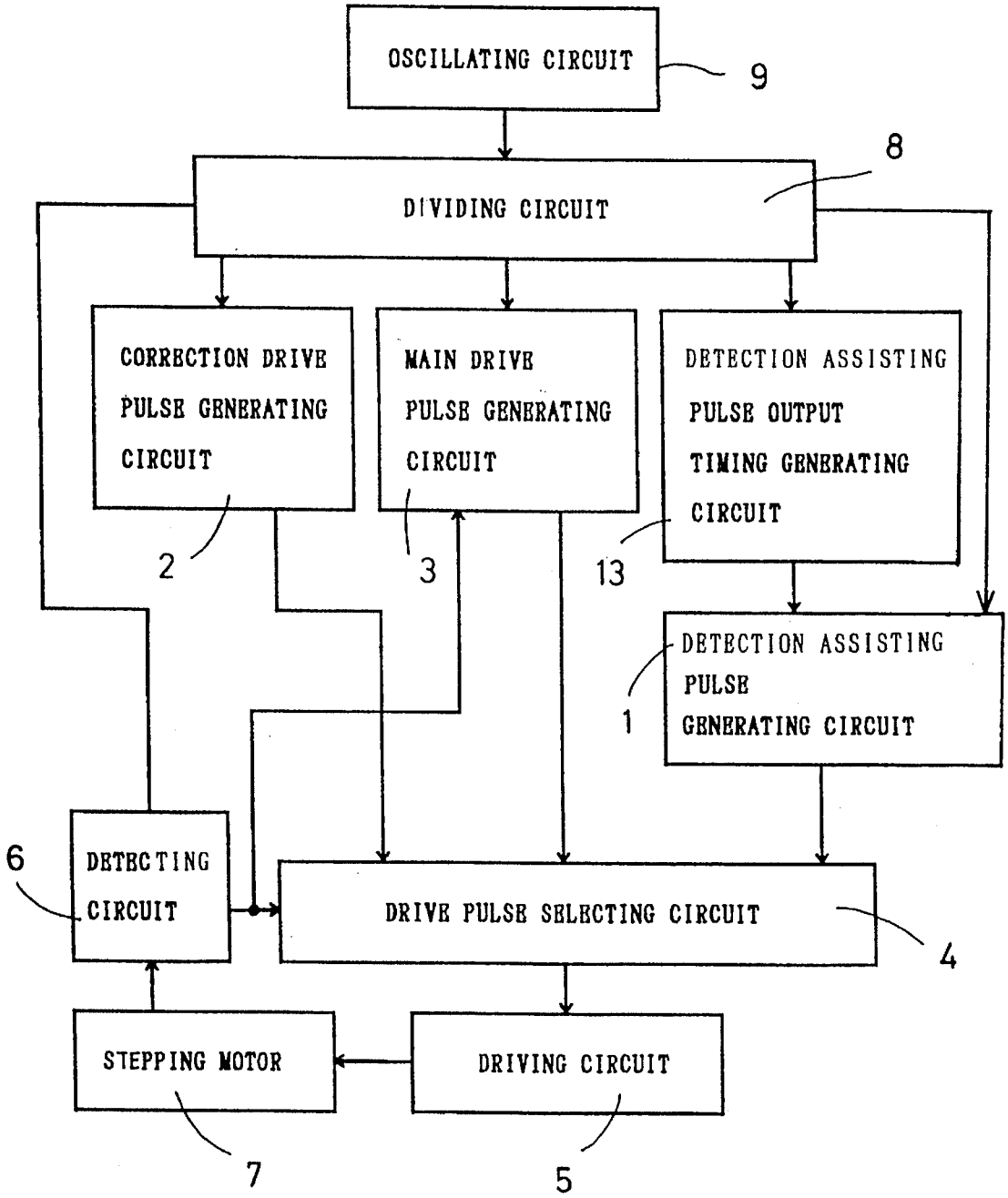
FIG. 52 is a block diagram showing the eighth embodiment according to this invention.
Figure 53:
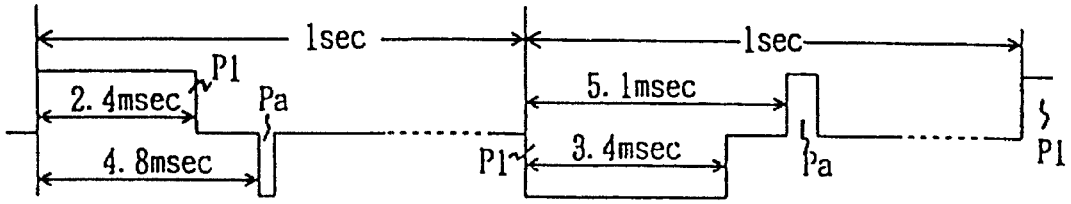
FIG. 53 is a diagram showing the drive voltage waveform of the eighth embodiment according to this invention.

The circuit construction of the eighth embodiment according to this invention is characterized in that a detection assisting pulse output timing generating circuit 13 is added to the circuit construction of the first embodiment as described above (see a block diagram as shown in FIG. 52), and the output start timing of the detection assisting pulse signal is altered in accordance with the gate output signal of the main drive pulse generating circuit 3 (see FIG. 53).

Figure 54:
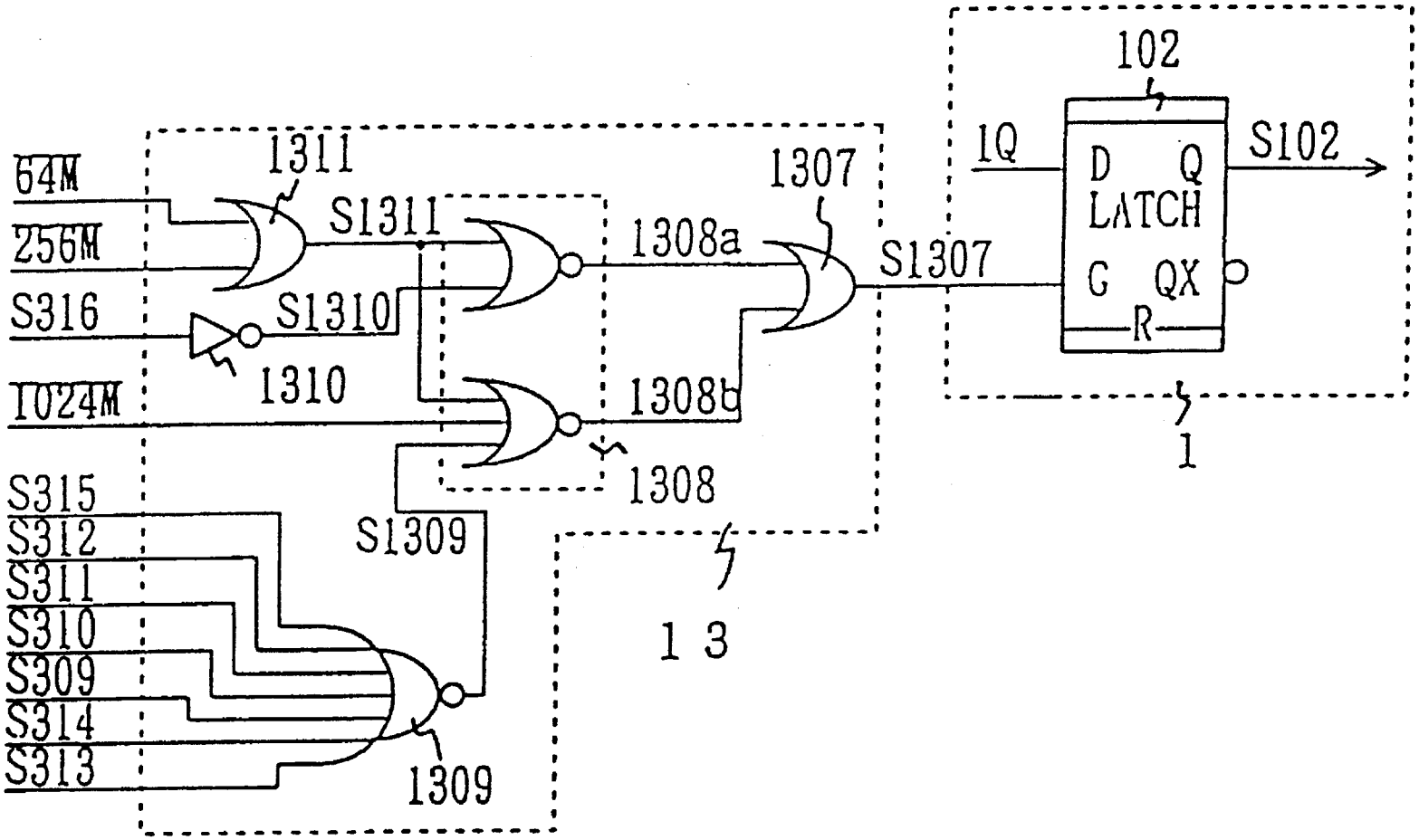
FIG. 54 is a circuit diagram showing an example of the detect assistant pulse output timing generating circuit 13 of the eighth embodiment according to this invention.
Figure 55:
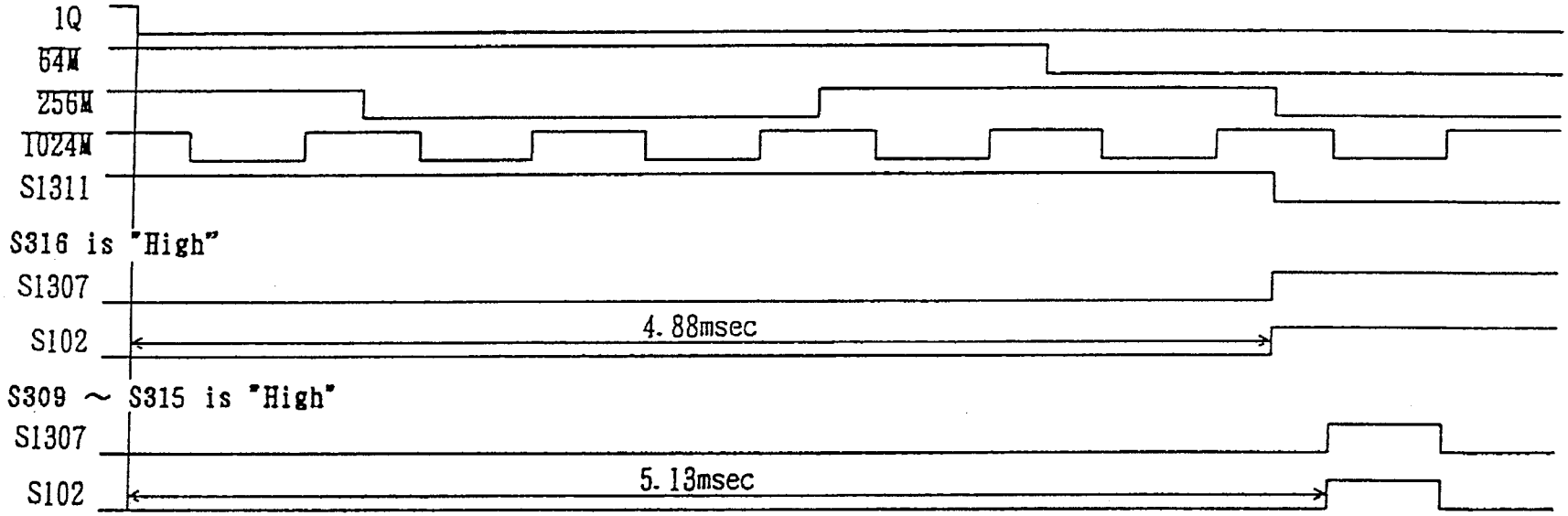
FIG. 55 is a timing chart for the electrical operation of the detect assistant pulse output timing generating circuit 13 of the eighth embodiment according to this invention.

FIG. 54 shows an embodiment of the detection assisting pulse output timing generating circuit 13 of the embodiment according to this invention, and FIG. 55 is a timing chart diagram. The circuit construction of the eighth embodiment and the operation thereof will be described with reference to FIGS. 54 and 55.

The detection assisting pulse output timing generating circuit 13 comprises OR gates 1307, 1311, a gate circuit 1308, a NOR gate 1309, a NOT gate 1310, etc.

The NOR gate 1309 sets an output signal S1309 to "L" when any one of the gate output signals S309 to S315 of the main drive pulse generating circuit is "H", outputs the signal to the gate circuit 1308.

The NOT gate 1310 inverts the gate output signal S316 of the drive pulse generating circuit, and outputs the signal S1310 to the gate circuit 1308.

The OR gate 1311 outputs to the gate circuit 1308 the. composite signal S1311 of the inverted master signals an inverse of the signal 64M and an inverse of the signal 256M of the dividing circuit 8.

The gate circuit 1308 is input with signals S1309, S1310 and S1311 and the inverted master signal an inverse of the signal 1024M of the dividing circuit 8, and outputs the output signal S1308*a* based on the signal S1311 to the OR gate 1307 when the gate output signal S316 is "H". When any one of the gate output signals S309 to S315 is "H" the gate circuit 1308 outputs the inverted master signal an inverse of the signal 1024M to the OR gate 1307 as an output signal S1308*b*.

The OR gate 1307 outputs a rise-up signal S1307 to the gate terminal of the latch circuit 102 of the detection assisting pulse generating circuit 1 when any one of the input signals S1308*a* and S1308*b* is "H". The output start time of the detection assisting pulse signal is determined with the signal S1307 to alter the signal S1307, whereby alteration of the output start time of the detection assisting pulse signal can be realized.

Figure 56:
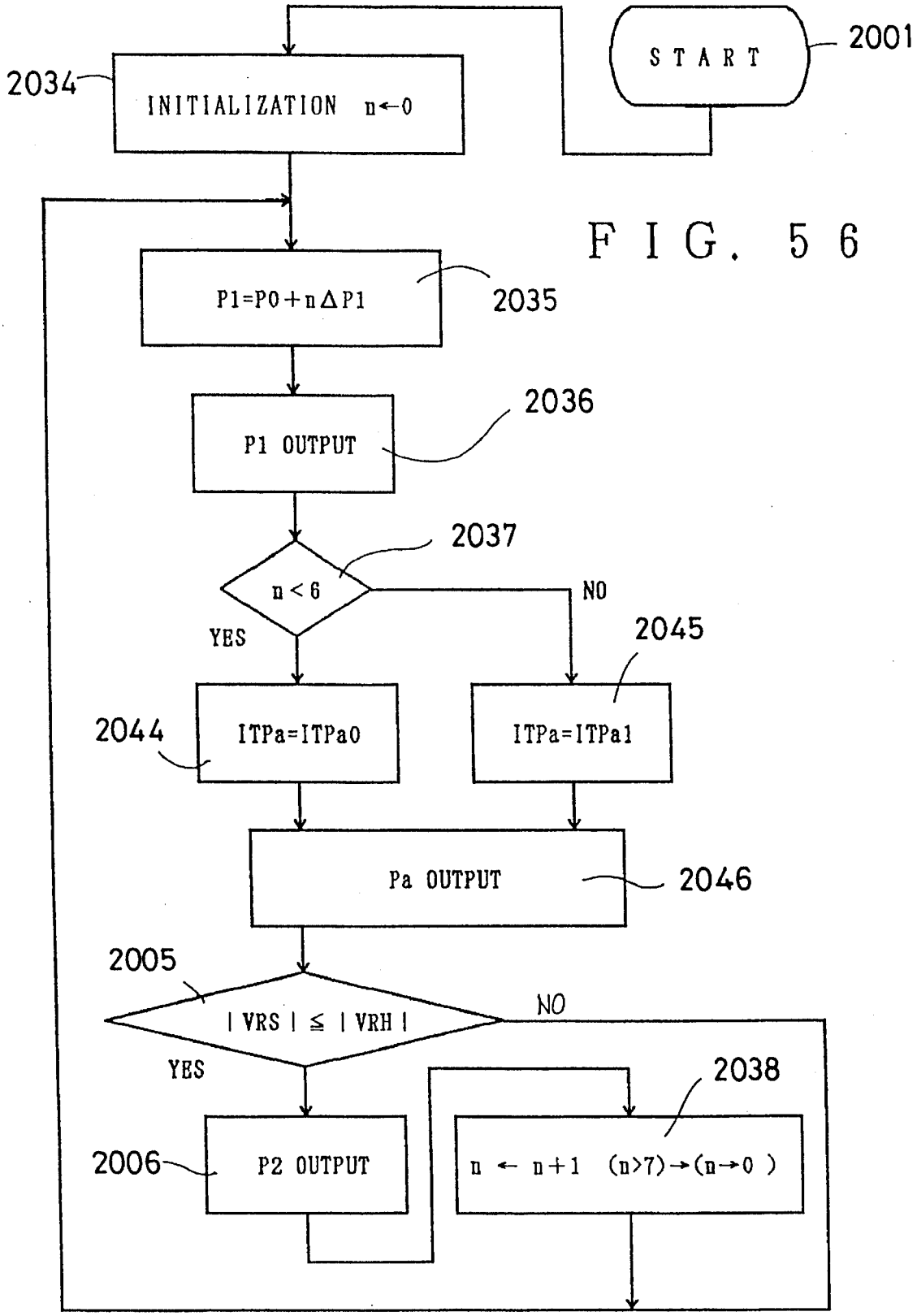
FIG. 56 is a flowchart for the circuit operation of the eighth embodiment according to this invention.
Figure 57A:
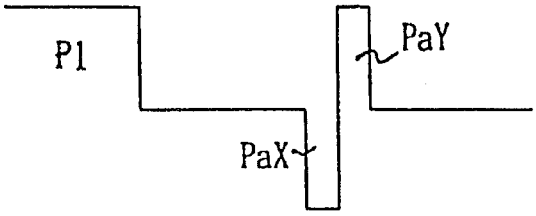
FIG. 57 (*a*) to (*d*) show the drive voltage waveform showing a construction example of an alternating pulse in the ninth embodiment according to this invention.
Figure 57B:
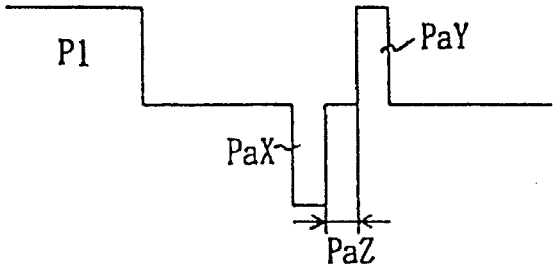
Figure 57C:
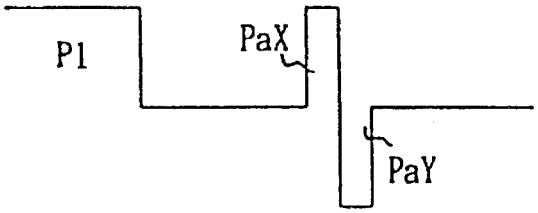
Figure 57D:
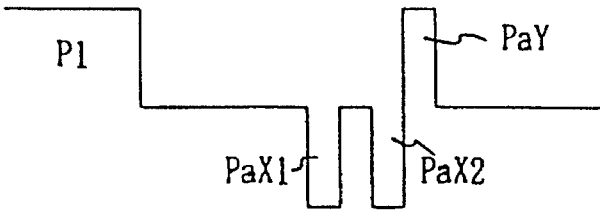

Next, the operation of the circuit of this invention will be described with reference to a flowchart of FIG. 56.

First, simultaneously with the start (2001), the initial setting (2034) is made to set the counter variable n to "n=0". The main drive pulse P1 is set to P1=P0+nΔP1 (2023). At this time, P0 has the shortest pulse width (for example, P0=1.95 msec), n is set to 0 to 7, and ΔP1 is set to 0.244 msec.

After the setting of the main drive pulse P1, the main drive pulse P1 is output to the motor (2036), and the pulse width of a next detection assisting pulse Pa is selected (2043). The counter value n is used for the selection of the pulse width. If "n<6", the output start timing ITPa of the detection assisting pulse Pa is set to "ITPa=ITPa0" (2044), and the detection assisting pulse Pa is output (2046). On the other hand, if "n≧6", the output start timing ITPa is set to "ITPa=ITPa1" (2045), and the detection assisting pulse Pa is output (2046).

In the next rotation detecting operation (2005), the rotation or non-rotation of the rotor is judged. The detection method uses the comparison between VTH and VRS. If |VRS|≦|VTH|, the correction drive pulse fP2 is output (2006), and the counter variable n is incremented as follows :"n=n+1" (2038), thereafter terminating the operation of the rotation of the rotor.

The above description is for the operating flowchart. P0, ΔP1, ITPa0, ITPa1 can be easily determined on the electrical circuit, and these are not necessarily to be limited to the above pulse width.

(9) Ninth Embodiment

In the ninth embodiment of this invention, the detection assistant pulse is alternated, and then output to the motor. FIGS. 57(*a*) to (*d*) are diagrams for the drive voltage waveform of the ninth embodiment.

There are various methods for generating an alternating pulse. The generation of the alternating pulse may be performed in the pulse generating circuit of the eighth embodiment and the other embodiments as described above, and thus the description thereof is omitted from the following embodiment.

The alternating pulse as shown in FIG. 57(*a*) is an embodiment of an alternating pulse which is formed by a detection assistant pulse PaX to be applied in an opposite direction to the main drive pulse and a detection assisting pulse PaY to be applied in the same direction as the main drive pulse.

The alternating pulse as shown in FIG. 57(*b*) is an embodiment of an alternating pulse for intermittently applying the detection assisting pulses Pax and PaY.

The alternating pulse as shown in FIG. 57(*c*) is an embodiment of an alternating pulse obtained by reversing the application order of the detection assisting pulses PaX and PaY for the alternating pulse as shown in (a).

The alternating pulse as shown in FIG. 57(*d*) is an embodiment of an alternating pulse for applying the detection assistant pulse PaY to the stepping motor after plural detection assistant pulses PaX, for example, PaX1 and PaX2 are applied to the stepping motor. The same effect can be also obtained by providing plural detection assisting pulses PaY.

It can be easily realized that the alternating pulses as shown in FIGS. 57(*a*) to (*d*) are repetitively applied to the stepping motor.

The effects of each embodiment disclosed in the present invention will be explained hereafter.

(Embodiment 1)

As described above, according to this invention, the rotation detecting system for the stepping motor in which the voltage induced in the coil of the stepping motor 7 after the interruption of the main drive pulse is converted to the transient voltage in the detecting circuit 6, thereby to electrically carry out detection judgment on the rotation of the stepping motor, the detection assisting pulse generating circuit 1 is provided on the circuit, and driving means for stepping motor for applying the detection assisting pulse as an effective power pulse from the driving circuit 5 after the interruption of the main drive pulse and before the detection of the rotation is provide.

The following effects can be obtained by the above construction in which the detection assisting pulse is provided before the rotation of the rotor is detected.

(1) When the main drive pulse having a wide pulse width and a large effective power is applied to the stepping motor in order to realize an accurate stepping operation by increasing the driving torque of the motor in accordance with unexpected increase of an external load torque, the output of the correction drive pulse due to an erroneous judgment operation which is caused by reduction of the induced voltage can be avoided, and the required minimum effective power can be supplied to the stepping motor.

(2) Even when a compact rotor, that is, a rotor having small inertia moment is used to realize miniaturization, thinning and low power-consumption for clocks, an erroneous judgment operation due to the stop of the rotation attenuating motion of the rotor after the interruption of the main drive pulse can be avoided, and the precision of the rotation detection can be effectively improved.

(3) High precision can be maintained for the rotation detection irrespective of dispersion in shape of parts of stepping motor due to mass production.

(Embodiment 2)

The detection assisting pulse output selecting circuit 10 for selecting whether the detection assisting pulse is output in accordance with the output result of the detecting circuit 6 obtained in the previous stepping operation is provided on the circuit of the embodiment 1. The following effect can be obtained by an electronic clock having the above construction in which the detection assisting pulse is output before the rotation detection of the rotor, and further the output or non-output is controlled.

(4) When the output or non-output of the detection assisting pulse is controlled in accordance with the rotation detection result of the rotor, the output of the detection assisting pulse is stopped in the stepping operation where the rotation detection is relatively stable, and thus the consumption of the effective power due to the detection assisting pulse can be prevented.

(Embodiment 3)

The detection assisting pulse width altering circuit 11 for altering the pulse width in accordance with the output result of the detecting circuit 6 obtained in the previous stepping operation is provided on the circuit of the first embodiment. The following effects can be obtained by an electronic clock having the construction in which the detection assisting pulse is output before the rotation detection of the rotor is carried out, and the pulse width is alterable.

(5) Even when the rotational motion of the rotor is moderated due to variation of a ring array load in accordance with time lapse and sudden increase of an external load torque, and the induced voltage required for the detection cannot be obtained, at least two kinds of detection assisting pulses serving as effective power are selected in accordance with the detection result and output to the stepping motor, so that the adjustment of the rotation attenuating motion of the rotor can be made and the detection precision can be improved.

(6) The detection assisting pulse having the required minimum effective power is selected and output to the stepping motor, so that the rotation detection can be stabilized and the consumption of the power by the detection assisting pulse can be minimized.

(Embodiment 4)

The detection assisting pulse output counter 12 for counting the output of the detection assisting pulse is provided on the circuit of the second embodiment. The electronic clock thus constructed is effective for a ring array mechanism which periodically generates a load torque to the motor, for example, a clock with a calender which has a jump-control spring for conducting an elastic jumping control on gears of a date wheel serving as a date indicating plate, for example.

(7) Even for a clock in which a load torque is periodically applied to a motor for a long time, for example in such a case where "the degree of moderation of the rotational motion of the motor is varied with time due to a load torque occurring in a date feeding operation", the output of the correction drive pulse due to the erroneous judgment and the consumption of current can be prevented through management of the output frequency of the detection assisting pulse such as an operation of outputting the detection assisting pulse until the load torque is reduced.

(Embodiment 5)

The detection assisting pulse output timing generating circuit 13 for altering the output start timing of the detection assisting pulse in accordance with the output result of the detecting circuit 6 obtained in the previous stepping operation is provided on the circuit of the first embodiment. According to the electronic clock having a construction such that the detection assisting pulse is output before the rotation detection of the rotor is carried out, and the pulse width thereof is altered, (8) The output of the detection assisting pulse can be met with the timing at which the rotational motion of the rotor is most likely to be amplified, and thus it is effective to keep the rotation detection result stable at all times.

(Embodiment 6, Embodiment 7, Embodiment 8)

The main drive pulse generating circuit 3 for generating plural main drive pulse signals is provided on the circuit of the first embodiment, and as a method of controlling (a) the detection assisting pulse output selecting circuit 10 for selecting whether the detection assisting pulse is output, (b) the detection assisting pulse width altering circuit 11 for altering the pulse width of the detection assisting pulse, and (c) the detection assisting pulse output timing generating circuit 13 for altering the output start timing of the detect assistant, the control is made in accordance with the signal of the main drive pulse generating circuit 3, so that:

(9) the number of the elements to be added to the circuit, and the circuit size can be miniaturized.

(Embodiment 9)

The alternating pulse has an effect on the improvement of the induced voltage required for the rotation detection of the rotor (by PAX), and on the control for preventing disorder of the rotor (a phenomenon that the rotor runs over a normal rest angular position, and rotates to a next rest angular position)(pulse PAY). The disorder of the rotor occurs when the driving voltage of the motor is high (a power source having high voltage, such as a lithium cell or the like).

As described above, the detection assisting pulse of this invention has great effects for stepping motors which are required to be miniaturized and thinned in construction, and have parts for which low current-consumption and high detection precision are required.

We claim:

1. An electronic timepiece comprising:

an oscillator circuit for generating a time standard signal;

a dividing circuit for dividing the time standard signal from the oscillator circuit and outputting a plurality of clock signals each having a different frequency;

a stepper motor having a rotor and a coil for driving a gear train;

a driving circuit for outputting an effective power pulse to drive the stepper motor;

a main drive pulse generating circuit for generating a main drive pulse signal to drive the stepper motor at a predetermined time interval in accordance with the plurality of clock signals from the dividing circuit;

a detecting circuit for detecting the rotational state of the rotor by comparing an induced voltage in the coil after application of the main drive pulse signal to the stepper motor with a reference voltage level, and for outputting a detection signal corresponding to a detection result;

a detection assisting pulse generating circuit for generating a detection assisting pulse signal having a smaller effective power than the main drive pulse signal in accordance with the plurality of clock signals from the dividing circuit, wherein the detection assisting pulse signal is effective to amplify the induced voltage level of the coil and is applied to the stepper motor at a time of detecting whether the rotor is being rotated by the main drive pulse signal;

a correction drive pulse generating circuit for generating a correction drive pulse signal having a larger effective power than the main drive pulse signal in accordance with the plurality of clock signals from the dividing circuit, wherein the correction drive pulse signal is applied to the stepper motor to rotate the rotor when the detection result of the detecting circuit indicates a non-rotation state of the rotor; and a drive pulse selecting circuit for selectively outputting the main drive pulse signal to the driving circuit at a predetermined time, for selectively outputting the detection assisting pulse signal to the driving circuit at a predetermined time, and for selectively outputting the correction drive pulse signal to the driving circuit a predetermined time period after application of the main drive pulse signal in accordance with the detection signal.

2. An electronic timepiece according to claim 1; wherein the detection assisting pulse generating circuit includes means for applying the detection assisting pulse signal to the stepper motor during a time period after application of the main drive pulse signal and before termination of rotation of the rotor.

3. An electronic timepiece according to claim 1; wherein the detection assisting pulse signal applied to the stepper motor has an opposite polarity from the main drive pulse signal.

4. An electronic timepiece according to claim 1; wherein the detection assisting pulse signal has a plurality of pulse components, at least one of the pulse components applied to the stepper motor has an opposite polarity from that of the main drive pulse signal and the remaining pulse components applied to stepper motor have the same polarity as the main drive pulse signal.

5. An electronic timepiece according to claim 1; wherein the drive pulse selecting circuit includes a detection assisting pulse output selecting circuit for selectively outputting the detection assisting pulse signal to the driving circuit only when a previous detection result of the detecting circuit indicates a non-rotation state of the rotor and the correction drive pulse signal is output.

6. An electronic timepiece according to claim 1; wherein the detection assisting pulse generating circuit includes means for generating a plurality of detection assisting pulse signals each having a different pulse width, and a detection assisting pulse width altering circuit for selectively outputting one of the detection assisting pulse signals having a relatively wide pulse width to the driving circuit when a previous detection result of the detecting circuit indicates a non-rotation state of the rotor and the correction drive pulse signal is output.

7. An electronic timepiece according to claim 1; wherein the detection assisting pulse generating circuit includes a detection assisting pulse counter for counting a predetermined number of the detection assisting pulses to be output after the correction drive pulse signal is output.

8. An electronic timepiece according to claim 1; wherein the detection assisting pulse generating circuit includes means for generating a plurality of detection assisting pulse signals each having a different output timing, and a detection assisting pulse output timing generating circuit for selectively outputting one of the detection assisting pulse signals having a relatively slow output timing to the driving circuit when a previous detection result of the detecting circuit indicates a non-rotation state of the rotor and the correction drive pulse signal is output.

9. An electronic timepiece according to claim 1; wherein the main drive pulse generating circuit includes means for generating a plurality of main drive pulse signals each having a different pulse width, and for outputting one of the main drive pulse signals having a relatively wide pulse width to the driving circuit when a previous detection result of the detecting circuit indicates a non-rotation state of the rotor and the correction drive pulse signal is output.

10. An electronic timepiece according to claim 9; wherein the drive pulse selecting circuit includes a detection assisting pulse output selecting circuit for selectively outputting the detection assisting pulse signal to the driving circuit only when the pulse width of the main drive pulse signal is wider than a predetermined pulse width.

11. An electronic timepiece according to claim 9; wherein the detection assisting pulse generating circuit includes means for generating a plurality of detection assisting pulse signals each having a different pulse width, and a detection assisting pulse width altering circuit for selectively outputting one of the detection assisting pulse signals having a relatively wide pulse width to the driving circuit when the pulse width of the main drive pulse signal is wider than a predetermined pulse width.

12. An electronic timepiece according to claim 9; wherein detection assisting pulse generating circuit includes means for generating a plurality of detection assisting pulse signals each having different output timing, and a detection assisting pulse output timing generating circuit for selectively outputting one of the detection assisting pulse signals having a relatively slow output timing to the driving circuit when a pulse width of the main drive pulse signal is wider than a predetermined pulse width.

13. A method of driving a stepper motor of an electronic timepiece including a stepper motor having a rotor and a coil for driving a gear train; the method comprising the steps of:

(a) outputting a main drive pulse signal to the stepper motor a predetermined time;

(b) outputting a detection assisting pulse signal having smaller effective power than the main drive pulse signal to the stepper motor for amplifying an induced voltage level in the coil due to oscillation of the rotor after application of the main drive pulse signal;

(c) detecting whether the rotor is rotating by comparing the induced voltage level with a reference voltage level at a predetermined time period after application of the detection assisting pulse signal; and (d) outputting a correction drive pulse signal having larger effective power than the main drive pulse signal to the stepper motor for rotating the rotor when the detection result indicates a non-rotation state of the rotor.

* * * * *